US007031912B2

(12) United States Patent
Yajima et al.

(10) Patent No.: US 7,031,912 B2
(45) Date of Patent: Apr. 18, 2006

(54) SPEECH CODING APPARATUS CAPABLE OF IMPLEMENTING ACCEPTABLE IN-CHANNEL TRANSMISSION OF NON-SPEECH SIGNALS

(75) Inventors: Hisashi Yajima, Tokyo (JP); Shigeaki Suzuki, Tokyo (JP); Hideaki Ebisawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 803 days.

(21) Appl. No.: 09/916,534

(22) Filed: Jul. 30, 2001

(65) Prior Publication Data

US 2002/0038210 A1 Mar. 28, 2002

(30) Foreign Application Priority Data

Aug. 10, 2000 (JP) ..... 2000-243114

(51) Int. Cl.
*G10L 11/06* (2006.01)

(52) U.S. Cl. ..... 704/208; 704/265; 704/230

(58) Field of Classification Search ..... 704/201, 704/208, 215, 219, 222, 230
See application file for complete search history.

(56) References Cited

U.S. PATENT DOCUMENTS

| | | | | |
|---|---|---|---|---|
| 4,393,272 | A | 7/1983 | Itakura et al. | |
| 5,835,480 | A * | 11/1998 | Chennakeshu | 370/206 |
| 5,913,189 | A | 6/1999 | Lee et al. | |
| 6,230,255 | B1 * | 5/2001 | Asghar et al. | 712/32 |
| 6,424,940 | B1 * | 7/2002 | Agassy et al. | 704/219 |
| 6,708,146 | B1 * | 3/2004 | Sewall et al. | 704/217 |

FOREIGN PATENT DOCUMENTS

| | | |
|---|---|---|
| EP | B1577488 | 1/1994 |
| EP | 0 742 548 A2 | 11/1996 |
| EP | B1577488 | 4/1997 |
| WO | WO 98/04046 A2 | 1/1998 |
| WO | WO 99/31895 A1 | 6/1999 |

OTHER PUBLICATIONS

Shapira I et al.; A Variable Bit Rate Operation of LD-CELP Mainly for VBD Applications in DCME; 1997 IEEE; pp. 73-74.*

Dimolitsas S et al. ; Performance of CCITT's 16kbits/s LD-CELP Algorithm with Non-Voice Signals; COMSAT Laboratories, USA, 1992, IEEE, pp. 1704-1708.*

(Continued)

*Primary Examiner*—Abul K. Azad
(74) *Attorney, Agent, or Firm*—Birch, Stewart, Kolasch & Birch, LLP

(57) ABSTRACT

A speech coding apparatus includes a frequency parameter generating unit that generates LSP coefficients of an input signal. When the input signal is a non-speech signal, it generates the LSP coefficients of the non-speech signal in such a manner that they approach the LSP coefficients of the speech signal. Thus, even when the input signal is the non-speech signal, its LSP coefficients are quantized by referring to the LSP quantization codebook which is specifically prepared for the speech signal. Although a conventional speech coding apparatus has a problem in that even when it transmits the non-speech signal in a good condition, a conventional speech decoding apparatus cannot always decode the non-speech signal correctly, the present speech coding apparatus can solve the problem even when the receiving side uses the conventional speech decoding apparatus.

19 Claims, 30 Drawing Sheets

OTHER PUBLICATIONS

Salami et al.; ITU-T G.729 Annex A: Reduced complexity 8kb/s CS-ACELP Codec for Digital Simultaneous Voice and data, IEEE Communication Magazine; Sep. 1997; pp. 56-63.*

Neto et al.; Performance of ITU-T G.729 8kb/s CS-ACELP Speech Codec with Nonvoice Narrowband Signals; IEEE Communication Magazine; Sep. 1997; pp. 82-91.*

International Telecommunication Union, Recommendation G.279, 35 pages (1996).

Salami, IEEE Transactions on Speech and Audio Processing, Vo, 6, No. 2, pp. 116-130 (1998).

Y. Tohkura et al., "Spectral Smoothing Technique in Parco Speech Analysis-Synthesis," IEEE Transactions on Acoustics, Speech, and Signal Processing, vol. ASSP-26, No. 6, Dec. 1, 1978, pp. 587-596.

Ramakrishnan, S., et al., "Constrained-Storage Vector Quantization Universal Codebook," Proceedings Data Compression Conference, Mar. 28-30, 1995, pp. 42-51, Snowbird, UT, USA (Abstract) ; IEEE Transactions on Image Processing, vol. 7, No. 6, Jun. 1998.

* cited by examiner

SPEECH CODING APPARATUS CAPABLE OF IMPLEMENTING ACCEPTABLE IN-CHANNEL TRANSMISSION OF NON-SPEECH SIGNALS

BACKGROUND OF THE INVENTION

1. Field of the Invention

The present invention relates to a speech coding apparatus used for digital wire communication or radio communication of a speech signal to encode the speech signal according to prescribed algorithm, and particularly to a speech coding apparatus capable of transmitting non-speech signals in a voice frequency band such as DTMF (Dual Tone Multi-Frequency) signals and PB (Push Button) signals.

2. Description of Related Art

Reduction in communication cost is required in intra-corporate communications. To implement low bit rate transmission of speech signals that occupy a considerable portion of communication traffic, an increasing number of systems employ speech coding/decoding schemes typified by speech coding at 8-kbit/s CS-ACELP (Conjugate-Structure Algebraic-Code-Excited Linear Prediction) based on ITU-T recommendation G.729 described in "ITU-T Recommendation G.729 Coding of Speech at 8-kbit/s using Conjugate-Structure Algebraic-Code-Excited Linear Prediction(CS-ACELP)" (Published by International Telecommunication Union).

Speech coding methods such as the 8-kbit/s CS-ACELP whose transmission rate is 8 kbit/s or so reduce the amount of information after coding under the assumption that the input signals are a speech signal and by making use of the characteristics of the speech signal to obtain high quality speech with a small amount of information.

FIG. 27 is a block diagram showing a configuration of a first conventional speech coding apparatus employing the 8-kbit/s CS-ACELP; and FIG. 28 is a block diagram showing a configuration of the LSP quantizer and LSP quantization codebook of FIG. 27.

In FIG. 27, the reference numeral 201 designates a pre-processing section for carrying out pre-processing such as scaling and high-pass filtering of an input signal; 202 designates a linear prediction analyzer for calculating linear prediction (LP) coefficients from the input signal according to the linear prediction, and for converting the LP coefficients to line spectral pair (LSP) coefficients; 203 designates an LSP quantizer for selecting quantized samples corresponding to the LSP coefficients by referring to an LSP quantization codebook 204; and 204 designates the LSP quantization codebook including the quantized samples (LSP samples) of the LSP coefficients to which codebook indices are assigned.

The reference numeral 205 designates an LSP inverse-quantizer for computing the LSP coefficients corresponding to the codebook indices by referring to the LSP quantization codebook 204; 206 designates an LSP-to-LPC converter for converting the LSP coefficients to the LP coefficients; 207 designates a synthesis filter for synthesizing a speech signal by filtering using the LP coefficients generated by the LSP-to-LPC converter 206; 208 designates a subtracter; 209 designates a perceptual weighting filter for reducing noise offensive to the ear by handling noise components due to quantization errors in response to the frequency distribution of the speech signal; and 210 designates a distortion minimizing section for minimizing the mean-squared error of the speech signal passing through the weighting by the perceptual weighting filter 209, by comparing the synthesized speech signal from the synthesis filter 207 with the input speech signal.

The reference numeral 211 designates an adaptive codebook for storing a past excitation signal sequence for computing considerably long term components (from about 18 to 140 samples) of the speech signal; 212 designates a noise codebook for storing a plurality of random pulse trains; 213 designates a gain codebook for storing a plurality of gain parameters; 214, 215 and 216 each designate a multiplier; 217 designates a gain predictor for supplying the multiplier 215 with coefficients for regulating the amplitude of the noise; 218 designates an adder; and 219 designates a multiplexer for multiplexing the codebook indices of the selected LSP samples and the codebook indices of the coding parameters selected by the coded distortion minimizing section 210.

In FIG. 28, the reference numeral 301 designates a first stage LSP codebook for storing a plurality of prescribed quantization LSP coefficients extracted from a lot of speech data by learning; 302 designates a second stage LSP codebook for storing a plurality of prescribed quantization LSP coefficients used for fine adjustment; and 303 designates an MA prediction coefficient codebook for storing a predetermined number of sets of MA (Moving Average) prediction coefficients.

The reference numeral 311 designates an adder; 312 designates a multiplier; 313 designates an MA prediction component calculating section for computing MA prediction components by multiplying a predetermined number of past outputs of the adder 311 by one of the sets of the MA prediction coefficients; 314 designates an adder; 315 designates a subtracter for computing the quantization errors of the LSP coefficients by subtracting the LSP coefficients that are computed from the coefficients of the LSP quantization codebook 204 from the LSP coefficients fed from the linear prediction analyzer 202; 316 designates a quantization error weighting coefficient calculating section for computing, using the LSP coefficients of respective orders, the weighting coefficients to be multiplied by the quantization error signal of the LSP coefficients output from the subtracter 315; and 317 designates a distortion minimizing section for searching the codebooks 301, 302 and 303 for combinations of such quantized samples as minimizing the power of the quantization error signal passing through the weighting using the coefficients computed by the quantization error weighting coefficient calculating section 316, and for outputting the codebook indices corresponding to the samples selected.

Next, the operation of the first conventional speech coding apparatus will be described.

The input speech signal is subjected to the pre-processing such as scaling by the pre-processing section 201, and then supplied to the linear prediction analyzer 202 and subtracter 208.

The linear prediction analyzer 202 computes the LP coefficients from the input signal according to the linear prediction, followed by converting the LP coefficients to the LSP coefficients to be supplied to the LSP quantizer 203.

Referring to the LSP quantization codebook 204, the LSP quantizer 203 selects the LSP samples corresponding to the LSP coefficients, and outputs their codebook indices. In this case, as shown in FIG. 28, the adder 311 of the LSP quantizer 203 adds the coefficients from the first stage LSP codebook 301 to those from the second stage LSP codebook 302 in the LSP quantization codebook 204, and supplies the sums to the multiplier 312 and MA prediction component calculating section 313. Besides, the MA prediction coefficient codebook 303 of the LSP quantization codebook 204 supplies the MA prediction coefficients to the multiplier 312 and MA prediction component calculating section 313. The multiplier 312 multiplies the output of the adder 311 by the MA prediction coefficients, and supplies the products to the adder 314. The MA prediction component calculating section 313 stores a predetermined number of past outputs of the adder 311 and the MA prediction coefficients, calculates the sums of the products of the outputs of the adder 311 and the MA prediction coefficients at the respective time points, and supplies them to the adder 314. The adder 314 calculates the sums of the input values, and supplies them to the subtracter 315. The subtracter 315 subtracts the output of the adder 314 (that is, the LSP coefficients obtained from the LSP quantization codebook 204) from the LSP coefficients fed from the linear prediction analyzer 202, and supplies the quantization error signal of the LSP coefficients to the distortion minimizing section 317. The distortion minimizing section 317 multiplies the quantization error signal of the LSP coefficients by the weighting coefficients fed from the quantization error weighting coefficient calculating section 316, and computes their square sum. Then, it searches the codebooks 301, 302 and 303 for the LSP coefficients that will minimize the square sum, and outputs the codebook indices corresponding to the selected LSP coefficients. As for the detail of the operation, it is described in "Quantization Method of LSP Coefficients and Gain of CS-ACELP", by Kataoka, et. al., pp.331–336, NTT R&D Vol.45, No.4, 1996. Thus, the spectrum envelope of the speech signal is quantized efficiently.

The LSP codebook indices selected by the LSP quantizer 203 are supplied to the multiplexer 219 and the LSP inverse-quantizer 205.

In response to the codebook indices supplied, and ref erring to the LSP quantization codebook 204, the LSP inverse-quantizer 205 generates the LSP coefficients, and supplies them to the LSP-to-LPC converter 206. The LSP-to-LPC converter 206 converts the LSP coefficients to the LP coefficients, and supplies them to the synthesis filter 207.

On the other hand, the adaptive codebook 211 stores long term components of a plurality of excitation vectors (pitch period excitation vectors), and the noise codebook 212 stores noise components of the plurality of excitation vectors. The codebooks each output one vector, and the adder 218 adds the two vectors (long term component and noise component), and supplies the resultant excitation vector to the synthesis filter 207.

The synthesis filter 207 generates a speech signal by filtering the excitation vector with a filtering characteristic based on the LP coefficients fed from the LSP-to-LPC converter 206, and supplies the speech signal to the subtracter 208.

The subtracter 208 subtracts the synthesized speech signal from the input speech signal after the pre-processing, and supplies the errors between them to the perceptual weighting filter 209. The perceptual weighting filter 209 regulates the filter coefficients adaptively in response to the spectrum envelope of the input speech signal, carries out the filtering of the speech signal error, and supplies the errors after the filtering to the distortion minimizing section 210.

The distortion minimizing section 210 repeatedly selects the long term components of the excitation vectors output from the adaptive codebook 211, the noise components of the excitation vectors output from the noise codebook 212 and gain parameters output from the gain codebook 213, calculates the errors between the synthesized speech signal and the input speech signal, and supplies the multiplexer 219 with the codebook indices of the adaptive codebook, noise codebook and gain codebook that will minimize the mean-squared error.

The multiplexer 219 multiplexes the codebook indices of the LSP samples with the codebook indices of the adaptive codebook, noise codebook and gain codebook, and transmits them through the transmission line.

In this way, according to the CELP, the first conventional speech coding apparatus generates time sequential signals as the voice source corresponding to human vocal cords in response to the coding parameters stored in the codebooks 211, 212 and 213, and drives the synthesis filter 207 (linear filter corresponding to the voice spectrum envelope) that models human vocal tract information by the signal, thereby reproducing the speech signal to select optimum coding parameters, the detail of which is described in "Basic Algorithm of CS-ACELP", by Kataoka, et. al., pp. 325–330, NTT R&D Vol.45, No.4, 1996.

As described above, the LSPs (line spectral pairs) are widely used for the method of expressing the spectrum envelope of the speech signal in the conventional speech coding apparatus that compresses and codes the speech signal into a low bit rate speech signal efficiently. The CS-ACELP system also utilizes the LSP coefficients as the frequency parameters for transmitting the speech spectrum envelope, the detail of which is described in "Speech Information Compression By Line Spectral Pair (LSP) Speech Analysis and Synthesis", by Sugamura and Itakura, pp.599–606, the Journal of the Institute of Electronics and Communication Engineers of Japan, 81/08 Vol. J64-A, No.8.

Thus, the foregoing conventional speech coding apparatus, which calculates the moving average prediction of the LSP codebook coefficients using the MA prediction coefficients, can quantize the LSP coefficients of the signal with little variations in frequency characteristics, that is, the signal having large correlation between frames. In addition, it can express the contour of the spectrum envelope of the speech signal by using the first stage LSP codebook based on learning in combination with the second stage LSP codebook based on random number, although it lacks mathematical precision. In addition, using the second stage codebook based on the random number makes it possible to flexibly follow slight variations in the spectrum envelope. Accordingly, the foregoing conventional speech coding apparatus can encode the characteristics of the spectrum envelope of the speech signal efficiently.

However, using the coding algorithm specialized for speech, the speech coding apparatus will degrade the transmission characteristics of signals other than the speech signal in the voice frequency band, such as DTMF (dual tone multi-frequency) signals output from a push-button telephone, No.5 signaling and modem signals.

The non-speech signal, particularly the DTMF signals has the following characteristics: (1) Their spectrum envelopes differ markedly from those of the speech signal; (2) The spectrum characteristics and gain little vary during the signal burst, but the spectrum characteristics change sharply between the signal burst and pause; (3) Since the quantization distortion of the LSP coefficients directly affects the frequency distortion of the DTMF signals, the LSP quantization distortion should be reduced as much as possible.

Thus, it is difficult for the conventional speech coding apparatus to code the non-speech signals like the DTMF signals with such characteristics. In particular, in a low bit rate transmission, the redundancy is small, and hence it is inappropriate for the non-speech signals to make use of the same scheme as the speech signal.

Incidentally, the intracorporate communications usually do not have a signal line dedicated for signaling for a call connection in the telephone communication, but make use of in-channel signaling transmission of the DTMF signals. In this case, when the transmission line assigned utilizes the above-described low bit rate speech coding, the transmission characteristics of the DTMF signals will be degraded, thereby bringing about erroneous call connections at a rather high probability.

To solve such a problem, a second conventional speech coding apparatus is proposed by Japanese patent application laid-open No.9-81199/1997, for example. FIG. 29 is a block diagram showing a configuration of the second conventional speech coding apparatus. In FIG. 29, the reference numeral 501 designates a conventional speech coding apparatus, and 502 designates a speech decoding apparatus for decoding the code generated by the speech coding apparatus 501.

In the speech coding apparatus 501, the reference numeral 511 designates a coder for encoding the speech signal; 512 designates a DTMF detector for detecting the DTMF signals from the input voice band signal; 513 designates a DTMF coding pattern memory for prestoring coding patterns corresponding to the DTMF signals; and 514 designates a selector switch.

In the speech decoding apparatus 502, the reference numeral 521 designates a decoder for decoding the code corresponding to the speech signal in the signal received via the transmission line, and for outputting the speech signal; 522 designates a DTMF coding pattern detector for detecting the coding pattern of the DTMF signals from the code received via the transmission line by referring to the DTMF coding pattern memory 523; 523 designates a DTMF coding pattern memory for prestoring the coding patterns corresponding to the DTMF signals; 524 designates a DTMF generator for generating the DTMF signals corresponding to the detected coding patterns; and 525 designates a selector switch.

Next, the operation of the second conventional speech coding apparatus will be described.

In the speech coding apparatus 501, the coder 511 encodes the input signal as a speech signal, and supplies it to the selector switch 514. The DTMF detector 512, detecting the DTMF signals from the input signal, supplies the DTMF coding pattern memory 513 with the types of the detected DTMF signals, and the selector switch 514 with the control signal for causing the selector switch 514 to select the output from the DTMF coding pattern memory 513.

Receiving the information about the types of the detected DTMF signals from the DTMF detector 512, the DTMF coding pattern memory 513 supplies the selector switch 514 with the code corresponding to the DTMF signals of the types.

When the DTMF signals are detected, the selector switch 514 selects the code from the DTMF coding pattern memory 513 in response to the control signal fed from the DTMF detector 512, and transmits the code via the transmission line. Otherwise, it selects the code fed from the coder 511, and transmits it through the transmission line.

In the speech decoding apparatus 502, on the other hand, the code received is supplied to the decoder 521 and the DTMF coding pattern detector 522. The decoder 521 decodes the code into the speech signal, and supplies it to the selector switch 525. On the other hand, the DTMF coding pattern detector 522 makes a decision as to whether the received code is the code of the DTMF signals or not by comparing it with the code corresponding to the DTMF signals stored in the DTMF coding pattern memory 523. When the received code is the code of the DTMF signals, the DTMF coding pattern detector 522 supplies the DTMF generator 524 with the types of the DTMF signals, and the selector switch 525 with the control signal for causing the selector switch 525 to select the signal from the DTMF generator 524.

When the code of the DTMF signals is detected, the selector switch 525 selects the DTMF signals fed from the DTMF generator 524 in response to the control signal from the DTMF coding pattern detector 522 and outputs them. Otherwise, it selects the speech signal fed from the decoder 521 and outputs it.

In this way, the second conventional speech coding apparatus detects the DTMF signals from the input voice band signal, and when the DTMF signals are detected, it outputs the prestored code corresponding to the DTMF signals, and when the DTMF signals are not detected, the coder 511 outputs the code it encodes.

As another technique to solve the foregoing problem, the assignee of the present invention proposed the speech coding apparatus disclosed in Japanese patent application laid-open No.11-259099/1999. FIG. 30 is a block diagram showing a configuration of the speech coding apparatus proposed therein; and FIG. 31 shows a speech decoding apparatus for decoding the code generated by the speech coding apparatus as shown in FIG. 30.

In FIG. 30, the reference numeral 601 designates a coder comprising a coding function block 611 for coding the speech signal, and a coding function block 612 for coding the non-speech signal; 602 designates a speech/non-speech signal discriminator for deciding as to whether the input signal is a speech signal or a non-speech signal, and outputs the decision result; 603 and 604 each designate a selector switch; and 605 designates a multiplexer for multiplexing the decision result from the speech/non-speech signal discriminator 602 and codewords from the coder 601, to be transmitted through the transmission line.

In FIG. 31, the reference numeral 651 designates a demultiplexer for demultiplexing the signals multiplexed by the multiplexer 605, that is, the decision result of the speech/non-speech signal discriminator 602 and the codewords output from the coder 601; 652 designates a decoder comprising a decoding function block 661 for decoding the codewords of the speech signal, and a decoding function block 662 for decoding the codewords of the non-speech signal; and 653 and 654 each designate a selector switch.

Next, the operation of the third conventional speech coding apparatus will be described.

In the speech coding apparatus as shown in FIG. 30, the speech/non-speech signal discriminator 602 always monitors the input signal to make a decision at to whether it is a speech signal or a non-speech signal, and from the decision result, it decides the operation mode of the coder 601. When the speech/non-speech signal discriminator 602 makes a decision that the input signal is the speech signal, it controls the selector switches 603 and 604 so that the coding function block 611 for the speech signal codes the input signal, whereas when it makes a decision that the input signal is the non-speech signal, it controls the selector switches 603 and 604, so that the coding function block 612 for the non-speech signal codes the input signal.

The multiplexer 605 multiplexes the codewords generated by the speech signal coding function block 611 or the non-speech signal coding function block 612 in the coder 601 with the decision result of the speech/non-speech signal discriminator 602, to be transmitted through the transmission line.

In the speech decoding apparatus as shown in FIG. 31, the demultiplexer 651 demultiplexes the signal received via the transmission line into the codewords generated by the coder 601 and the decision result by the speech/non-speech signal discriminator 602, and supplies the decision result to the selector switches 653 and 654, and the codewords to the decoder 652.

When the decision result indicates the speech signal, the selector switches 653 and 654 select the speech signal decoding function block 661 to decode the received codewords. In contrast, when the decision result indicates the non-speech signal, the selector switches 653 and 654 select the non-speech signal decoding function block 662 to decode the received codewords. The decoded speech signal or non-speech signal is output from the decoder 652.

In this way, the system can transmit the speech signal and non-speech signal via the same transmission line without changing the transmission rate and with maintaining the speech quality as much as possible.

However, it is sometimes difficult for the intracorporate communication system, which installs the speech coding apparatus on the transmission side and the speech decoding apparatus on the receiving side, to simultaneously replace the apparatuses on both the transmission side and receiving side by new apparatuses because of various reasons such as cost or management in the company.

With the foregoing arrangements, the conventional speech coding apparatus such as the intracorporate communication system (a communication system for multiplexing multimedia, for example) installing a speech codec according to the CS-ACELP based on the ITU-T recommendation G.729 has the following problem. To achieve the in-channel transmission of the DTMF signals, the speech coding apparatus on the transmission side must be replaced by the speech coding apparatus that can transmit the non-speech signal well. However, it offers a problem in that the speech decoding apparatus on the receiving side, which remains conventional, cannot receive the non-speech signal satisfactorily.

SUMMARY OF THE INVENTION

The present invention is implemented to solve the foregoing problem. It is therefore an object of the present invention to provide a speech coding apparatus capable of carrying out in-channel transmission of the non-speech signal such as the DTMF signals without changing the speech decoding apparatus on the receiving side.

According to a first aspect of the present invention, there is provided a speech coding apparatus for coding an input signal consisting of one of a speech signal and a voice-band non-speech signal, the speech coding apparatus comprising: discriminating means for deciding as to whether the input signal is a speech signal or a non-speech signal; frequency parameter generating means for outputting, when the input signal is the speech signal, frequency parameters that indicate characteristics of a frequency spectrum of the speech signal, and for outputting, when the input signal is the non-speech signal, frequency parameters obtained by correcting frequency parameters that indicate characteristics of a frequency spectrum of the non-speech signal; a quantization codebook for storing codewords of a predetermined number of frequency parameters; and quantization means for selecting codewords corresponding to the frequency parameters output from the frequency parameter generating means by referring to the quantization codebook.

Here, the frequency parameters may be line spectral pairs.

The frequency parameter generating means may comprise a correcting section for interpolating frequency parameters between the frequency parameters of the input signal and frequency parameters of white noise when the input signal is the non-speech signal, and for replacing the frequency parameters of the input signal by the frequency parameters interpolated.

The frequency parameter generating means may comprise a linear prediction analyzer for computing linear prediction coefficients from the input signal, at least one bandwidth expanding section for carrying out bandwidth expansion of the linear prediction coefficients when the input signal is the non-speech signal; and at least one converter for generating line spectral pairs from the linear prediction coefficients passing through the bandwidth expansion as the frequency parameters.

The frequency parameter generating means may comprise at least one white noise superimposing section for superimposing white noise on the input signal when the input signal is the non-speech signal, and at least one linear prediction analyzer for computing linear prediction coefficients from the input signal on which the white noise is superimposed.

The quantization means may comprise a first quantization section for selecting, when the input signal is the speech signal, codewords of the input signal according to the frequency parameters of the speech signal by referring to quantization codebook, and a second quantization section for selecting, when the input signal is the non-speech signal, codewords of the input signal according to the frequency parameters of the non-speech signal by referring to quantization codebook.

The speech coding apparatus may further comprise a non-speech signal detector for detecting a type of the non-speech signal from the input signal, wherein the frequency parameter generating means may comprise a correcting section for correcting, when the input signal is the non-speech signal, the frequency parameters of the input signal according to the type of the non-speech signal detected by the non-speech signal detector.

The speech coding apparatus may further comprise selecting means for selecting a codeword that will minimize quantization distortion from a plurality of codewords, wherein the frequency parameter generating means may comprise correcting means for correcting the frequency parameters of the non-speech signal when the input signal is the non-speech signal, the correcting means including one of three sets consisting of a plurality of correcting sections, a plurality of bandwidth expansion sections and a plurality of white noise superimposing sections, the correcting sections correcting the frequency parameters of the non-speech signal with different interpolation characteristics between the frequency parameters of the input signal and frequency parameters of white noise, the bandwidth expansion sections carrying out bandwidth expansion of the non-speech signal by different characteristics, and the white noise superimposing sections superimposing different level white noises on the input signal, and the frequency parameter generating means may generate the frequency parameters of a plurality of non-speech signal streams from the outputs of the correcting means; the quantization means may include a plurality of quantization sections for selecting codewords corresponding to the frequency parameters of the non-speech signal streams, and for outputting the codewords with quantization distortions at that time; and the selecting means may select codeword that will minimize quantization distortion from the plurality of codewords selected by the quantization sections.

According to a second aspect of the present invention, there is provided a speech coding apparatus for coding an input signal consisting of one of a speech signal and a voice-band non-speech signal, the speech coding apparatus comprising: discriminating means for deciding as to whether the input signal is a speech signal or a non-speech signal; frequency parameter generating means for generating frequency parameters that indicate characteristics of a frequency spectrum of the input signal; a quantization codebook for storing codewords of a predetermined number of frequency parameters; at least one codebook subset including a subset of the codewords stored in the quantization codebook; and quantization means for selecting, when the input signal is the speech signal, codewords corresponding to the frequency parameters of the input signal by referring to the quantization codebook, and for selecting, when the input signal is the non-speech signal, codewords corresponding to the frequency parameters of the input signal by referring to the codebook subset.

Here, the frequency parameters may be line spectral pairs.

The codebook subset may consist of codewords selected from among the codewords in the quantization codebook, the codewords selected having small quantization distortion involved in quantizing the frequency parameters of the non-speech signal.

The speech coding apparatus may further comprise codeword selecting means for adaptively selecting, from among the codewords in the quantization codebook, codewords with small quantization distortion involved in quantizing the frequency parameters of the non-speech signal, wherein the codebook subset may include the codewords output from the codeword selecting means.

The speech coding apparatus may further comprise a non-speech signal detector for detecting a type of the non-speech signal from the input signal, wherein the codebook subset may include a plurality of codebook subsets corresponding to the types of the non-speech signal detected by the non-speech signal detector; and the quantization means may include a selector for selecting, when the input signal is the non-speech signal, one of the plurality of codebook subsets according to the type of the non-speech signal detected by the non-speech signal detector, in order to select a codeword corresponding to the frequency parameters of the non-speech signal.

The speech coding apparatus may further comprise a correcting section for correcting the frequency parameters of the non-speech signal, wherein according to the frequency parameters after the correction by the correcting section, the codeword selecting means may adaptively select, from among the codewords in the quantization codebook, codewords that will cause small quantization distortion in quantizing the frequency parameters of the non-speech signal, and supply the selected codewords to the codebook subset.

The speech coding apparatus may further comprise second frequency parameter generating means for generating frequency parameters by interpolating between the frequency parameters of the input signal and frequency parameters of white noise, wherein the codeword selecting means may quantize the frequency parameters generated by the second frequency parameter generating means, and select the codewords of the codebook subset considering quantization distortion involved in the quantization.

The speech coding apparatus may further comprise second frequency parameter generating means including a linear prediction analyzer for computing linear prediction coefficients from the input signal, a bandwidth expansion section for carrying out bandwidth expansion of the linear prediction coefficients, and a converter for generating, as the frequency parameters, line spectral pairs from the linear prediction coefficients passing through the bandwidth expansion, wherein the codeword selecting means may quantize the frequency parameters generated by the second frequency parameter generating means, and select the codewords of the codebook subset considering quantization distortion involved in the quantization.

The speech coding apparatus may further comprise second frequency parameter generating means including a white noise superimposing section for superimposing white noise on the input signal, and a converter for generating the frequency parameters from the input signal on which the white noise is superimposed, wherein the codeword selecting means may quantize the frequency parameters generated by the second frequency parameter generating means, and select the codewords of the codebook subset considering quantization distortion involved in the quantization.

The frequency parameter generating means may comprise: a linear prediction analyzer for computing linear prediction coefficients from the input signal; and an LPC-to-LSP converter for converting the linear prediction coefficients into line spectral pairs used as the frequency parameters; and the quantization means may comprise: an inverse synthesis filter for carrying out inverse synthesis filtering of the input signal according to filtering characteristics based on the linear prediction coefficients when the input signal is the non-speech signal; an LSP inverse-quantization section for generating line spectral pairs by dequantizing codewords in the codebook subset when the input signal is the non-speech signal; an LSP-to-LPC converter for converting the line spectral pairs generated by the LSP inverse-quantization section into linear prediction coefficients; a synthesis filter for carrying out synthesis filtering of the signal generated by the inverse synthesis filter according to filtering characteristics based on the linear prediction coefficients output from the LSP-to-LPC converter; and a distortion minimizing section for selecting codewords that will minimize quantization distortion when the input signal is the non-speech signal according to errors between the input signal and the speech signal synthesized by the synthesis filter.

The frequency parameter generating means may comprise: a linear prediction analyzer for computing linear prediction coefficients from the input signal; and an LPC-to-LSP converter for converting the linear prediction coefficients into line spectral pairs used as the frequency parameter; and the quantization means may comprise: an inverse synthesis filter for carrying out inverse synthesis filtering of the input signal according to filtering characteristics based on the linear prediction coefficients when the input signal is the non-speech signal; an LSP inverse-quantization section for generating line spectral pairs by dequantizing codewords in the codebook subset when the input signal is the non-speech signal; an LSP-to-LPC converter for converting the line spectral pairs generated by the LSP inverse-quantization section into linear prediction coefficients; a synthesis filter for carrying out synthesis filtering of the signal generated by the inverse synthesis filter according to filtering characteristics based on the linear prediction coefficients output from the LSP-to-LPC converter; a first non-speech signal detector for detecting a non-speech signal from the input signal; a second non-speech signal detector for detecting a non-speech signal from the speech signal output from the synthesis filter; and a comparator for selecting codewords that will make a type of the non-speech signal that is detected by the first non-speech signal detector identical to a type of the non-speech signal that is detected by the second non-speech signal detector.

The speech coding apparatus may further comprise optimization means for causing the quantization means to select optimum codewords according to a closed loop search method by comparing the input signal with a signal that is decoded from the codewords selected by the quantization means.

DETAILED DESCRIPTION OF THE PREFERRED EMBODIMENTS

The invention will now be described with reference to the accompanying drawings.

Embodiment 1

Figure 1:
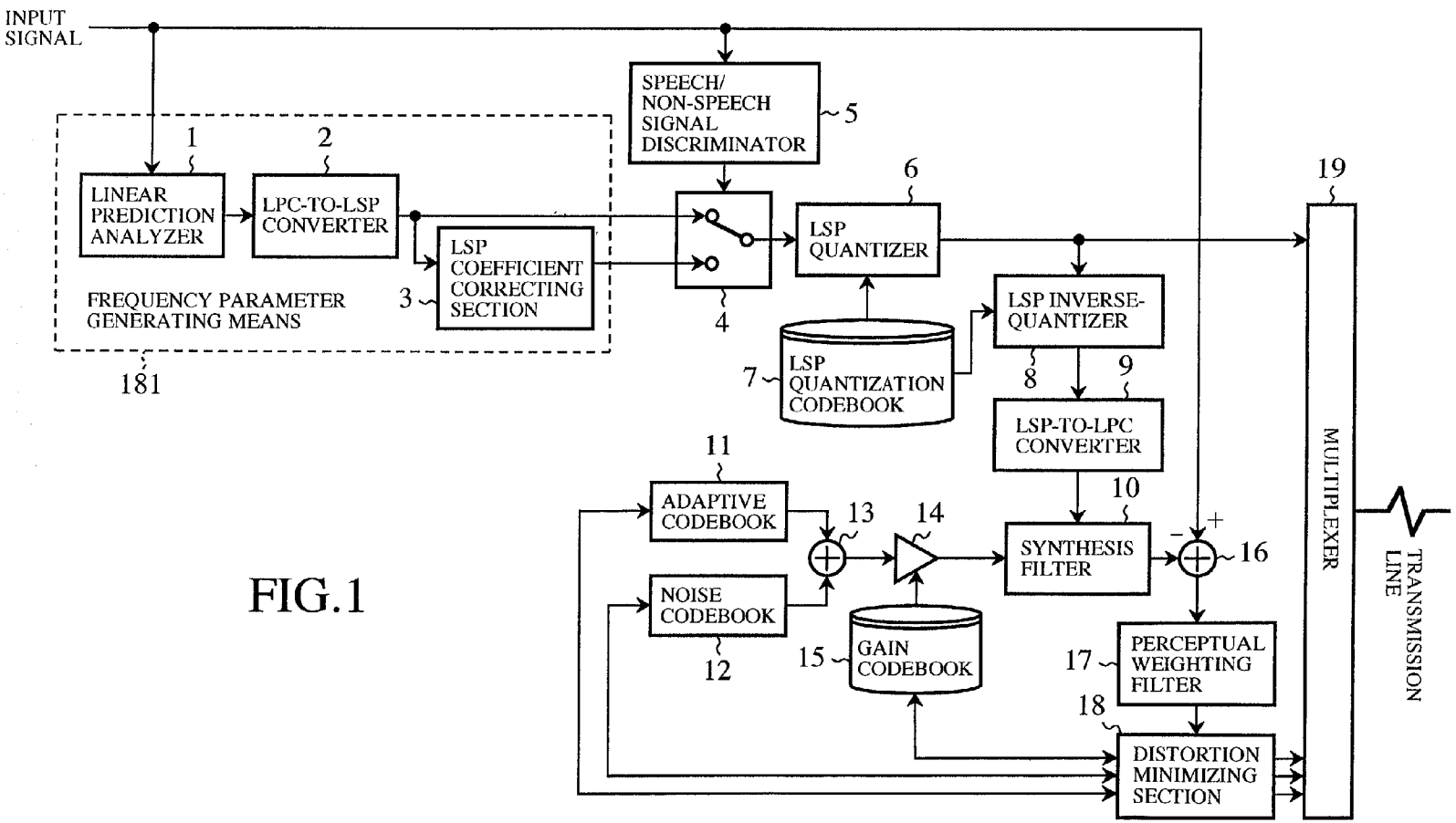
FIG. 1 is a block diagram showing a configuration of an embodiment 1 of the speech coding apparatus in accordance with the present invention.

FIG. 1 is a block diagram showing a configuration of an embodiment 1 of the speech coding apparatus in accordance with the present invention. In this figure, the reference numeral 1 designates a linear prediction analyzer for computing LP coefficients from an input signal according to linear prediction; 2 designates an LPC-to-LSP converter for converting the LP coefficients to line spectral pair (LSP) coefficients; 3 designates an LSP coefficient correcting section for correcting the distribution of the LSP coefficients of the input signal such that it approaches the distribution of the LSP coefficients of a speech signal on the basis of the distribution of the LSP coefficients of the white noise; 4 designates a selector switch; 5 designates a speech/non-speech signal discriminator for determining whether the input signal is a speech signal or a non-speech signal; 6 designates an LSP quantizer for quantizing the LSP coefficients by referring to an LSP quantization codebook 7 that stores the quantized LSP coefficients (LSP samples) in conjunction with the codebook indices; 8 designates an LSP inverse-quantizer for converting the codebook indices to the LSP coefficients by referring to quantization codebook 7; 9 designates an LSP-to-LPC converter for converting the LSP coefficients to the LP coefficients; and 10 designates a synthesis filter for carrying out linear prediction operation using the LP coefficients.

The reference numeral 11 designates an adaptive codebook for storing past excitation signal sequences in order to compute comparatively long term (of about 18–140 samples) components of the speech signal; 12 designates a noise codebook for storing a plurality of random pulse trains; 13 designates an adder; 14 designates a multiplier; and 15 designates a gain codebook for storing a plurality of gain parameters.

The reference numeral 16 designates a subtracter; 17 designates a perceptual weighting filter for reducing noise offensive to the ear by handling the spectra of the noise components resulting from quantization errors in response to the frequency distribution of the speech signal; 18 designates a distortion minimizing section for selecting coding parameters of the codebooks 11, 12 and 15 that will minimize the mean-squared error between the input signal and the synthesized speech signal output from the perceptual weighting filter 17, and for outputting the codebook indices corresponding to them; and 19 designates a multiplexer for multiplexing the codebook indices (LSP codebook indices) of the selected LSP samples with the codebook indices of the coding parameters selected by the distortion minimizing section 18.

The reference numeral 181 designates a frequency parameter generating means for generating the LSP coefficients (frequency parameters) from the input signal.

Next, the operation of the present embodiment 1 will be described.

The linear prediction analyzer 1 computes tenth-order LP coefficients, for example, from the input signal according to the linear prediction. The LPC-to-LSP converter 2 converts the LP coefficients to the LSP coefficients, and supplies the LSP coefficients to the selector switch 4 and LSP coefficient correcting section 3.

The LSP coefficient correcting section 3 corrects the LSP coefficients obtained by analyzing the input signal in such a manner that the distribution of the LSP coefficients is brought as close as possible to the distribution of the samples of the LSP coefficients prestored in the LSP quantization codebook 7, and supplies the LSP coefficients after the correction to the selector switch 4.

On the other hand, the speech/non-speech signal discriminator 5 makes a decision as to whether the input signal is a speech signal or a non-speech signal such as the DTMF signals, and controls the selector switch 4 in response to the decision result, so that when the input signal is a speech signal, the LSP coefficients are directly supplied from the LPC-to-LSP converter 2 to the LSP quantizer 6, whereas when the input signal is the non-speech signal, the LSP coefficients after the correction are supplied from the LSP coefficient correcting section 3 to the LSP quantizer 6. Consequently, this is equivalent to that the correction of the LSP coefficients is performed only when the input signal is the non-speech signal such as the DTMF signals.

Referring to the LSP quantization codebook 7, the LSP quantizer 6 selects the LSP coefficients that will minimize the mean-squared error (least square errors) between them and the LSP coefficients obtained by analyzing the input speech signal, and supplies the codebook indices (LSP codebook indices) corresponding to them to the multiplexer 19 and LSP inverse-quantizer 8.

The LSP inverse-quantizer 8 computes the LSP coefficients corresponding to the LSP codebook indices, and supplies them to the LSP-to-LPC converter 9. The LSP-to-LPC converter 9 converts the LSP coefficients to the LP coefficients, and supplies them to the synthesis filter 10.

On the other hand, the adaptive codebook 11 stores long term components of a plurality of excitation vectors (pitch period excitation vectors), and the noise codebook 12 stores noise components of the plurality of excitation vectors. The codebooks each output one vector, and the adder 13 adds the two vectors (long term components and noise components), and supplies the sum to the multiplier 14 as the excitation vector. The multiplier 14 sets its magnitude in accordance with the gain parameter fed from the gain codebook 15. Thus, the excitation vectors are generated and supplied to the synthesis filter 10.

The synthesis filter 10 filters the excitation vectors according to the filtering characteristics based on the LP coefficients fed from the LSP-to-LPC converter 9 to synthesize the speech signal, and supplies it to the subtracter 16.

The subtracter 16 subtracts the synthesized speech signal from the input signal, and supplies the errors between the two to the perceptual weighting filter 17. The perceptual weighting filter 17 regulates filter coefficients adaptively in response to spectrum envelope of the input signal, filters the speech signal errors, and supplies the errors after the filtering to the distortion minimizing section 18.

The distortion minimizing section 18 repeatedly selects the long term components of the excitation vectors output from the adaptive codebook 11, the noise components of the excitation vectors output from the noise codebook 12 and gain parameters output from the gain codebook 15, calculates the errors between the synthesized speech signal and the input speech signal, and supplies the multiplexer 19 with the codebook indices of the adaptive codebook, noise codebook and gain codebook (that is, the adaptive codebook indices, noise codebook indices and gain codebook indices) that will minimize the mean-squared error.

Thus, the components from the LSP inverse-quantizer 8 to the distortion minimizing section 18 inclusive of the synthesis filter 10 carry out the speech coding processing based on the A-b-S (Analysis by Synthesis) so that the optimum coding parameters (the long term components of the excitation vectors, noise components and gain parameters) used for the decoding are selected, and the codebook indices corresponding to them are output together with the LSP codebook indices. These components operate according to the CS-ACELP based on the ITU-T recommendation G.729, which models the production mechanism of speech, and uses codebooks that are formed by learning a large number of speech signals. As a result, the present embodiment 1 can encode the speech signals at a low bit rate efficiently.

The multiplexer 19 multiplexes the LSP codebook indices fed from the LSP quantizer 6 with the codebook indices of the adaptive codebook, noise codebook and gain codebook, and transmits them through the transmission line.

In this way, the coding of the speech signal and non-speech signal is performed. In the present embodiment 1, since the quantization is carried out by referring to the same LSP quantization codebook 7 either for the LSP coefficients of the speech signal or for the LSP coefficients of the non-speech signal after the correction, and the common codebook indices are transmitted, it is not necessary for the receiving side to use the decision result of the speech/non-speech signal discriminator 5. Accordingly, multiplexing of the decision result of the speech/non-speech signal discriminator 5 is not required, and hence the bit sequence (frame format) transmitted from the multiplexer 19 can be made identical to that of the conventional speech coding apparatus. Thus, a conventional speech decoding apparatus for the speech signal can decode the codes of both the speech signal and non-speech signal output from the speech coding apparatus of the present embodiment 1.

Next, the correction of the LSP coefficients by the LSP coefficient correcting section 3 will be described in detail.

Figure 2:
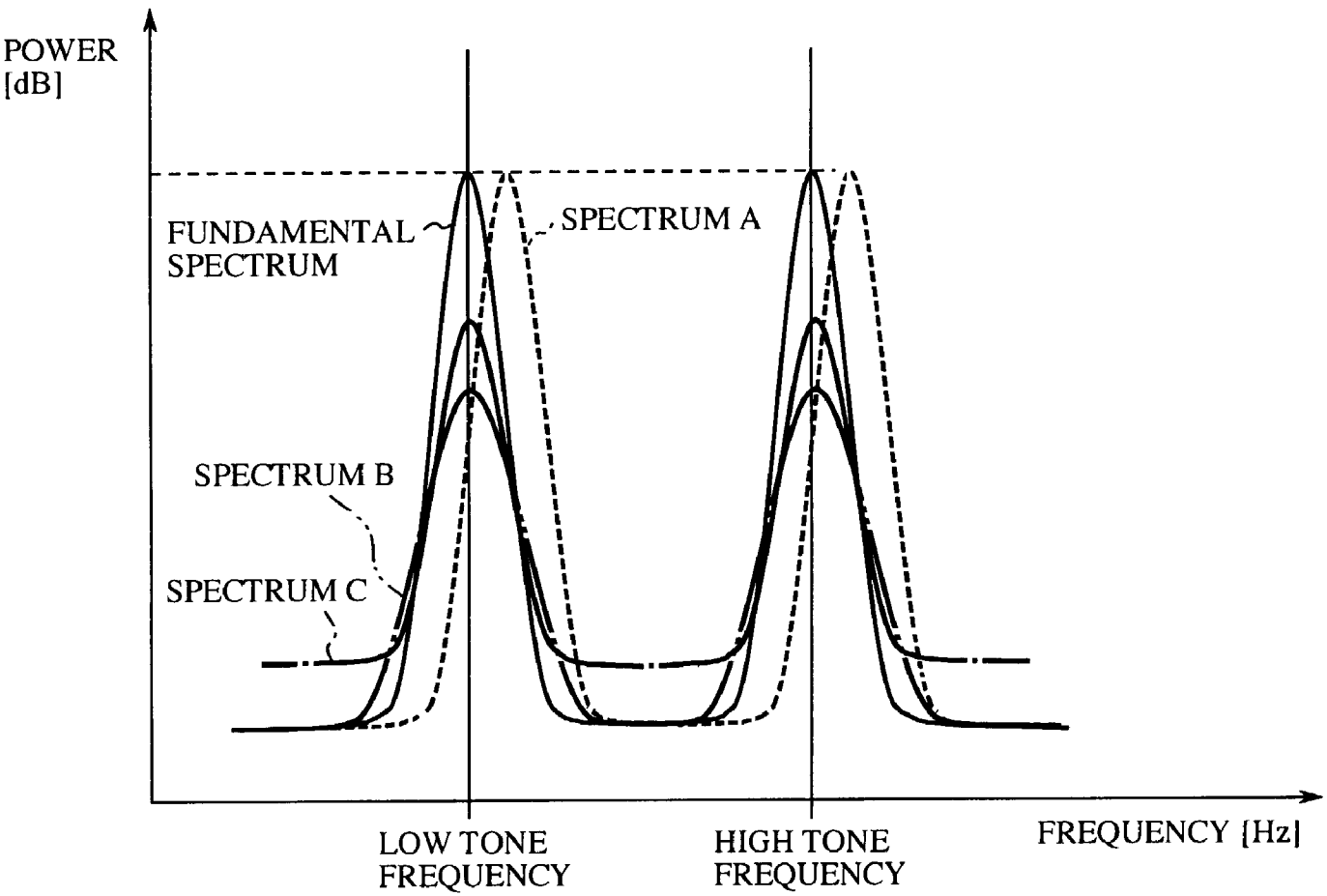
FIG. 2 is a diagram illustrating frequency spectra of a DTMF signal.
Figure 3:
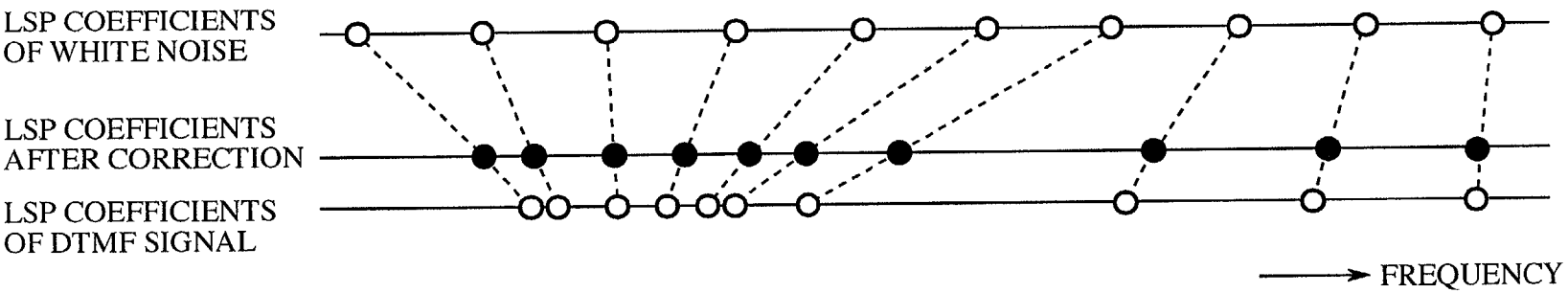
FIG. 3 is a diagram illustrating the relationships between the LSP coefficients of a DTMF signal and the LSP coefficients after correction.

FIG. 2 is a diagram illustrating frequency spectra of a DTMF signal; and FIG. 3 is a diagram illustrating the relationships between the LSP coefficients of the DTMF signal and the LSP coefficients after correction.

The DTMF signals are specified by the peak frequencies and the power of the tone signals as illustrated in FIG. 2, according to the receiving specification defined by TTC recommendation JJ-20.12 "Digital Interface between PBX and TDM (Channel Associated Signaling)-PBX-PBX Signal Specification".

Accordingly, if the peak frequencies of the spectrum of a tone signal shift as the spectrum A as illustrated in FIG. 2, even a small amount of frequency deviation will make it difficult for the receiving side (decoder side) to detect the DTMF signal. In contrast, comparatively large deviation is acceptable in such a case as the sharpness of the spectrum of the tone signal becomes dull, or the tone signal is buried into the white noise components as the spectrum B as illustrated in FIG. 2.

Making use of the foregoing characteristics and the existing LSP quantization codebook 7 specialized for speech, the LSP coefficient correcting section 3 holds the peak frequencies as much as possible with allowing a certain level of degradation in a spectrum profile (reduction in the sharpness or superimposition of white noise components), and suppresses the frequency distortion resulting from the quantization of the LSP coefficients of the non-speech signal.

As illustrated in FIG. 3, the LSP coefficient correcting section 3 computes the LSP coefficients after correction (middle line of FIG. 3) by the linear interpolation between the LSP coefficients that are obtained by the linear prediction analysis of the DTMF signal (bottom line of FIG. 3), and the LSP coefficients that are obtained by the linear prediction analysis of the white noise (top line of FIG. 3). In other words, they are obtained by computing the weighted averages of the LSP coefficients of the white noise and the LSP coefficients of the DTMF signal.

Since the spectrum of the white noise is flat, the distribution of its LSP coefficients is uniform as illustrated in FIG. 3, and they are prestored in the LSP coefficient correcting section 3.

Thus, although the sharpness of the spectrum of the DTMF signals may become dull, the peak frequencies are held, and the distribution of the LSP coefficients of the DTMF signal approaches that of the speech signal, so that the existing LSP quantization codebook 7 specified for the speech signal can effectively quantize the LSP coefficients of the DTMF signal.

The quantization distortion of the LSP coefficients of the DTMF signal can be further reduced by optimizing the correcting processing by adjusting the weights for the weighted averaging.

In this way, the LSP coefficient correcting section 3 can correct the LSP coefficients of the non-speech signal with suppressing the peak frequency deviation resulting from the quantization. Although the DTMF signals are described as the non-speech signal, other non-speech signals can be dealt with in the same manner.

Next, the operation of the speech/non-speech signal discriminator 5 will be described in detail.

The DTMF signals each consist of two tone signals, and the peak frequency of each tone signal is fixed to a particular value according to the foregoing specification. Accordingly, it is possible to decide as to whether the input signal is a speech signal or non-speech signal by extracting features of the frequency components such as peak levels at the specified frequencies by calculating the frequency spectrum of the input signal by fast Fourier transform, or by filtering the specified frequency components with bandpass filters, for example, and by comparing the features extracted with the features of the DTMF signals.

As for the levels of the DTMF signals, the transmission specification according to the foregoing TTC recommendation JJ-20.12 limits its transmission levels and variable ranges to specified ranges. Thus, they have markedly different features from that of the speech signal whose level variations are comparatively large and dynamic range is wide. In view of this, the level variations in the input signal can be used as auxiliary information for identifying the DTMF signals to improve the accuracy of detecting the DTMF signals.

In this way, the speech/non-speech signal discriminator 5 makes a decision as to whether the input signal is the speech signal or non-speech signal. Although the DTMF signals are described here as the non-speech signal, other non-speech signals can be dealt with in the same manner. The speech/non-speech signal discriminator 5 is only an example, and hence other methods can be used to discriminate between the speech signal and non-speech signal.

As described above, the present embodiment 1 is configured such that when the input signal is a non-speech signal, it corrects the LSP coefficients of the non-speech signal to bring its distribution closer to the distribution of the LSP coefficients of the speech signal, and quantizes the LSP coefficients after the correction. Thus, the present embodiment 1 can scatter the distribution of the LSP coefficients of the non-speech signal with holding the tone frequencies close to those inherent in the non-speech signal in the spectrum profile. In addition, it can reduce the quantization distortion involved in quantizing the LSP coefficients of the non-speech signal while using in common the LSP quantization codebook 7 for the speech signal (that is, the LSP quantization codebook 7 formed for handling the speech signal), thereby making it possible to utilize the same bit sequence in common for the speech signal transmission and non-speech signal transmission. As a result, the present embodiment 1 offers an advantage of being able to implement good in-channel transmission of the non-speech signal such as the DTMF signals without changing the speech decoding apparatus on the receiving side.

In addition, the present embodiment 1 is configured such that it reduces the quantization distortion of the non-speech signal by carrying out the quantization of the LSP coefficients using the common LSP quantization codebook 7 by processing the non-speech signal such that its characteristics approach the characteristics of the speech signal. Thus, even if the input signal consisting of the speech signal is erroneously decided as the non-speech signal by the speech/non-speech signal discriminator 5, it can prevent the degradation in the speech quality. As a result, it offers an advantage of being able to maintain a certain level of speech transmission quality, and to reduce the possibility that the speech becomes offensive to the ear during conversation, and by extension to reduce the cost of the apparatus because of the simple configuration to implement the foregoing advantage.

Figure 5:
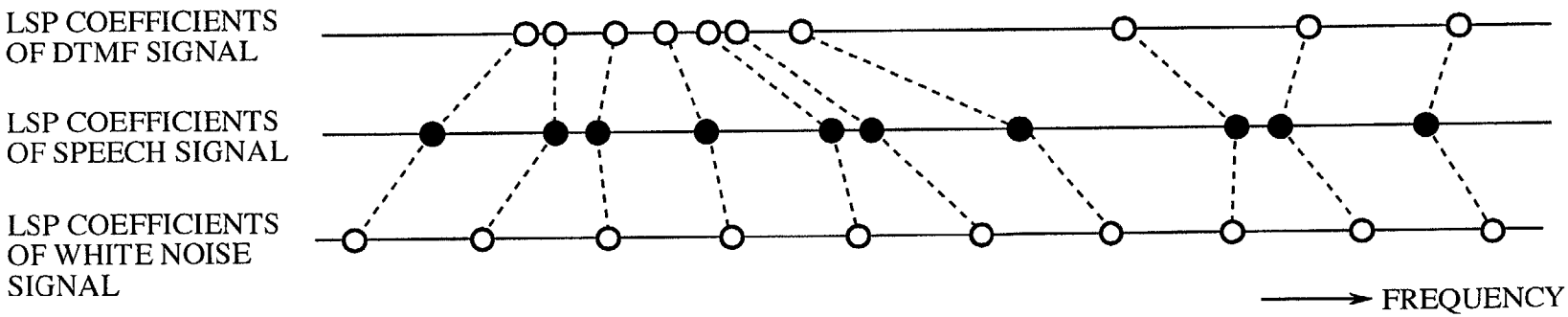
FIG. 5 is a diagram illustrating an example of the distribution of LSP coefficients of a DTMF signal and an example of the distribution of LSP coefficients of a speech signal.
Figure 4:
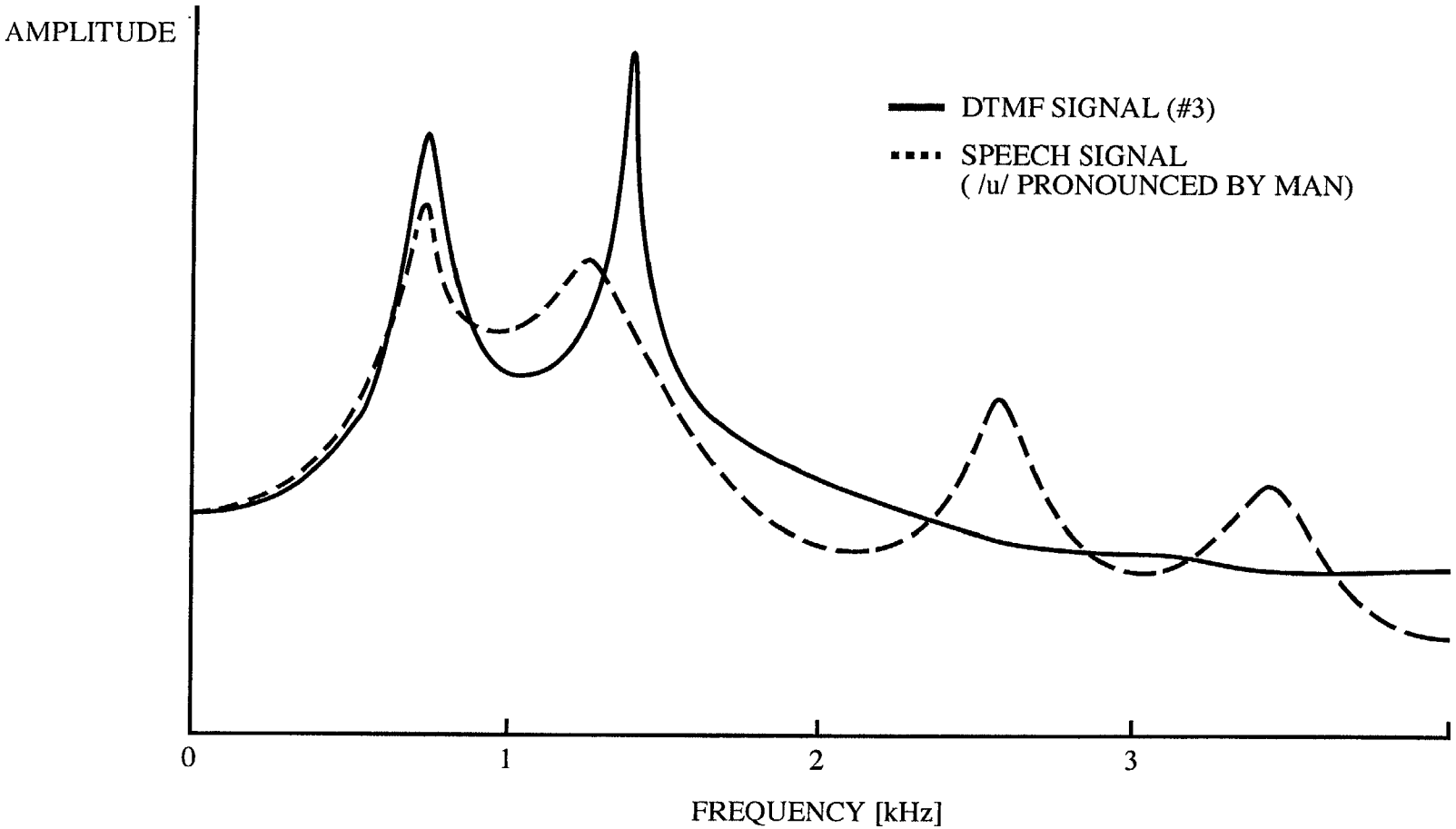
FIG. 4 is a diagram illustrating a frequency spectrum of the DTMF signal of digit "3", and a frequency spectrum of "u" produced by a common man.

Incidentally, ordinary LSP quantization codebooks are specified for the speech, and use the LSP samples obtained by learning a large amount of speech signals. In particular, when employing a low bit rate speech coding method such as the CS-ACELP, they are further specified for the speech to maintain the speech quality preferentially. However, as illustrated in FIG. 4, the spectrum profile of the DTMF signal differs from that of the speech signal in that the LSP coefficients of the DTMF signal distribute thickly near the tone frequencies as illustrated in FIG. 5, for example, because of the sharp spectrum peaks. In contrast, although the LSP coefficients of the speech signal are rather thick near the formant frequencies, they are distributed rather smoother than those of the DTMF signal. Thus, the frequency characteristics of the speech signal markedly differ from those of the tone signals such as the DTMF signals, so that the distributions of the LSP coefficients, which represent the spectrum profiles in terms of the concentration on the frequency axis, differ from each other. Incidentally, FIG. 4 is a diagram illustrating a frequency spectrum of the DTMF signal of digit "3", and a frequency spectrum of "u" pronounced by a common man; and FIG. 5 is a diagram illustrating an example of the distribution of LSP coefficients of the DTMF signal and an example of the distribution of LSP coefficients of the speech signal.

Thus, when quantizing the LSP coefficients of the non-speech signal such as the DTMF signals that deviate from the frequency characteristics of the speech signal without the correction, it is likely that suitable codewords (quantized LSP coefficients) cannot be found in the LSP quantization codebook, thereby increasing the quantization distortion. The speech coding apparatus of the present embodiment 1, however, corrects the LSP coefficients of the non-speech signal, making it possible to code the non-speech signal in good condition using the common LSP quantization codebook.

Embodiment 2

Figure 6:
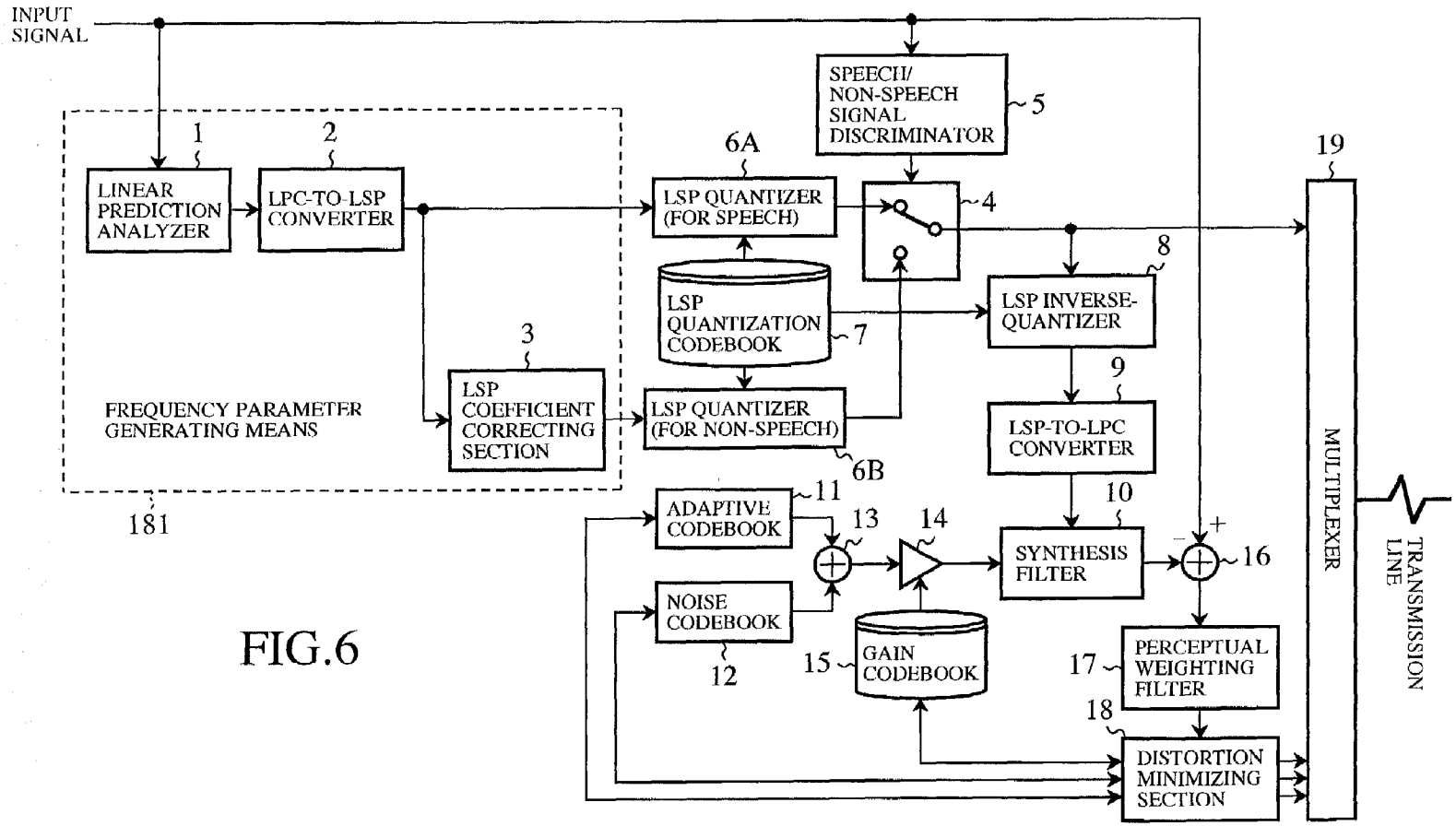
FIG. 6 is a block diagram showing a configuration of an embodiment 2 of the speech coding apparatus in accordance with the present invention.
Figure 7A:
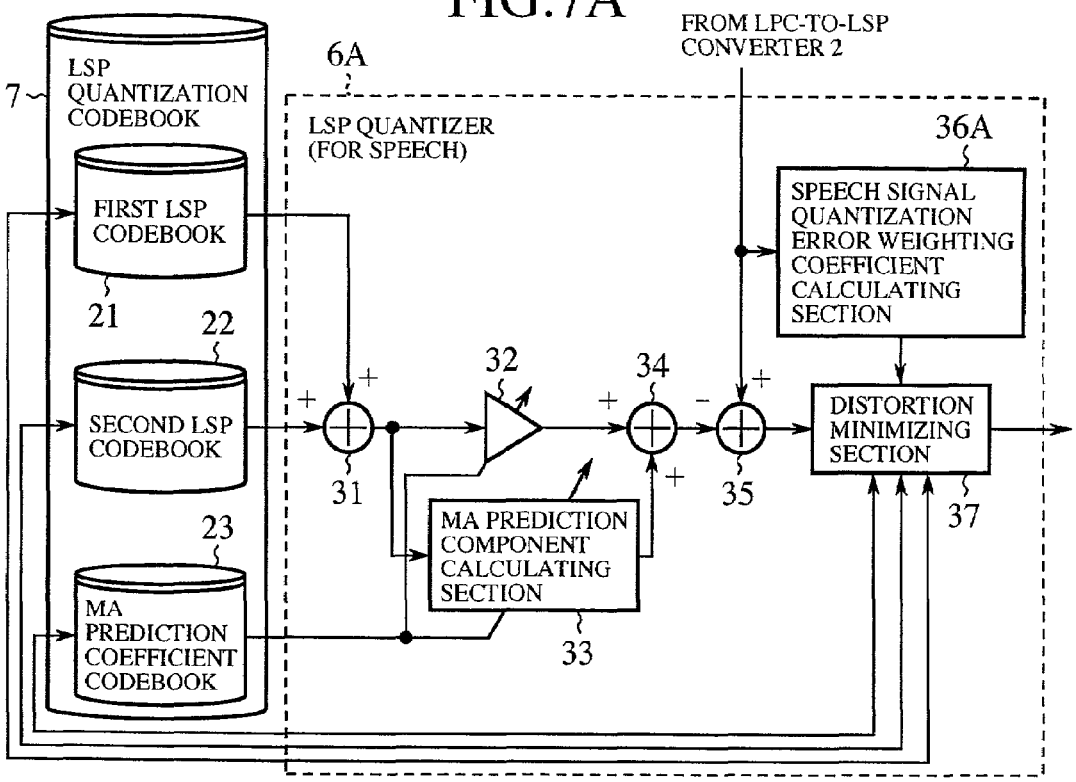
FIGS. 7A and 7B are block diagrams each showing a configuration of the LSP quantization codebook and LSP quantizer as shown in FIG. 6.
Figure 7B:
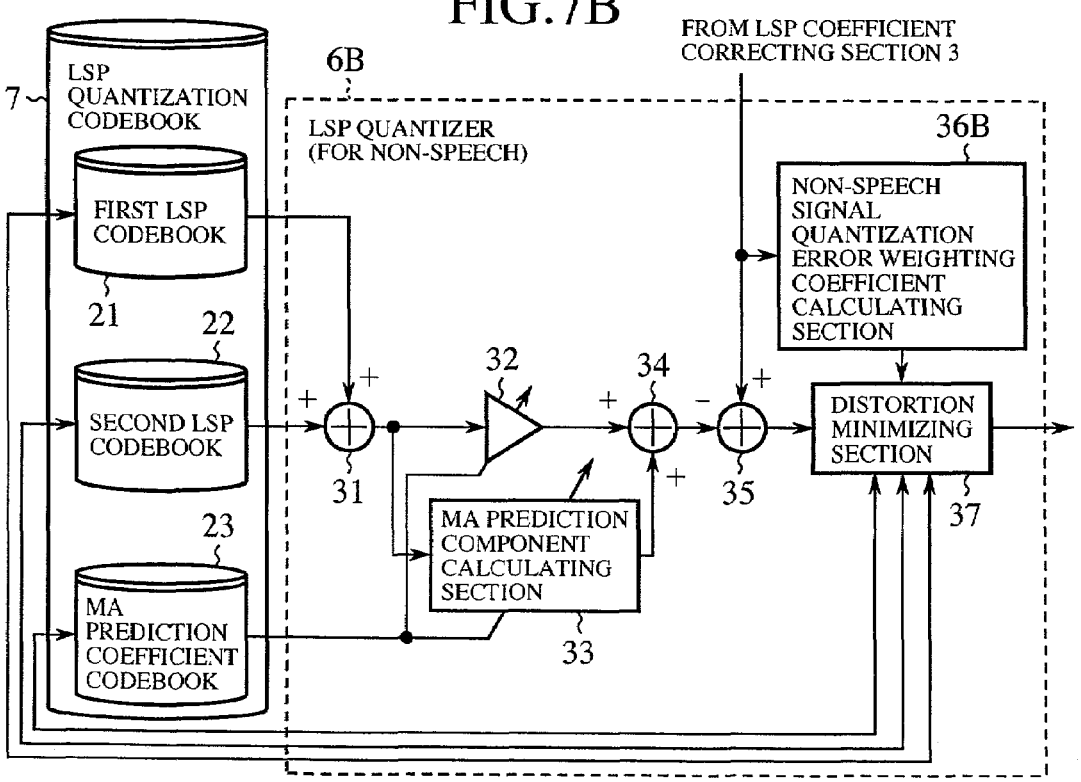

FIG. 6 is a block diagram showing a configuration of an embodiment 2 of the speech coding apparatus in accordance with the present invention; and FIGS. 7A and 7B are block diagrams each showing a configuration of the LSP quantization codebook 7 plus the LSP quantizer 6A or 6B as shown in FIG. 6. In FIG. 6, the reference numeral 6A designates an LSP quantizer for a speech signal, and 6B designates an LSP quantizer for a non-speech signal. The LSP quantizers 6A and 6B refer to the same LSP quantization codebook 7, and use the common codebook indices. Since the remaining components of FIG. 6 are the same as those of the foregoing embodiment 1, the description thereof is omitted here.

In the LSP quantization codebook 7 as shown in FIG. 7A, the reference numeral 21 designates a first stage LSP codebook for storing a plurality of prescribed quantization coefficients that are obtained by learning a large amount of speech data; 22 designates a second stage LSP codebook for storing a plurality of prescribed quantization coefficients for fine adjustment based on random numbers; and 23 designates an MA prediction coefficient codebook for storing predetermined number of sets of the MA prediction coefficients.

In the LSP quantizer 6A for the speech signal as shown in FIG. 7A, the reference numeral 31 designates an adder; 32 designates a multiplier; 33 designates an MA prediction component calculating section for computing the MA prediction components by multiplying the sets of the MA prediction coefficients by the predetermined number of past outputs of the adder 31; 34 designates an adder; and 35 designates a subtracter for subtracting the LSP coefficients, which are calculated from the coefficients of the LSP quantization codebook 7, from the LSP coefficients supplied from the LPC-to-LSP converter 2, thereby computing the residual errors between the LSP coefficients. The reference numeral 36A designates a speech signal quantization error weighting coefficient calculating section for computing weighting coefficients, which are to be multiplied by the LSP coefficients of respective orders of the speech signal, from the LSP coefficients of respective orders that are supplied from the LPC-to-LSP converter 2, in order to reduce the quantization error; and 37 designates a distortion minimizing section for searching for the LSP coefficients that will minimize the sum of the squares of the residual errors of the LSP coefficients multiplied by their weighting coefficients with varying the coefficients output from the codebooks of the LSP quantization codebook 7, and outputs the codebook indices corresponding to the LSP coefficients as the LSP codebook indices.

In the LSP quantizer 6B of the non-speech signal as shown in FIG. 7B, the reference numeral 36B designates a non-speech signal quantization error weighting coefficient calculating section for computing weighting coefficients, which are to be multiplied by the LSP coefficients of respective orders of the non-speech signal, from the LSP coefficients of respective orders that are supplied from the LSP coefficient correcting section 3, in order to reduce the quantization error. Since the remaining components of FIG. 7B are the same as those of FIG. 7A, the description thereof is omitted here.

Next, the operation of the present embodiment 2 will be described.

In the speech coding apparatus of the present embodiment 2, the LSP coefficients generated by the LPC-to-LSP converter 2 are supplied to the LSP quantizer 6A and LSP coefficient correcting section 3. The LSP quantizer 6A, assuming that the LSP coefficients are those of the speech signal, selects the codebook indices corresponding to the LSP coefficients by referring to the LSP quantization codebook 7 in order to reduce the quantization distortion, and supplies them to the selector switch 4. On the other hand, the LSP coefficient correcting section 3 corrects the LSP coefficients just as in the embodiment 1, and supplies the LSP coefficients after the correction to the LSP quantizer 6B. The LSP quantizer 6B, assuming that the LSP coefficients are those of the non-speech signal, selects the codebook indices corresponding to the LSP coefficients by referring to the LSP quantization codebook 7 in order to reduce the quantization distortion, and supplies them to the selector switch 4.

In the LSP quantizer 6A, the adder 31 adds the coefficients fed from the first stage LSP codebook 21 in the LSP quantization codebook 7 to the coefficients fed from the second stage LSP codebook 22, and supplies the resultant sum to the multiplier 32 and MA prediction component calculating section 33. In addition, the MA prediction coefficient codebook 23 in the LSP quantization codebook 7 supplies the MA prediction coefficients to the multiplier 32 and MA prediction component calculating section 33. The multiplier 32 multiplies the output of the adder 31 by the MA prediction coefficients, and supplies the resultant products to the adder 34. The MA prediction component calculating section 33 stores a predetermined number of the past outputs of the adder 31 and MA prediction coefficients, computes the sum totals of the products between the individual outputs of the adder 31 and the MA prediction coefficients, and supplies them to the adder 34. The adder 34 computes the sum of them, and supplies it to the subtracter 35. The subtracter 35 subtracts the output of the adder 34 (that is, the LSP coefficients obtained from the codebooks in the LSP quantization codebook 7) from the LSP coefficients fed from the LPC-to-LSP converter 2, and supplies the residual errors between the LSP coefficients to the distortion minimizing section 37. The distortion minimizing section 37 multiplies the squares of the residual errors of the LSP coefficients by the weighting coefficients fed from the speech signal quantization error weighting coefficient calculating section 36A, searches for the LSP coefficients that will minimize the calculation result with varying the coefficients output from the codebooks in the LSP quantization codebook 7, and outputs the indices of the individual codebooks in the LSP quantization codebook 7 as the LSP codebook indices when the distortion becomes minimum.

On the other hand, in the LSP quantizer 6B, the distortion minimizing section 37 multiplies the squares of the residual errors of the LSP coefficients by the weighting coefficients fed from the non-speech signal quantization error weighting coefficient calculating section 36B, searches for the LSP coefficients that will minimize the calculation result with varying the coefficients output from the codebooks in the LSP quantization codebook 7, and outputs the indices of the individual codebooks in LSP quantization codebook 7 as the LSP codebook indices when the distortion becomes minimum.

In other words, the speech signal quantization error weighting coefficient calculating section 36A in the LSP quantizer 6A determines the weighting coefficients according to the characteristics of the speech signal such that the quantization distortion is reduced, and the non-speech signal quantization error weighting coefficient calculating section 36B in the LSP quantizer 6B determines the weighting coefficients according to the characteristics of the non-speech signal like the DTMF signals such that the quantization distortion is reduced. Thus, the LSP quantizer 6A selects the LSP codebook indices of the LSP samples that will minimize the quantization distortion generated with respect to the LSP coefficients of the speech signal, and the LSP quantizer 6B selects the LSP codebook indices of the LSP samples that will minimize the quantization distortion generated with respect to the LSP coefficients of the non-speech signal.

The speech/non-speech signal discriminator 5 decides whether the input signal is the speech signal or non-speech signal such as the DTMF signals, and controls the selector switch 4 by the decision result such that when the input signal is the speech signal, it causes the LSP codebook indices from the LSP quantizer 6A to be supplied to the multiplexer 19 and LSP inverse-quantizer 8, whereas when the input signal is the non-speech signal, it causes the LSP codebook indices from the LSP quantizer 6B to be supplied to the multiplexer 19 and LSP inverse-quantizer 8. Consequently, this is equivalent to that the correction of the LSP coefficients is performed only when the input signal is the non-speech signal such as the DTMF signals.

Since the remaining operation is the same as that of the foregoing embodiment 1, the description thereof is omitted here.

As described above, the present embodiment 2 is configured such that when selecting the optimum LSP samples corresponding to the LSP coefficients from the LSP quantization codebook 7, it selects the LSP samples, when the input signal is the non-speech signal, such that the quantization distortion becomes minimum considering the characteristics of the non-speech signal, followed by quantizing the LSP coefficients. As a result, the present embodiment 2 offers an advantage of being able to reduce the quantization distortion involved in quantizing the LSP coefficients of the non-speech signal using the same LSP quantization codebook 7 for the speech signal (specified for the speech signal).

Embodiment 3

Figure 8:
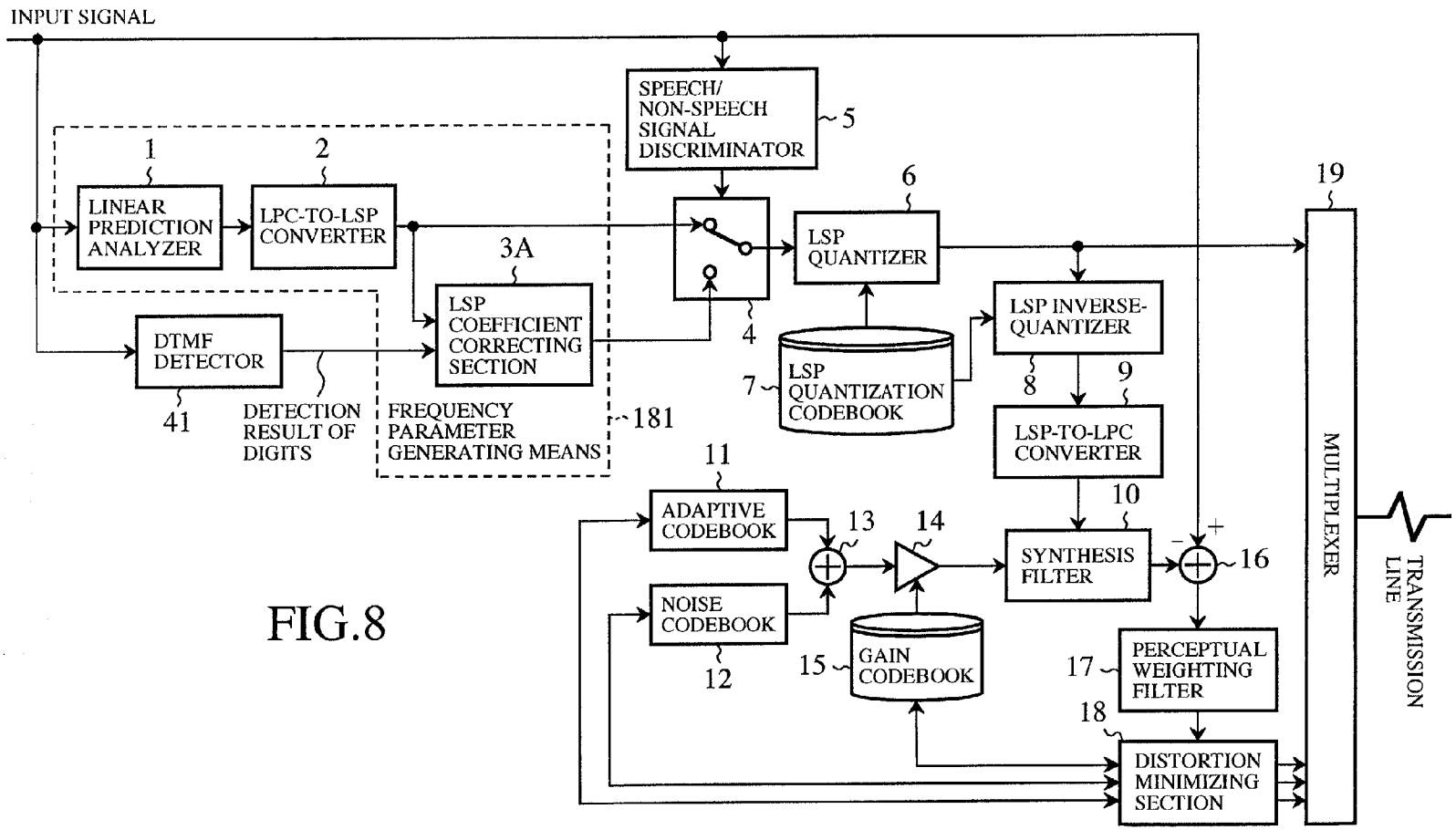
FIG. 8 is a block diagram showing a configuration of an embodiment 3 of the speech coding apparatus in accordance with the present invention.

FIG. 8 is a block diagram showing a configuration of an embodiment 3 of the speech coding apparatus in accordance with the present invention. In this figure, the reference numeral 41 designates a DTMF detector (non-speech signal detector) for detecting the DTMF signals from the input signal, and notifies an LSP coefficient correcting section 3A of the types (digits) of the DTMF signals; and 3A designates the LSP coefficient correcting section for correcting the LSP coefficients in the same manner-as the LSP coefficient correcting section 3, with varying its correction characteristics in accordance with the digits (types) fed from the DTMF detector 41. Since the remaining components of FIG. 8 are the same as those of the foregoing embodiment 1, the description thereof is omitted here. As the DTMF detector 41, any one of existing detectors which are widely used in the exchanges or telephones can be employed without change. There are 16 types of the digits including twelve digits 0, 1, 2, 3, 4, 5, 6, 7, 8, 9, * and #, along with A, B, C and D used in foreign countries.

Next, the operation of the present embodiment 3 will be described.

Detecting the DTMF signals from the input signal, the DTMF detector 41 notifies the LSP coefficient correcting section 3A of the digits corresponding to the DTMF signals. Receiving the notification of the digits from the DTMF detector 41, the LSP coefficient correcting section 3A corrects the LSP coefficients fed from the LPC-to-LSP converter 2 in accordance with the correction characteristics corresponding to the digits, and outputs the LSP coefficients after the correction.

In the course of this, the LSP coefficient correcting section 3A, which knows the peak frequencies in advance of the two tones constituting each of the DTMF signals of the detected digits, assigns small correction quantity to the LSP coefficients around the peak frequencies, whereas assigns greater correction quantity to the LSP coefficients in the remaining frequency regions, thereby holding the characteristics in the peak regions of the DTMF signals of the detected digits.

Figure 9:
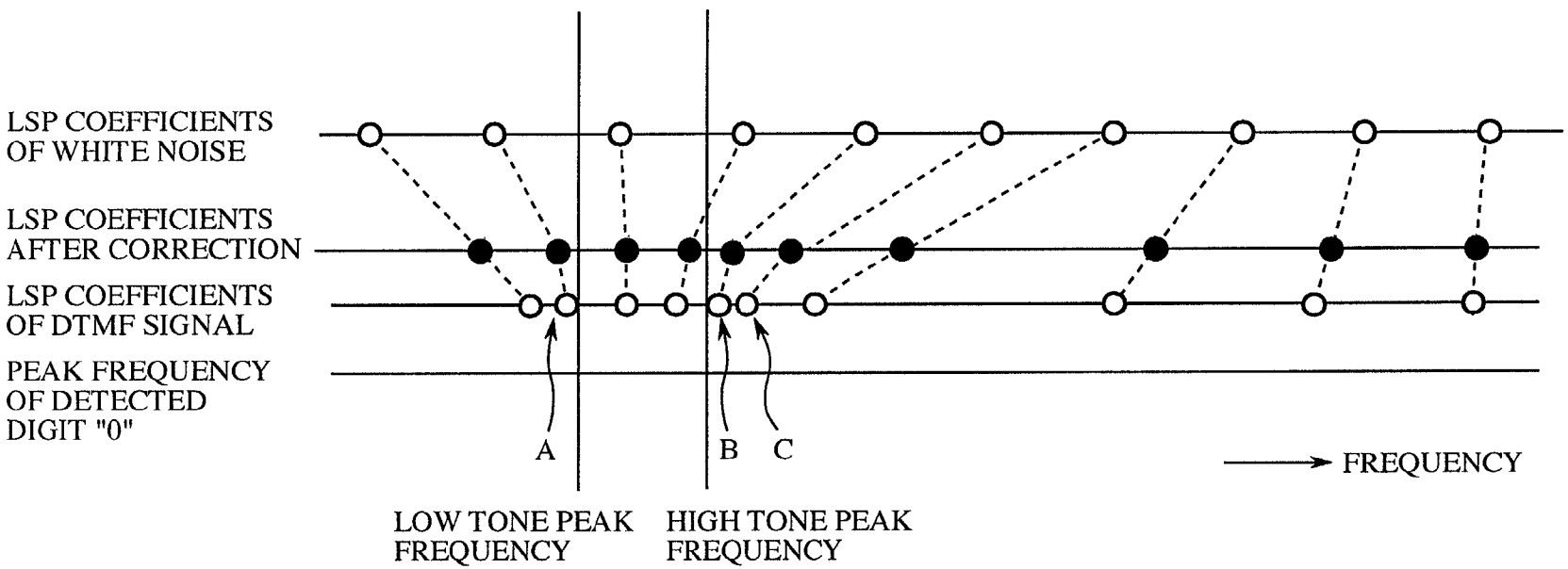
FIG. 9 is a diagram illustrating an example of relationships between the LSP coefficients of the DTMF signal and the LSP coefficients after the correction when digit "0" is detected.

Taking an example where digit "0" is detected, the correction of the LSP coefficients will be described. FIG. 9 is a diagram illustrating an example of relationships between the LSP coefficients of the DTMF signals and the LSP coefficients after the correction when digit "0" is detected.

The DTMF signal of digit "0" includes a lower tone with a peak frequency of 941 Hz, and a higher tone with a peak frequency of 1336 Hz. Thus, the LSP coefficient correcting section 3A, receiving the notification that the DTMF signal of digit "0" is detected, corrects the LSP coefficients such that the regions around the two frequencies become thick as illustrated in FIG. 9. Thus, the LSP coefficient correcting section 3A assigns small correction coefficients to the LSP coefficients near the two peak frequencies (LSP coefficients A, B and C in FIG. 9), thereby making the correction quantity smaller.

Since the remaining operation is the same as that of the foregoing embodiment 1, the description thereof is omitted here.

Although the DTMF signals are taken as an example of the non-speech signal, other non-speech signals can be dealt with in the same manner.

As described above, since the present embodiment 3 is configured such that it corrects the LSP coefficients of the DTMF signals according to the correction characteristics corresponding to the types of the DTMF signals (that is, the digits), it can spread the distribution of the LSP coefficients without substantially varying the spectrum profile near the tone frequencies of the DTMF signals. As a result, the present embodiment 3 offers an advantage of being able to reduce the quantization distortion involved in quantizing the LSP coefficients of the non-speech signal using the LSP quantization codebook 7 (specified for the speech signal) in common with the non-speech signal.

Embodiment 4

Figure 10:
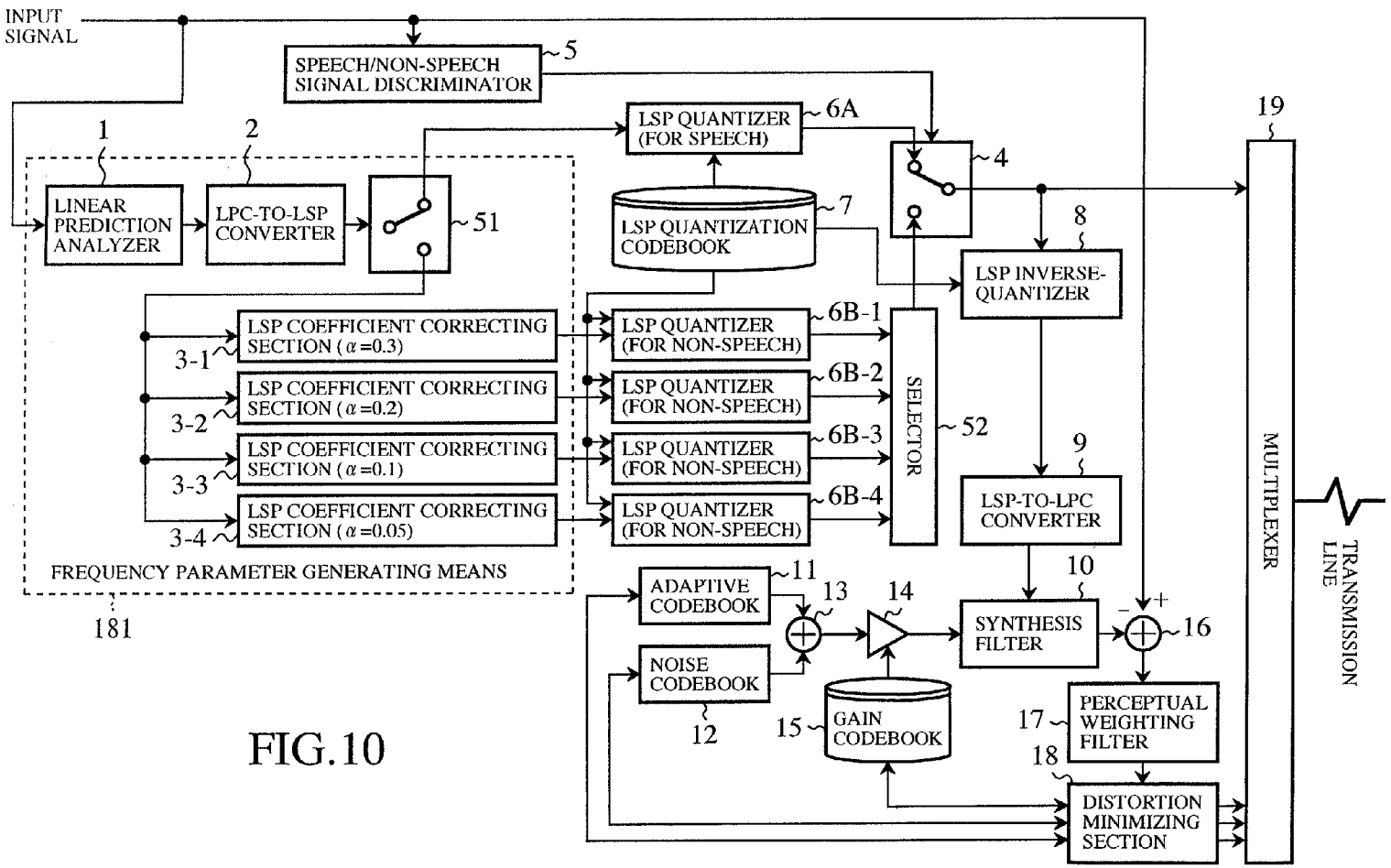
FIG. 10 is a block diagram showing a configuration of an embodiment 4 of the speech coding apparatus in accordance with the present invention.

FIG. 10 is a block diagram showing a configuration of an embodiment 4 of the speech coding apparatus in accordance with the present invention. In this figure, the reference numerals 3-1–3-4 designate a plurality of LSP coefficient correcting sections having the same structure as the LSP coefficient correcting section 3, but different correction coefficients from one another; 6B-1–6B-4 designate a plurality of non-speech signal LSP quantizers that select the LSP codebook indices of the LSP samples corresponding to the LSP coefficients by referring to the LSP quantization codebook 7 just as the LSP quantizer 6B in the embodiment 2, and output them along with the quantization distortion at that time; the reference numeral 51 designates a selector switch; and 52 designates a selector for selecting the LSP codebook indices with the smallest quantization distortion from among the plurality of non-speech LSP quantizers 6B-1–6B-4. Since the remaining components of FIG. 10 are the same as those of the foregoing embodiment 2, the description thereof is omitted here.

Next, the operation of the present embodiment 4 will be described.

Figure 11:
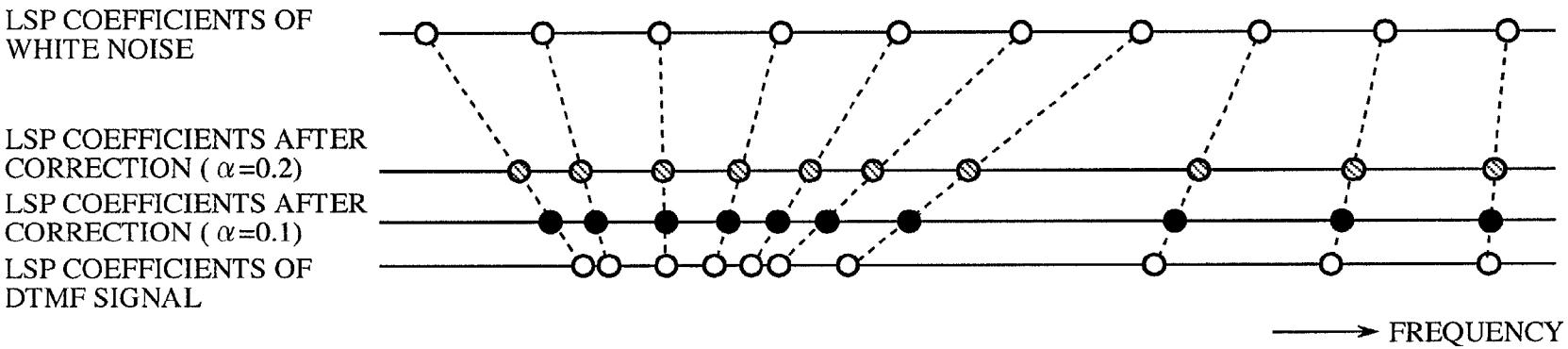
FIG. 11 is a diagram illustrating an example of correspondence between the LSP coefficients of the DTMF signal and the LSP coefficients after the correction using different correction coefficients.

FIG. 11 is a diagram illustrating an example of correspondence-between the LSP coefficients of a DTMF signal and the LSP coefficients after the correction using different correction coefficients.

In the speech coding apparatus of the present embodiment 4, the speech/non-speech signal discriminator 5 controls the selector switch 51 according to its decision result, so that the LSP coefficients from the LPC-to-LSP converter 2 is supplied to the LSP quantizer 6A when the input signal is the speech signal, and to the LSP coefficient correcting sections 3-1–3-4 when the input signal is the non-speech signal.

The LSP coefficient correcting section 3-1 with the correction coefficient $\alpha=0.3$, corrects the LSP coefficients of the non-speech signal, which are supplied from the LPC-to-LSP converter 2 via the selector switch 51, according to equation (1) using the LSP coefficients of the white noise, and supplies the LSP coefficients after the correction to the LSP quantizer 6B-1.

$$f(i)=(1-\alpha)\cdot fDTMF(i)+\alpha\cdot fwhite(i) \quad (1)$$

where f(i) is the ith order LSP coefficient after the correction, $\alpha$ is the correction coefficient, fDTMF(i) is the ith order LSP coefficient of the non-speech signal such as the DTMF signals before the correction, and fwhite(i) is the ith order LSP coefficient of the white noise.

Likewise, the LSP coefficient correcting sections 3-2–3-4, which are assigned the correction coefficients $\alpha$ of 0.2, 0.1 and 0.05, respectively, correct the LSP coefficients of the non-speech signal, which are supplied from the LPC-to-LSP converter 2 via the selector switch 51, according to equation (1) using the LSP coefficients of the white noise, for example, and supply the LSP coefficients after the correction to the LSP quantizers 6B-2–6B-4, respectively.

The LSP quantizers 6B-1-6B-4 select the LSP codebook indices corresponding to the supplied LSP coefficients just as the LSP quantizer 6B does, and supply the selector 52 with the selected indices along with the quantization distortion values obtained at that time by the distortion minimizing section 37. The selector 52 selects the LSP codebook indices with the minimum quantization distortion from among the LSP quantizers 6B-1–6B-4, and supplies them to the selector switch 4.

As illustrated in FIG. 11, the distribution of the LSP coefficients is made more uniform with an increase of the correction coefficient $\alpha$. Accordingly, from the viewpoint of reducing the quantization distortion, a greater correction coefficient $\alpha$ will be more effective. The greater correction coefficient $\alpha$, however, will markedly deviate the spectrum profile of the DTMF signals after the correction from that of the DTMF signals before the correction, although the peak frequencies are maintained. Thus, the speech coding apparatus of the present embodiment 4 is configured such that it quantizes a plurality of LSP coefficients corrected on the basis of the plurality of correction coefficients $\alpha$, and selects the LSP samples with the minimum quantization distortion.

Since the remaining operation is the same as that of the foregoing embodiment 2, the description thereof is omitted here.

Although the present embodiment 4 employs the same LSP coefficient correcting sections 3-1–3-4 except for the correction coefficient a to carry out the correction based on the linear interpolation, they can perform the correction based on other interpolation methods.

In addition, the speech coding apparatus of the present embodiment 4 can comprise the DTMF detector 41 that supplies its detection result to at least one of the LSP coefficient correcting sections 3-1–3-4 as in the embodiment 3, so that they can further vary the correction characteristics in response to the detected digits in the same manner as the LSP coefficient correcting section 3A.

Although the present embodiment 4 comprises four LSP coefficient correcting sections 3-1–3-4 and four LSP quantizers 6B-1–6B-4 for the non-speech signal, the number of these components is not limited to four, but can take any plural number of components.

As described above, the present embodiment 4 is configured such that it carries out the correction of the LSP coefficients of the non-speech signal using a plurality of different correction coefficients, quantizes the LSP coefficients after the correction, and selects the LSP samples with the least quantization distortion from among the selected LSP samples in accordance with the LSP coefficients. As a result, the present embodiment 4 can select the LSP samples with small quantization distortion and little corruption in the spectrum profile, thereby offering an advantage of being able to quantize the LSP coefficients of the non-speech signal well.

Embodiment 5

Figure 12:
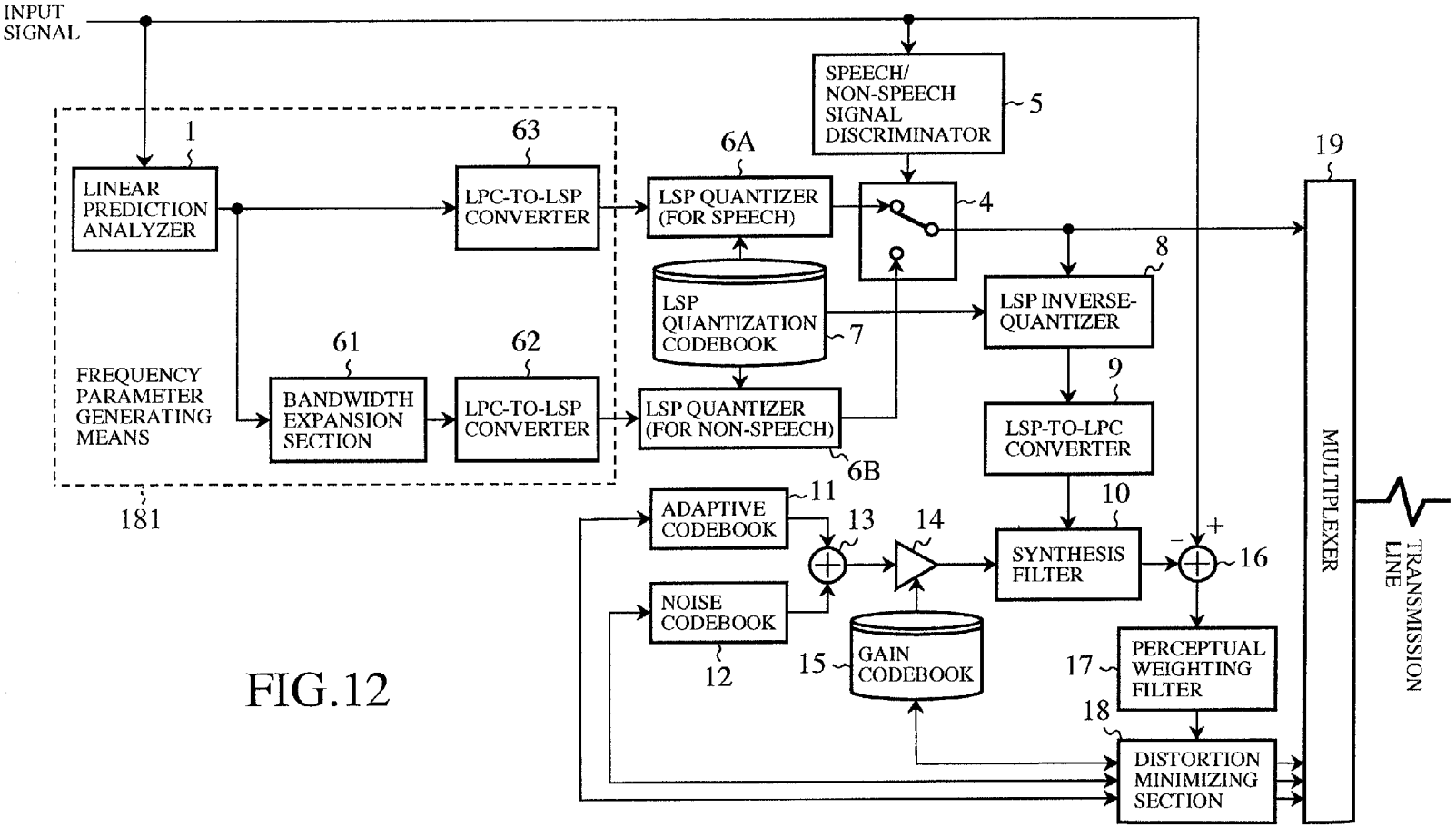
FIG. 12 is a block diagram showing a configuration of an embodiment 5 of the speech coding apparatus in accordance with the present invention.

FIG. 12 is a block diagram showing a configuration of an embodiment 5 of the speech coding apparatus in accordance with the present invention. In this figure, the reference numeral 61 designates a bandwidth expanding section for performing bandwidth expansion of the LP coefficients generated by the linear prediction analyzer 1; 62 designates an LPC-to-LSP converter for converting the bandwidth expanded LP coefficients to the LSP coefficients; and 63 designates an LPC-to-LSP converter for converting the LP coefficients generated by the linear prediction analyzer 1 to the LSP coefficients. Since the remaining components of FIG. 12 are the same as those of the foregoing embodiment 2, the description thereof is omitted here.

Next, the operation of the present embodiment 5 will be described.

In the speech coding apparatus of the present embodiment 5, the LP coefficients generated by the linear prediction analyzer 1 are supplied to the LPC-to-LSP converter 63 and bandwidth expanding section 61. The LPC-to-LSP converter 63 converts the LP coefficients to the LSP coefficients, and supplies the LSP coefficients to the LSP quantizer 6A. On the other hand, the bandwidth expanding section 61 carries out the bandwidth expansion of the LP coefficients generated by the linear prediction analyzer 1 according to equation (2), and supplies the LPC-to-LSP converter 62 with the LP coefficients after the bandwidth expansion.

$$a^*(i)=\lambda^i \cdot a(i) \tag{2}$$

where, a*(i) is the ith order LP coefficient after the bandwidth expansion, λ is an expansion coefficient (1>λ>0), and a(i) is the ith order LP coefficient before the bandwidth expansion.

The LPC-to-LSP converter 62 converts the bandwidth expanded LP coefficients to the LSP coefficients, and supplies the LSP coefficients to the LSP quantizer 6B.

Since the remaining operation is the same as that of the foregoing embodiment 2, the description thereof is omitted here.

As described above, the present embodiment 5 is configured such that it performs the bandwidth expansion of the LP coefficients of the non-speech signal, thereby expanding the peak width of the frequency spectrum of the non-speech signal. Accordingly, the present embodiment 5 can scatter the distribution of the LSP coefficients with holding the spectrum profile near the tone frequencies of the non-speech signal, and hence it offers an advantage of being able to reduce the quantization distortion involved in quantizing the LSP coefficients of the non-speech signal by using the LSP quantization codebook 7 for the speech signal (that is, the LSP quantization codebook 7 formed for handling the speech signal) in common with the non-speech signal.

Embodiment 6

Figure 13:
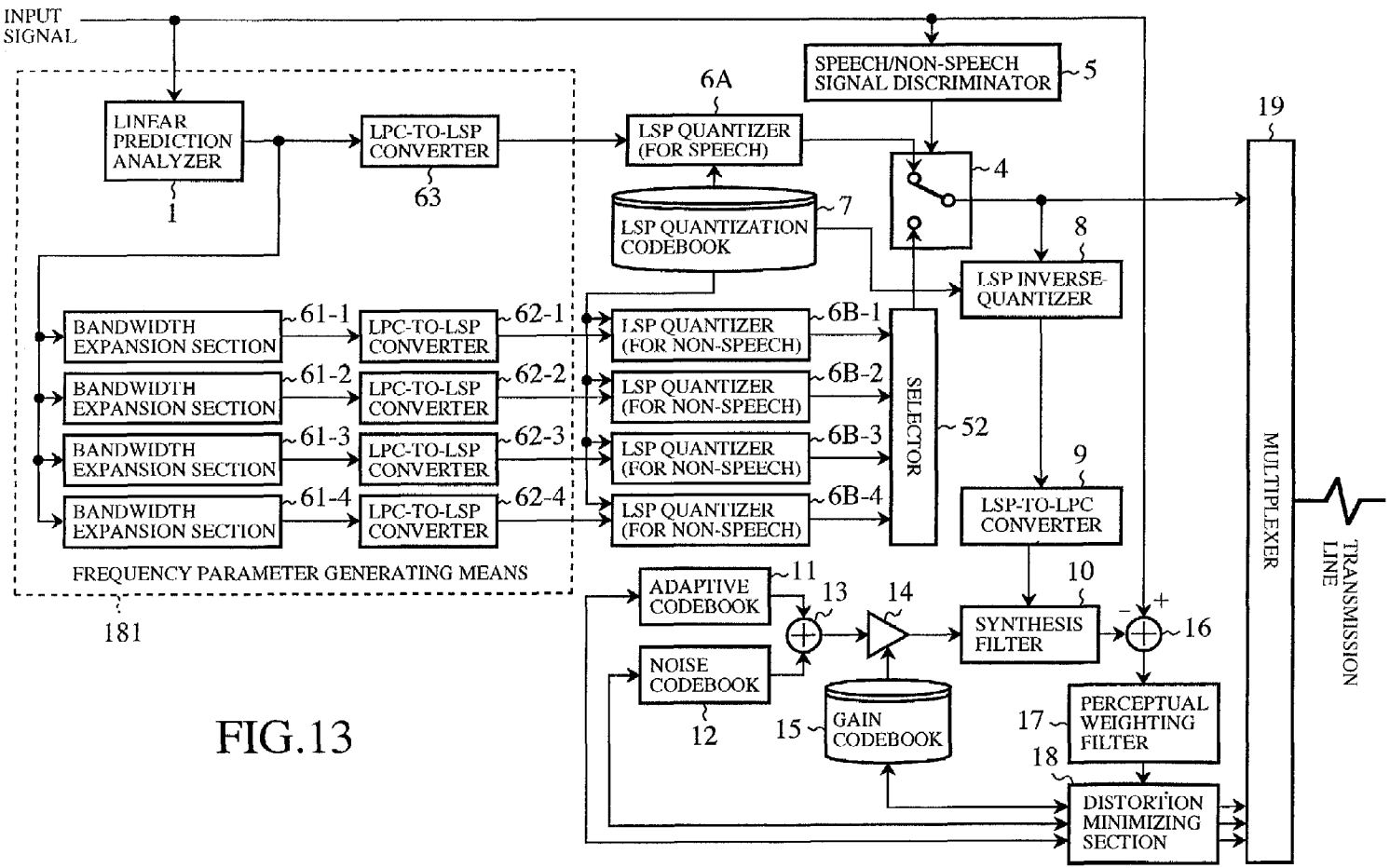
FIG. 13 is a block diagram showing a configuration of an embodiment 6 of the speech coding apparatus in accordance with the present invention.
Figure 14:
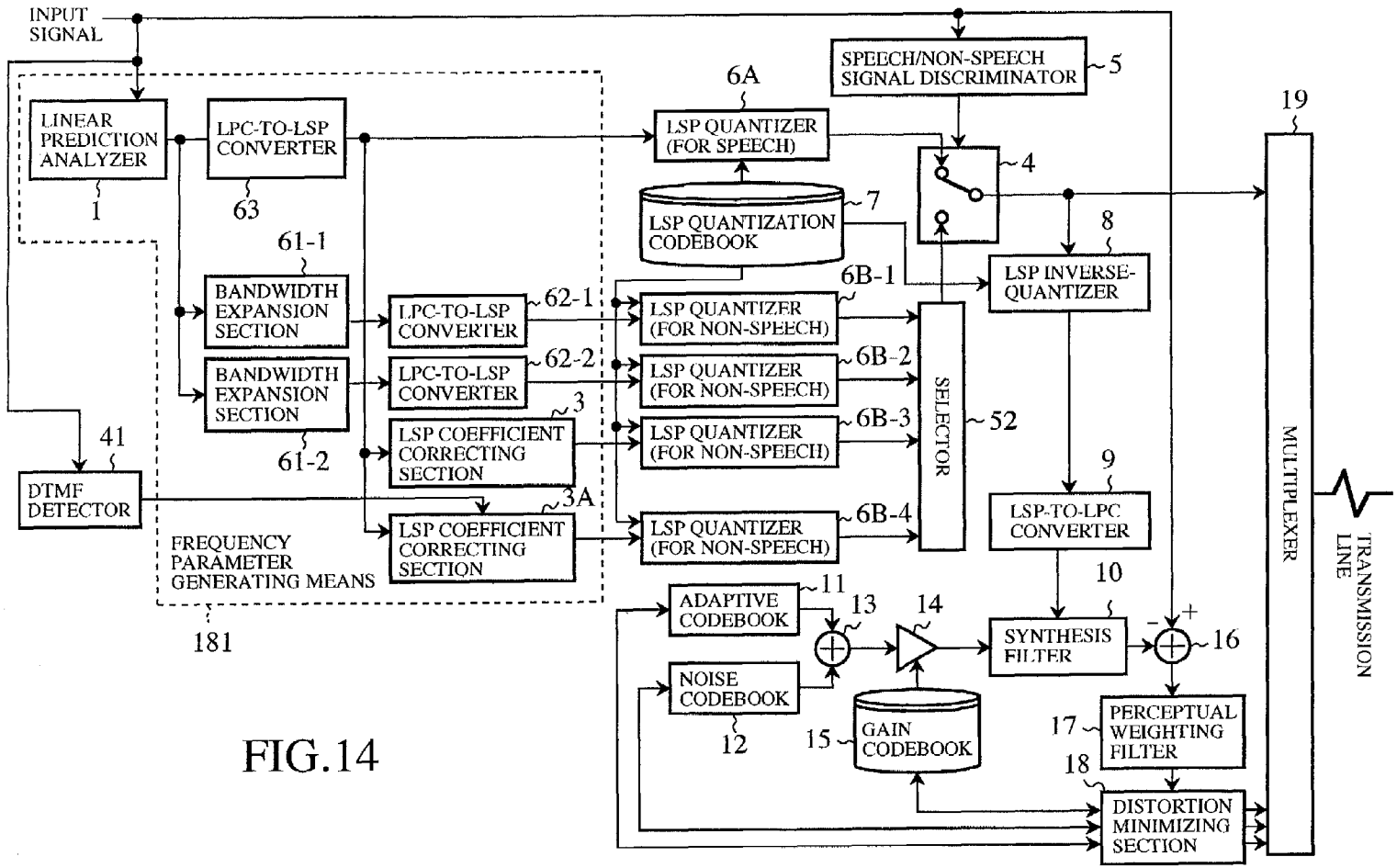
FIG. 14 is a block diagram showing another configuration of an embodiment 6 of the speech coding apparatus in accordance with the present invention.

FIG. 13 is a block diagram showing a configuration of an embodiment 6 of the speech coding apparatus in accordance with the present invention; and FIG. 14 is a block diagram showing another configuration of the embodiment 6 of the speech coding apparatus in accordance with the present invention. In FIG. 13, the reference numerals 61-1–61-4 designate a plurality of bandwidth expanding sections having the same structure as the bandwidth expanding section 61, but having different expansion coefficients from one another; and 62-1–62-4 designate LPC-to-LSP converters for converting the LP coefficients, the bandwidths of which are expanded by the bandwidth expanding sections 61-1–61-4, into the LSP coefficients. Since the remaining components of FIG. 13 are the same as those of the foregoing embodiment 4 or 5, the description thereof is omitted here.

Next, the operation of the present embodiment 6 will be described.

In the speech coding apparatus of the present embodiment 6, the LP coefficients from the linear prediction analyzer 1 are supplied to the LPC-to-LSP converter 63 and bandwidth expanding sections 61-1–61-4.

The bandwidth expanding sections 61-1–61-4 carry out the bandwidth expansion of the LP coefficients fed from the linear prediction analyzer 1 in accordance with the expansion coefficients λ different from one another, and supplies the LP coefficients after the bandwidth expansion to the LPC-to-LSP converters 62-1–62-4. The LPC-to-LSP converters 62-k (k=1, 2, 3 and 4) convert the supplied LP coefficients to the LSP coefficients, and supply the LSP coefficients to the LSP quantizers 6B-k. The LSP quantizers 6B-k supply the selector 52 with the LSP codebook indices corresponding to the LSP coefficients, and with the quantization distortion involved in the quantization. The selector 52 selects the LSP codebook indices that will minimize the quantization distortion from among the LSP codebook indices of the LSP quantizers 6B-1–6B-4, and supplies the selected LSP codebook indices to the selector switch 4.

In this case, as the expansion coefficient λ decreases (that is, as it approaches zero), the distribution of the LSP coefficients is made more uniform. In contrast,as the expansion coefficient λ increases (that is, as it approaches one), the bandwidth expanding becomes less effective, so that the LSP coefficients approach closer the LSP coefficients that do not undergo the bandwidth expansion. Thus, a decreasing expansion coefficient λ has the same effect as an increasing correction coefficient α, whereas an increasing expansion coefficient λ has the same effect as a decreasing correction coefficient α. As a result, expanding the bandwidth of the LP coefficients by the plurality of bandwidth expanding sections 61-1–61-4 with different expansion coefficients λ can offer the same advantages as the embodiment 4 that corrects the LSP coefficients by the plurality of LSP coefficient correcting sections 3-1–3-4 with different correction coefficient α.

Since the remaining operation is the same as that of the foregoing embodiment 5, the description thereof is omitted here.

Although the bandwidth expanding sections 61-1–61-4 carry out the bandwidth expansion according to equation (2) in the present embodiment 6, they can perform the bandwidth expansion based on other methods. In addition, although the present embodiment 6 comprises four bandwidth expanding sections 61-1–61-4, four LPC-to-LSP converters 62-1–62-4 and four non-speech signal LSP quantizers 6B-1–6B-4, the number of them is not limited to four, but any number greater than one is acceptable.

Furthermore, as shown in FIG. 14, the bandwidth expanding sections 61-1 and 61-2 and the LPC-to-LSP converters 62-1 and 62-2 can be combined with the LSP coefficient correction section 3 and the DTMF detector 41 and with the LSP coefficient correction section 3A according to the foregoing embodiments 2 and 3. In this case, it is obvious that the number of the bandwidth expanding sections 61-1 and 61-2 and that of the LPC-to-LSP converters 62-1 and 62-2 are not limited to two, and the number of the LSP coefficient correction section 3 and that of the LSP coefficient correction section 3A are not limited to one.

As described above, the present embodiment 6 is configured such that it carries out the bandwidth expansion of the LP coefficients of the non-speech signal using the plurality of different expansion coefficients, converts the LP coefficients after the bandwidth expansion to the LSP coefficients, quantizes the LSP coefficients, and selects the LSP samples with the least quantization distortion from among the selected LSP samples in accordance with the LSP coefficients. As a result, the present embodiment 6 can select the LSP samples with small quantization distortion and little corruption in the spectrum profile, thereby offering an advantage of being able to quantize the LSP coefficients of the non-speech signal well.

Embodiment 7

Figure 15:
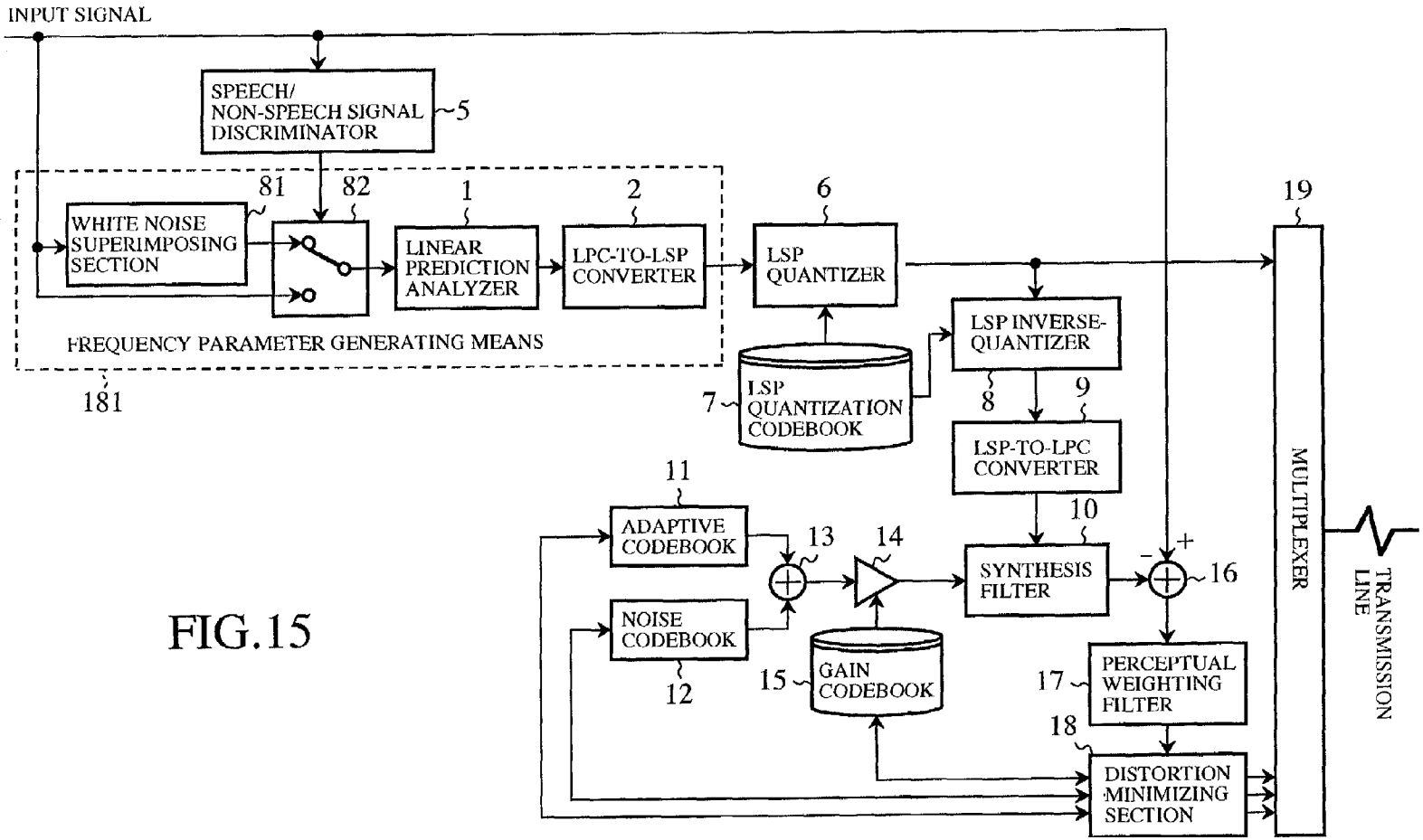
FIG. 15 is a block diagram showing a configuration of an embodiment 7 of the speech coding apparatus in accordance with the present invention.

FIG. 15 is a block diagram showing a configuration of an embodiment 7 of the speech coding apparatus in accordance with the present invention. In this figure, the reference numeral 81 designates a white noise superimposing section for generating pseudo white noise of a predetermined level, and for superimposing it on the input signal; and 82 designates a selector switch. Since the remaining components of FIG. 15 are the same as those of the foregoing embodiment 1, the description thereof is omitted here.

Next, the operation of the present embodiment 7 will be described.

In the speech coding apparatus of the present embodiment 7, the input signal is supplied to the speech/non-speech signal discriminator 5, subtracter 16, white noise superimposing section 81 and selector switch 82. The white noise superimposing section 81 superimposes the white noise of the predetermined level on the input signal, and supplies them to the selector switch 82.

On the other hand, in response to the decision result by the speech/non-speech signal discriminator 5, the selector switch 82 supplies the linear prediction analyzer 1 with the input signal itself when the input signal is the speech signal, and with the input signal on which the white noise is superimposed when the input signal is the non-speech signal. Thus, this is equivalent that the white noise is superimposed on the input signal only when the input signal is the non-speech signal. By thus superimposing the white noise on the non-speech signal, the peak width in the spectrum of the non-speech signal is expanded to some extent, thereby smoothing the spectrum of the non-speech signal.

The linear prediction analyzer 1 generates the LP coefficients from the input signal, supplies them to the LPC-to-LSP converter 2. The LPC-to-LSP converter 2 converts the LP coefficients to the LSP coefficients, and supplies the LSP coefficients to the LSP quantizer 6.

Since the remaining operation is the same as that of the foregoing embodiment 1, the description thereof is omitted here.

As described above, the present embodiment 7 is configured such that it superimposes the white noise on the non-speech signal, computes the LP coefficients from the input signal on which the white noise is superimposed, converts the LP coefficients to the LSP coefficients, quantizes the LSP coefficients. Thus, the present embodiment 7 can scatter the distribution of the LSP coefficients with keeping the spectrum profile near the tone frequencies of the non-speech signal. In addition, it offers an advantage of being able to further reduce the quantization distortion involved in quantizing the LSP coefficients of the non-speech signal by using the LSP quantization codebook 7 for the speech signal (that is, the LSP quantization codebook 7 formed for dealing with the speech signal) in common with the non-speech signal.

Embodiment 8

Figure 16:
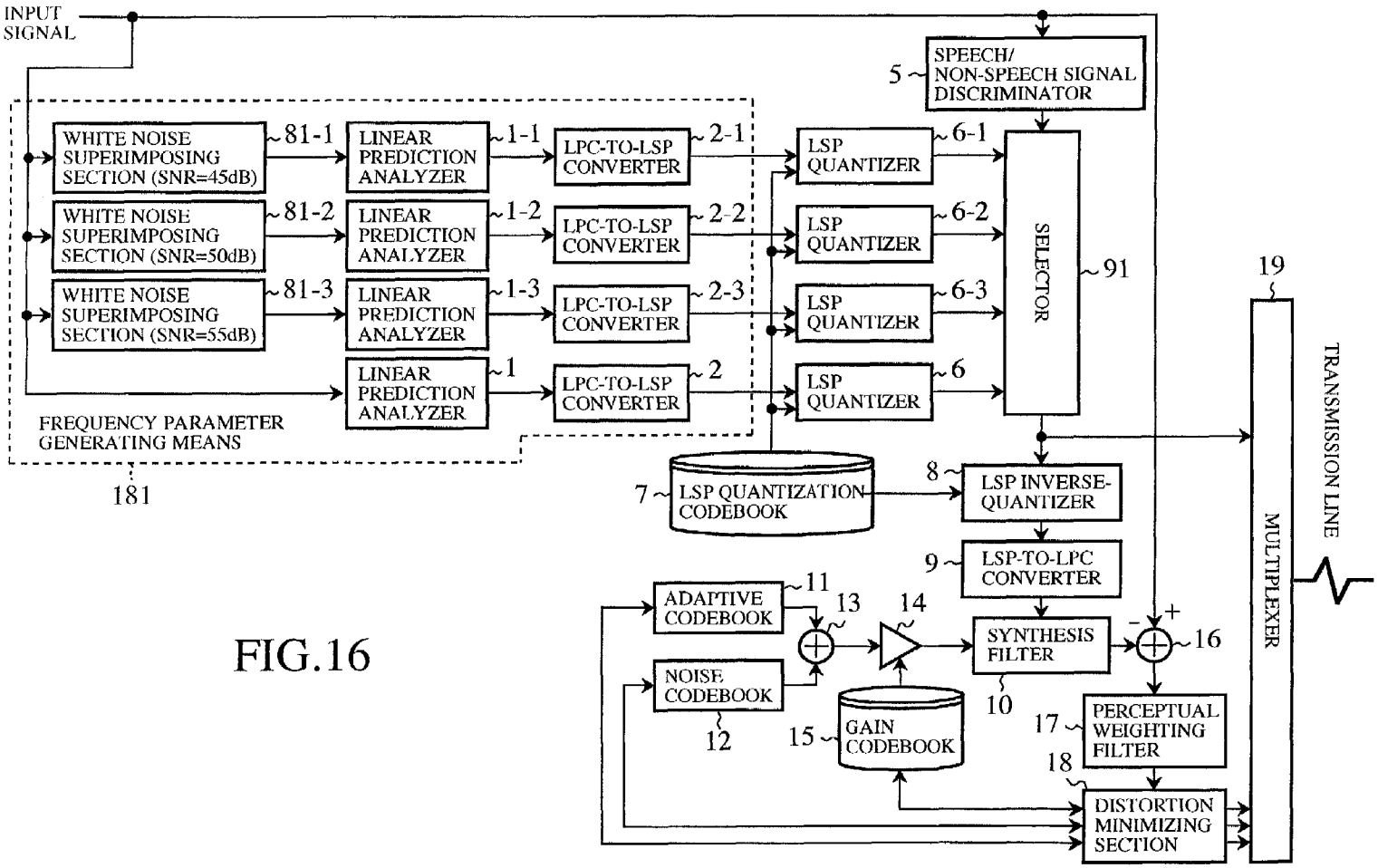
FIG. 16 is a block diagram showing a configuration of an embodiment 8 of the speech coding apparatus in accordance with the present invention.

FIG. 16 is a block diagram showing a configuration of an embodiment 8 of the speech coding apparatus in accordance with the present invention. In this figure, reference numerals 81-1–81-3 designate a plurality of white noise superimposing sections for generating pseudo white noises of different levels, and for superimposing them on the input signal; 1-1–1-3 designate linear prediction analyzers like the linear prediction analyzer 1; 2-1–2-3 designate LPC-to-LSP converters like the LPC-to-LSP converter 2; and 6-1–6-3 designate LSP quantizers like the LSP quantizer 6. The reference numeral 91 designates a selector for selecting the LSP codebook indices that will minimizes the quantization distortion from among the LSP codebook indices fed from the LSP quantizers 6 and 6-1–6-3. Since the remaining components of FIG. 16 are the same as those of the foregoing embodiment 6, the description thereof is omitted here.

Next, the operation of the present embodiment 8 will be described.

In the speech coding apparatus of the present embodiment 8, the input signal is supplied to the speech/non-speech signal discriminator 5, subtracter 16, white noise superimposing sections 81-1–81-3 and linear prediction analyzer 1.

The white noise superimposing section 81-1 superimposes the white noise whose SNR (Signal to Noise Ratio) is 45 dB on the input signal, and supplies the input signal on which the white noise is superimposed to the linear prediction analyzer 1-1. Likewise, the white noise superimposing section 81-2 superimposes the white noise whose SNR is 50 dB on the input signal, and supplies the input signal on which the white noise is superimposed to the linear prediction analyzer 1-2, and the white noise superimposing section 81-3 superimposes the white noise whose SNR is 55 dB on the input signal, and supplies the input signal on which the white noise is superimposed to the linear prediction analyzer 1-3.

The linear prediction analyzers 1-k (k=1, 2 and 3) generate the LP coefficients from the supplied signals, and supply them to the LPC-to-LSP converters 2-k. The LPC-to-LSP converters 2-k convert the LP coefficients to the LSP coefficients, and supply the LSP coefficients to the LSP quantizers 6-k. The LSP quantizers 6-k supply the selector 91 with the LSP codebook indices corresponding to the LSP coefficients and with the quantization distortion corresponding to them by referring to the LSP quantization codebook 7.

In this case, as the white noise level to be superimposed increases (that is, as the SNR reduces), the distribution of the LSP coefficients becomes more uniform. In contrast, as the white noise level decreases (that is, as the SNR increases), the LSP coefficients approach closer the LSP coefficients that do not undergo the superimposition of the white noise. Thus, an increasing white noise level has the same effect as an increasing correction coefficient $\alpha$, whereas a decreasing white noise level has the same effect as a decreasing correction coefficient a. As a result, superimposing the white noises of different levels on the input signal by the plurality of white noise superimposing sections 81-1–81-3 can offer the same advantage as the embodiment 4 that corrects the LSP coefficients by the plurality of LSP coefficient correcting sections 3-1–3-4 with different correction coefficient $\alpha$.

on the other hand, the linear prediction analyzer 1 generates the LP coefficients from the input signal, and supplies them to the LPC-to-LSP converter 2. The LPC-to-LSP converter 2 converts the LP coefficients to the LSP coefficients, and supplies the LSP coefficients to the LSP quantizer 6. The LSP quantizer 6 selects the LSP coefficients by referring to the LSP quantization codebook 7, and supplies the selector 91 with the quantization distortion at that time.

In response to the decision result by the speech/non-speech signal discriminator 5, when the input signal is the speech signal, the selector 91 selects the LSP codebook indices from the LSP quantizer 6 and supplies it to the multiplexer 19 and LSP inverse-quantizer 8, whereas when the input signal is the non-speech signal, it selects the LSP codebook indices with the minimum quantization distortion from among the LSP quantizers 6 and 6-1–6-3, and supplies them to the multiplexer 19 and LSP inverse-quantizer 8.

Since the remaining operation is the same as that of the foregoing embodiment 6, the description thereof is omitted here.

The number of the white noise superimposing sections 81-1–81-3, and the levels of the white noise to be superimposed are not limited to the foregoing value.

As described above, the present embodiment 8 is configured such that it superimposes the white noises of different levels on the non-speech signal, computes the LP coefficients from the signals on which the white noises are superimposed, converts the LP coefficients to the LSP coefficients, quantizes the LSP coefficients, and selects the LSP samples with the least quantization distortion from among the selected LSP samples in accordance with the LSP coefficients. As a result, the present embodiment 8 can select the LSP samples with small quantization distortion and little corruption in the spectrum profile, thereby offering an advantage of being able to quantize the LSP coefficients of the non-speech signal well.

Embodiment 9

Figure 17:
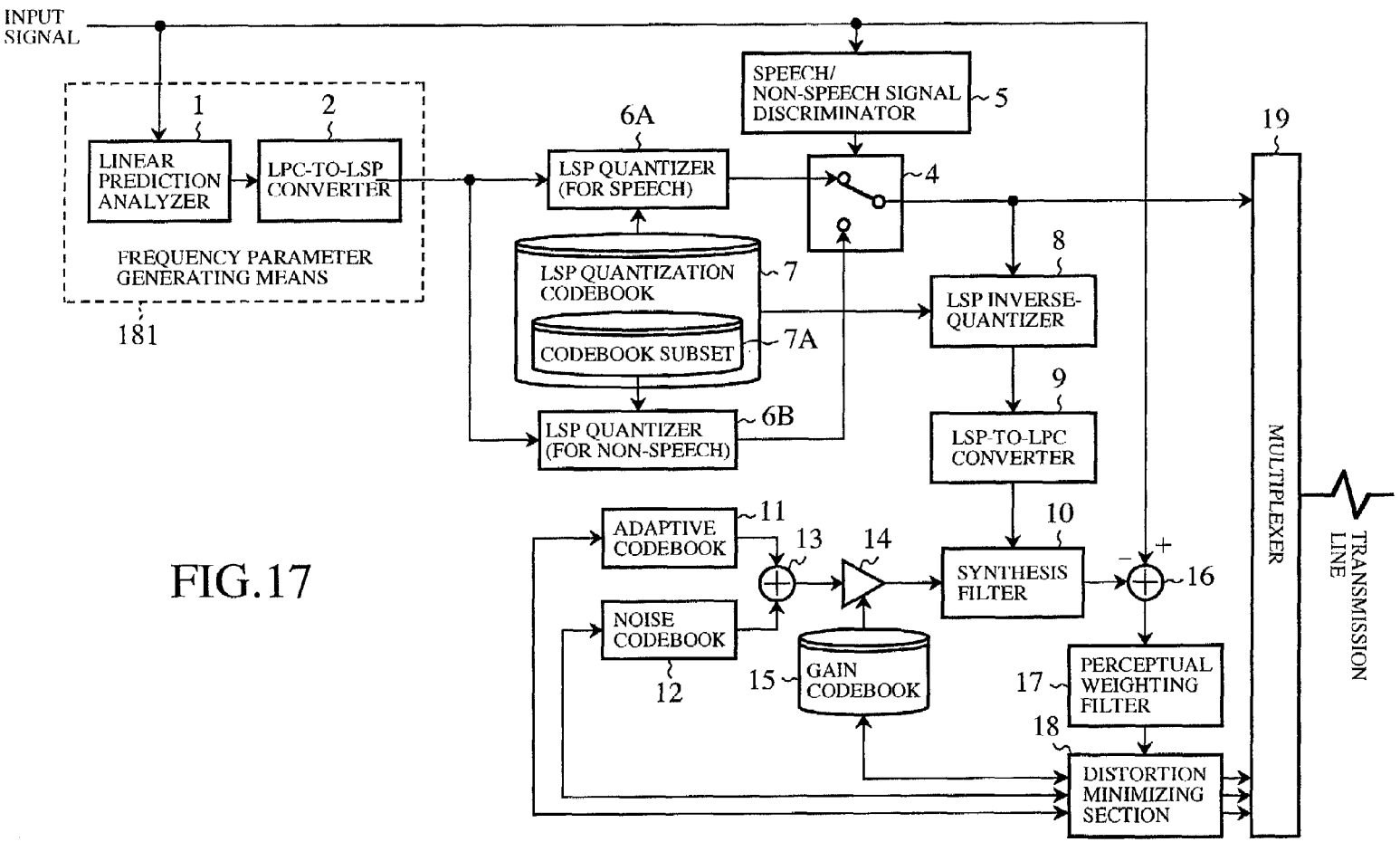
FIG. 17 is a block diagram showing a configuration of an embodiment 9 of the speech coding apparatus in accordance with the present invention.

FIG. 17 is a block diagram showing a configuration of an embodiment 9 of the speech coding apparatus in accordance with the present invention. In this figure, the reference numeral 7A designates a codebook subset including a subset of the LSP samples stored in the LSP quantization codebook 7. Here, the same LSP samples in the codebook subset 7A and in the LSP quantization codebook 7 are assigned the same LSP codebook indices.

Since the remaining components of FIG. 17 are the same as those of the foregoing embodiment 2, the description thereof is omitted here. However, the LSP coefficient correcting section 3 that is installed in front of the LSP quantizer 6B in FIG. 6 is removed.

Next, the operation of the present embodiment 9 will be described.

Figure 18:
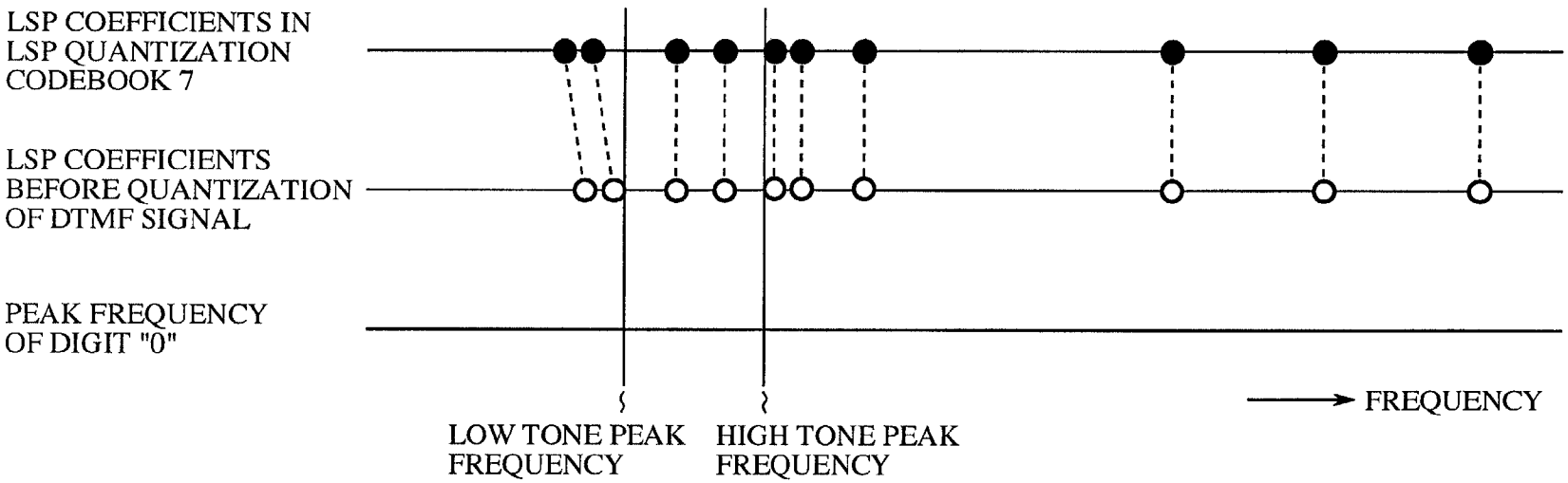
FIG. 18 is a diagram illustrating an example of the correspondence between the LSP coefficients of the DTMF signal before quantization and the LSP samples in the LSP quantization codebook.

FIG. 18 is a diagram illustrating an example of the correspondence between the LSP coefficients of a DTMF signal before quantization and the LSP samples in the LSP quantization codebook 7.

In the speech coding apparatus of the present embodiment 9, the LSP quantizer 6B quantizes the LSP coefficients by referring to the codebook subset 7A. In other words, the LSP quantizer 6B does not search all the LSP samples in the LSP quantization codebook 7 for the optimum LSP samples, but searches only the LSP samples in the codebook subset 7A for the optimum LSP samples.

The LSP samples of the codebook subset 7A are selected from among the LSP samples in the LSP quantization codebook 7 in such a manner that the LSP samples are removed which are likely to bring about large frequency distortion when quantizing the LSP coefficients of the non-speech signal. For example, the LSP samples that can cause large frequency distortion in the quantization of the LSP coefficients which are obtained by the linear prediction analysis of the DTMF signals are removed from the LSP samples of the LSP quantization codebook 7 so that only a subset consisting of the remaining LSP samples constitutes the codebook subset 7A. For example, as illustrated in FIG. 18, the LSP samples having large quantization errors near the tone peak frequency of the DTMF signals are removed in advance to be excluded from the codebook subset 7A.

As a result, using the codebook subset 7A can prevent the LSP quantizer 6B from selecting the LSP samples that can cause large quantization distortion when coding the LSP coefficients of the non-speech signal such as the DTMF signals, even when using the distortion estimation method based on the least square error of the LSP coefficients.

Since the remaining operation is the same as that of the foregoing embodiment 2, the description thereof is omitted here. As described above, since the set of the LSP samples in the codebook subset 7A is the subset of the LSP samples in the LSP quantization codebook 7, they use the same LSP codebook indices. Accordingly, the speech decoding apparatus can select the same LSP samples using these LSP codebook indices. As a result, the decision result of the speech/non-speech signal discriminator 5 in the speech coding apparatus is not required for the decoding processing by the speech decoding apparatus, which makes it unnecessary for the speech coding apparatus to transmit the decision result.

As described above, the present embodiment 9 is configured such that it quantizes the LSP coefficients of the non-speech signal by referring to the codebook subset 7A consisting only of the LSP samples selected from the LSP quantization codebook 7, which are unlikely to bring about large frequency distortion in the quantization of the LSP coefficients of the non-speech signal. Accordingly, the present embodiment 9 can use the common bit sequence for both the speech signal transmission and non-speech signal transmission. As a result it offers an advantage of being able to implement good in-channel transmission of the non-speech signal such as the DTMF signals without changing the speech decoding apparatus on the receiving side.

Embodiment 10

Figure 19:
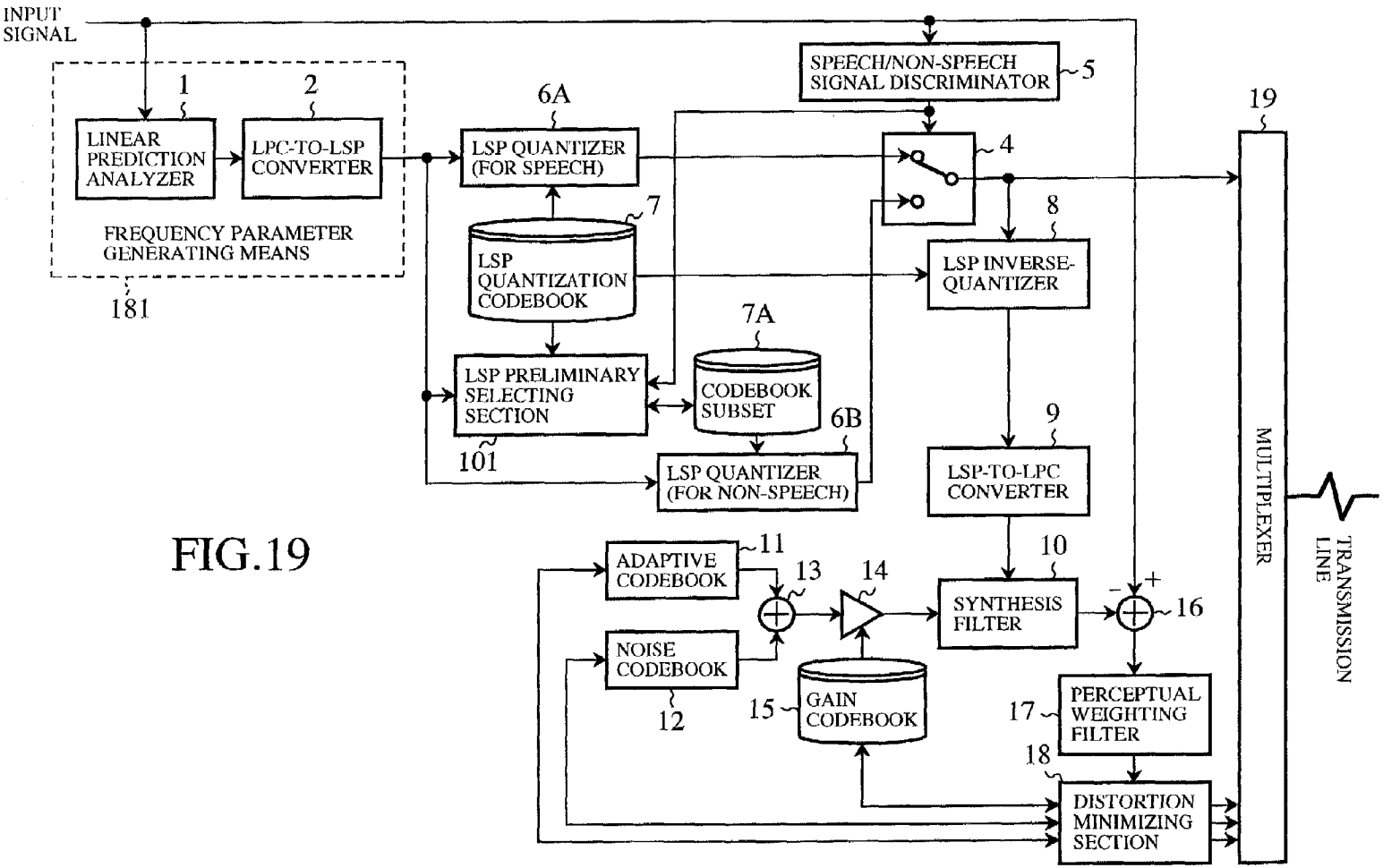
FIG. 19 is a block diagram showing a configuration of an embodiment 10 of the speech coding apparatus in accordance with the present invention.

FIG. 19 is a block diagram showing a configuration of an embodiment 10 of the speech coding apparatus in accordance with the present invention. In this figure, the reference numeral 101 designates an LSP preliminary selecting section for selecting LSP samples usable for the non-speech signal from among the LSP samples in the LSP quantization codebook 7 according to the LSP coefficients fed from the LPC-to-LSP converter 2, and for placing the selected LSP samples as the LSP samples of the codebook subset 7A. Since the remaining components of FIG. 19 are the same as those of the foregoing embodiment 9, the description thereof is omitted here.

Next, the operation of the present embodiment 10 will be described.

The LSP preliminary selecting section 101 performs the following processing on the LSP coefficients of the non-speech signal fed from the LPC-to-LSP converter 2. It selects from the LSP quantization codebook 7 the LSP samples with which the quantization distortion is estimated to be large and/or to be small when quantizing the LSP coefficients. If the LSP samples with which the quantization distortion is estimated to be greater than a first reference value are included in the codebook subset 7A, these LSP samples are removed from the codebook subset 7A, and/or if the LSP samples with which the quantization distortion is estimated to be less than a second reference value are not included in the codebook subset 7A, these LSP samples are added to the codebook subset 7A. Thus, the LSP samples included in the codebook subset 7A vary adaptively in accordance with the processing result of the LSP preliminary selecting section 101 corresponding to the LSP coefficients of the non-speech signal.

Alternatively, the LSP preliminary selecting section 101 can take a configuration like the LSP quantizer 6B as shown in FIG. 7, so that its distortion minimizing section 37 can add N LSP samples with least quantization distortion to the codebook subset 7A, where N is a predetermined number greater than one, and if it finds that the LSP samples with quantization distortion greater than a predetermined value are included in the codebook subset 7A, it can remove these LSP samples from the codebook subset 7A.

Since the remaining operation is the same as that of the foregoing embodiment 9, the description thereof is omitted here. As described above, the present embodiment 10 is configured such that it selects the LSP samples usable for the non-speech signal from among the LSP samples in the LSP quantization codebook 7 according to the LSP coefficients of the input non-speech signal, and places the selected LSP samples as the LSP samples of the codebook subset 7A. As a result, the present embodiment 10 offers an advantage of being able to vary the LSP samples constituting the codebook subset 7A adaptively, and hence to replace the LSP samples to those more suitable for the non-speech signal.

Embodiment 11

Figure 20:
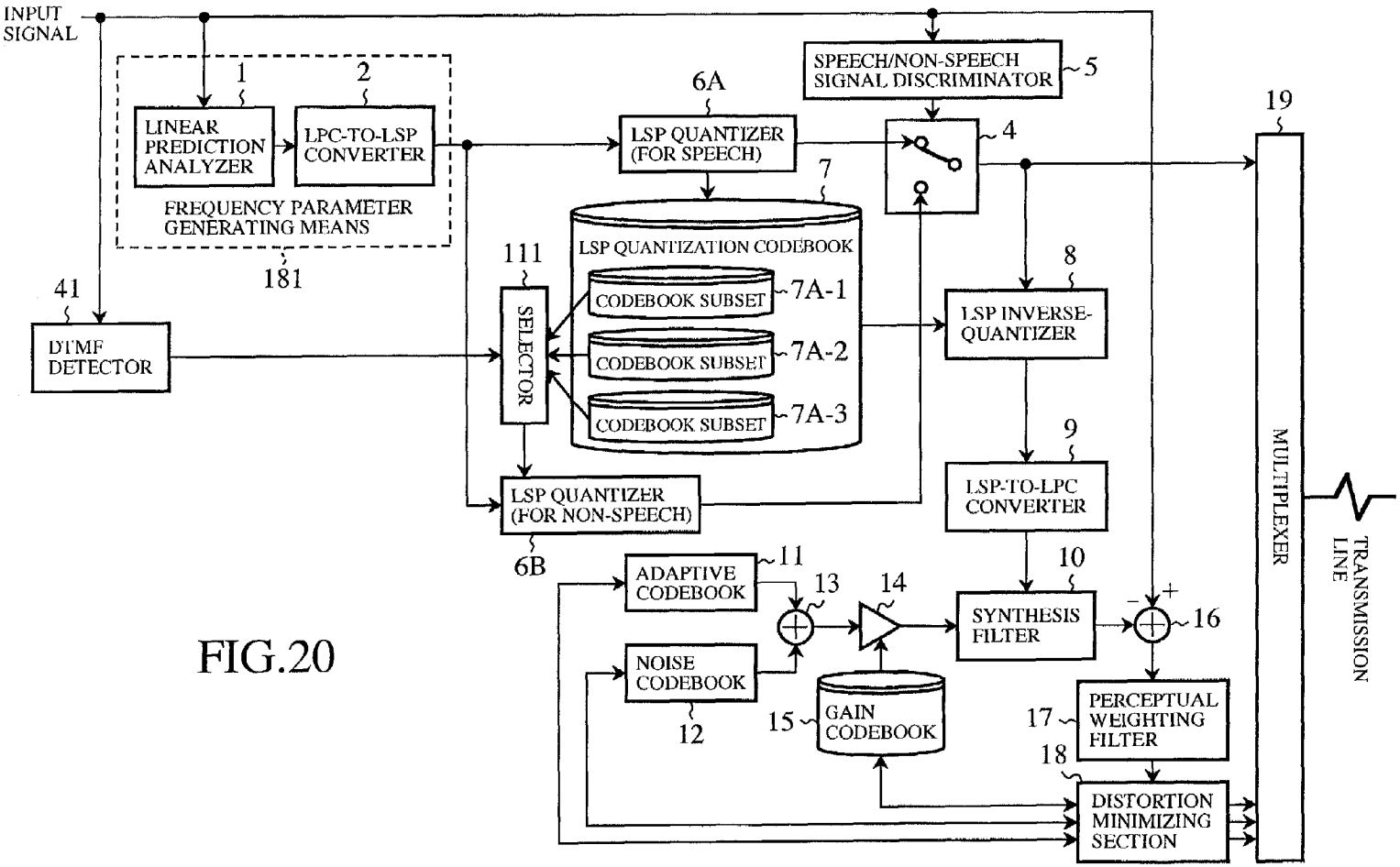
FIG. 20 is a block diagram showing a configuration of an embodiment 11 of the speech coding apparatus in accordance with the present invention.

FIG. 20 is a block diagram showing a configuration of an embodiment 11 of the speech coding apparatus in accordance with the present invention. In this figure, reference numerals 7A-1–7A-3 designate a plurality of codebook subsets, each of which includes a plurality of LSP samples that are searched in the quantization of the LSP coefficients of prescribed types of non-speech signals. Here, the same LSP samples in the codebook subsets 7A-1–7A-3 and in the LSP quantization codebook 7 are assigned the same LSP codebook indices.

The reference numeral 111 designates a selector for selecting one of the codebook subsets 7A-i (i=1, 2 and 3) in response to the information about the digits fed from the DTMF detector 41 to enable the selected codebook subset 7A-i to be read by the LSP quantizer 6B; and 41 designates a DTMF detector for detecting the DTMF signals from the input signal, and for notifying the selector 111 of the types (that is, the digits) of the DTMF signals. Since the remaining components of FIG. 20 are the same as those of the foregoing embodiment 2, the description thereof is omitted here.

Next, the operation of the present embodiment 11 will be described.

Detecting a DTMF signal from the input signal, the DTMF detector 41 notifies the selector 111 of the type (the digit) of the DTMF signal. The selector 111 selects one of the codebook subsets 7A-i (i=1, 2 and 3) corresponding to the digit sent from the DTMF detector 41, and enables the codebook subset 7A-i to be read from the LSP quantizer 6B. The LSP quantizer 6B selects the LSP codebook indices corresponding to the LSP coefficients by referring to the codebook subset 7A-i via the selector 111. Thus, the LSP quantizer 6B does not search all the LSP samples in the LSP quantization codebook 7 for the optimum LSP samples, but searches only LSP samples in the codebook subset 7A-i for the optimum LSP samples.

The LSP samples of the codebook subset 7A-i are selected from among the LSP samples in the LSP quantization codebook 7 such that the LSP samples are removed which are likely to bring about large frequency distortion when quantizing the LSP coefficients of the respective digits. For example, by removing from the LSP samples of the LSP quantization codebook 7 the LSP samples that can cause large frequency distortion in the quantization of the LSP coefficients that are obtained in the linear prediction analysis of the DTMF signals after classifying them in terms of the digits, only a subset consisting of the remaining LSP samples constitutes the codebook subset 7A-i. In this case, the number of the codebook subsets 7A-i are not limited to three as shown in FIG. 20. They can be installed by any other number such as 16 which has one-to-one correspondence with the respective digits. Besides, it is unnecessary for the codebook subset 7A-j (j≠i) to include the same LSP samples included in the codebook subset 7A-i.

As a result, using the codebook subsets 7A-i can prevent the LSP quantizer 6B from selecting the LSP samples that can cause large quantization distortion when coding the LSP coefficients corresponding to the digits of the DTMF signals, even when employing the distortion estimation method based on the least square error of the LSP coefficients.

Since the remaining operation is the same as that of the foregoing embodiment 2, the description thereof is omitted here.

As described above, the present embodiment 11 is configured such that it detects the type of the non-speech signal, and quantizes the LSP coefficients of the non-speech signal by referring to the codebook subset 7A-i consisting of such LSP samples that are selected from the LSP samples included in the LSP quantization codebook 7, and are unlikely to bring about large frequency distortion in the quantization of the LSP coefficients of that type of the non-speech signal. As a result, the present embodiment 11 offers an advantage of being able to implement better in-channel transmission of the non-speech signals of various types.

Embodiment 12

Figure 21:
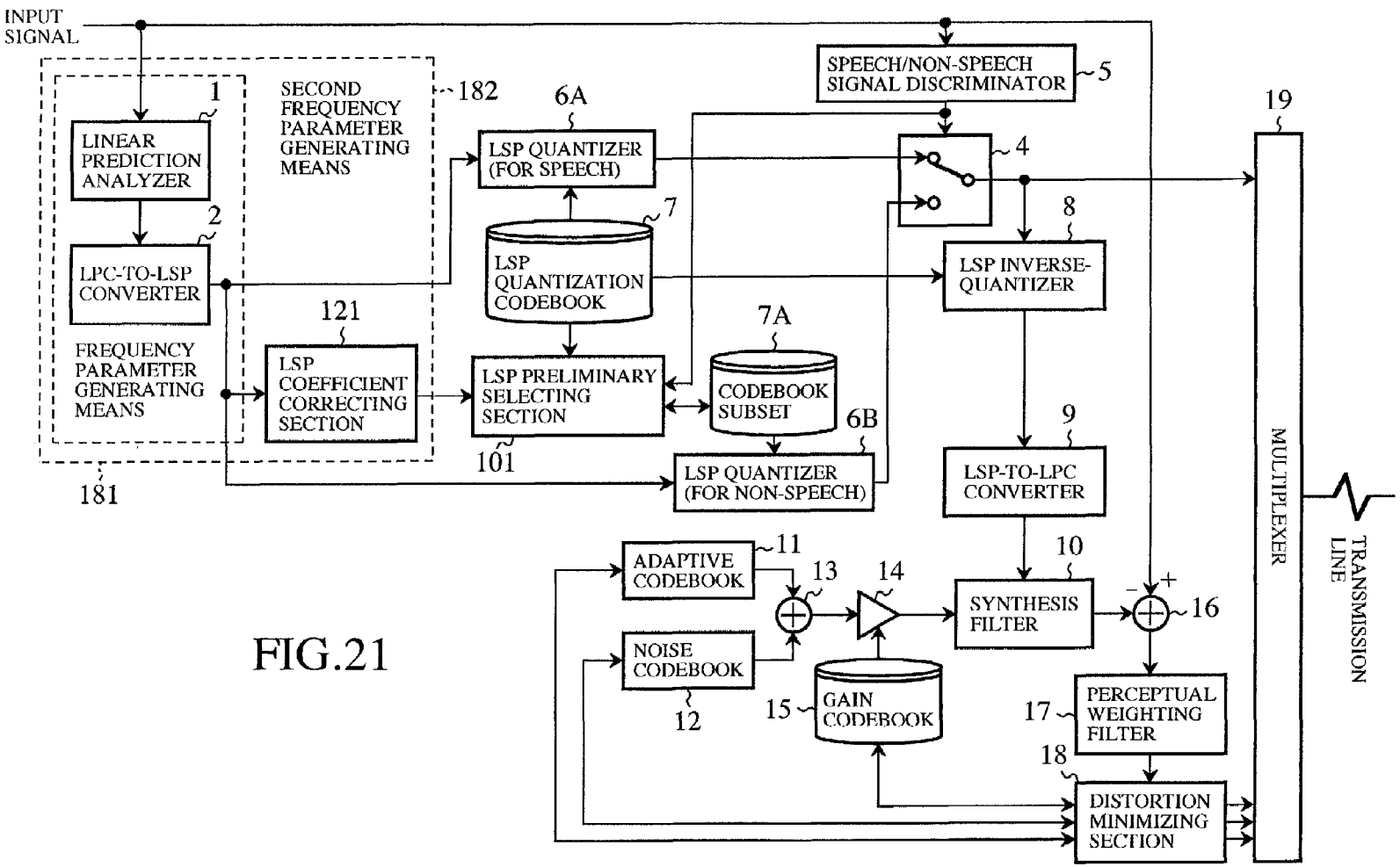
FIG. 21 is a block diagram showing a configuration of an embodiment 12 of the speech coding apparatus in accordance with the present invention.

FIG. 21 is a block diagram showing a configuration of an embodiment 12 of the speech coding apparatus in accordance with the present invention. In this figure, the reference numeral 121 designates an LSP coefficient correcting section installed in front of the LSP preliminary selecting section 101. The reference numeral 182 designates second frequency parameter generating means for generating LSP coefficients (frequency parameters) to be supplied to the LSP preliminary selecting section 101.

Since the remaining components of FIG. 21 are the same as those of the foregoing embodiment 10, the description thereof is omitted here.

Next, the operation of the present embodiment 12 will be described.

In the speech coding apparatus of the present embodiment 12, the LSP coefficient correcting section 121 performs the same correction processing as the LSP coefficient correcting section 3 on the LSP coefficients output from the LPC-to-LSP converter 2, and supplies the LSP coefficients after the correction to the LSP preliminary selecting section 101. Then, the LSP preliminary selecting section 101 adaptively changes the LSP samples in the codebook subset 7A in accordance with the LSP coefficients after the correction.

Since the remaining operation is the same as that of the foregoing embodiment 10, the description thereof is omitted here.

As described above, the present embodiment 12 is configured such that it corrects the LSP coefficients of the non-speech signal to reduce the quantization distortion involved in the quantization, and in accordance with the LSP coefficients after the correction, it extracts from the LSP quantization codebook 7 the LSP samples that are suitable for the quantization of the LSP coefficients of the non-speech signal, and are stored in the codebook subset 7A. As a result, the present embodiment 12 has an advantage of being able to select the LSP samples suitable for the non-speech signal from the LSP samples constituting the LSP quantization codebook 7 for the speech signal.

Embodiment 13

Figure 22:
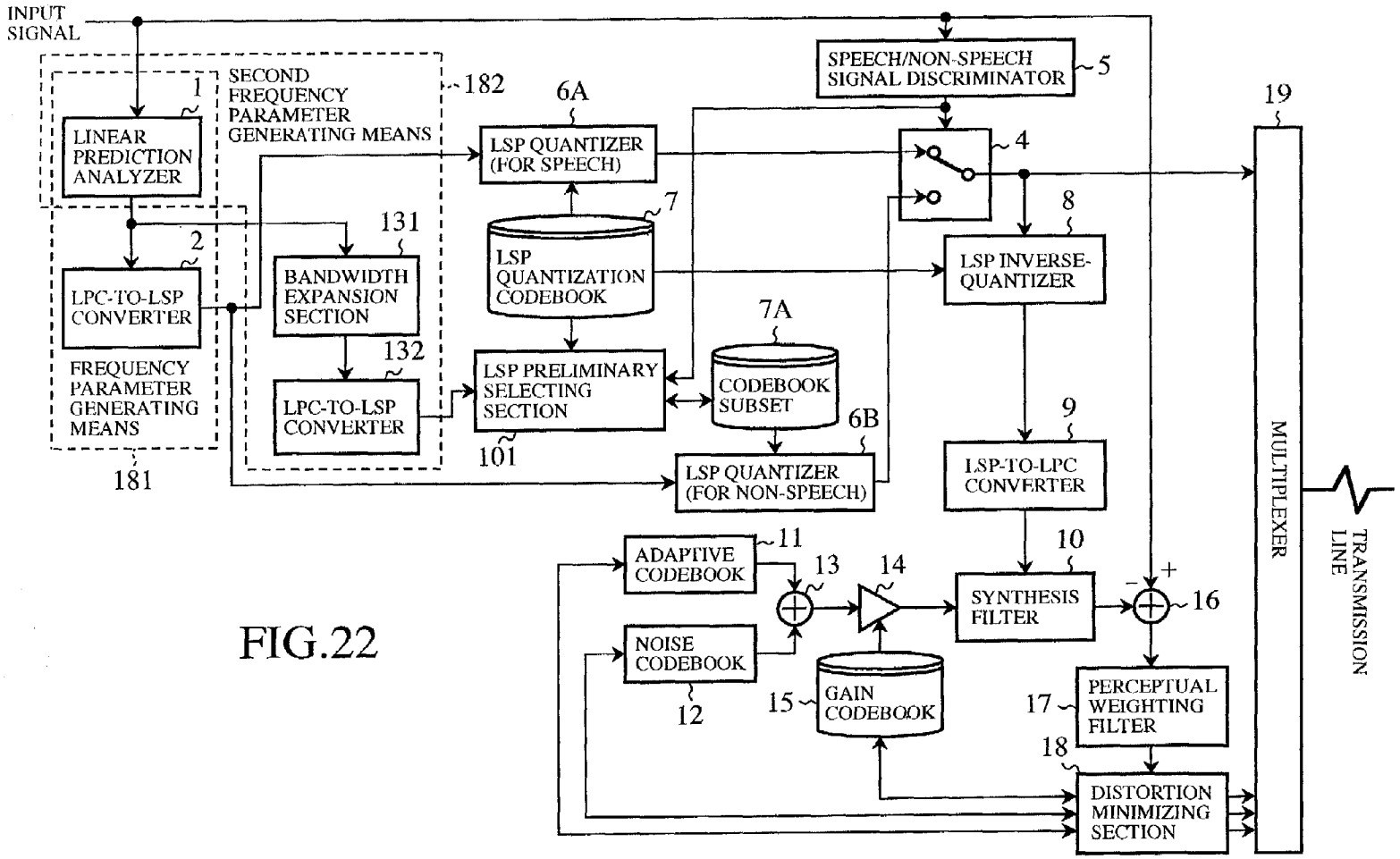
FIG. 22 is a block diagram showing a configuration of an embodiment 13 of the speech coding apparatus in accordance with the present invention.

FIG. 22 is a block diagram showing a configuration of an embodiment 13 of the speech coding apparatus in accordance with the present invention. In this figure, the reference numeral 131 designates a bandwidth expanding section installed in front of the LSP preliminary selecting section 101; and 132 designates an LPC-to-LSP converter installed in front of the LSP preliminary selecting section 101. Since the remaining components of FIG. 22 are the same as those of the foregoing embodiment 10, the description thereof is omitted here.

Next, the operation of the present embodiment 13 will be described.

In the speech coding apparatus of the present embodiment 13, the LP coefficients output from the linear prediction analyzer 1 are supplied to the LPC-to-LSP converter 2 and bandwidth expanding section 131. The bandwidth expanding section 131 carries out the bandwidth expansion of the LP coefficients in the same manner as the bandwidth expanding section 61, and supplies the bandwidth expanded LP coefficients to the LPC-to-LSP converter 132. The LPC-to-LSP converter 132 converts the LP coefficients to the LSP coefficients, and supplies them to the LSP preliminary selecting section 101. The LSP preliminary selecting section 101 adaptively changes the LSP samples in the codebook subset 7A in accordance with the LSP coefficients.

Since the remaining operation is the same as that of the foregoing embodiment 10, the description thereof is omitted here.

As described above, the present embodiment 13 is configured such that it carries out the bandwidth expansion of the LP coefficients of the non-speech signal, converts the LP coefficients after the expansion to the LSP coefficients, and in accordance with the LSP coefficients, it extracts the LSP samples suitable for the quantization of the LSP coefficients of the non-speech signal from the LSP quantization codebook 7 to be stored as the codebook subset 7A. As a result, the present embodiment 13 has an advantage of being able to select the LSP samples suitable for the non-speech signal from the LSP samples constituting the LSP quantization codebook 7 for the speech signal.

Embodiment 14

Figure 23:
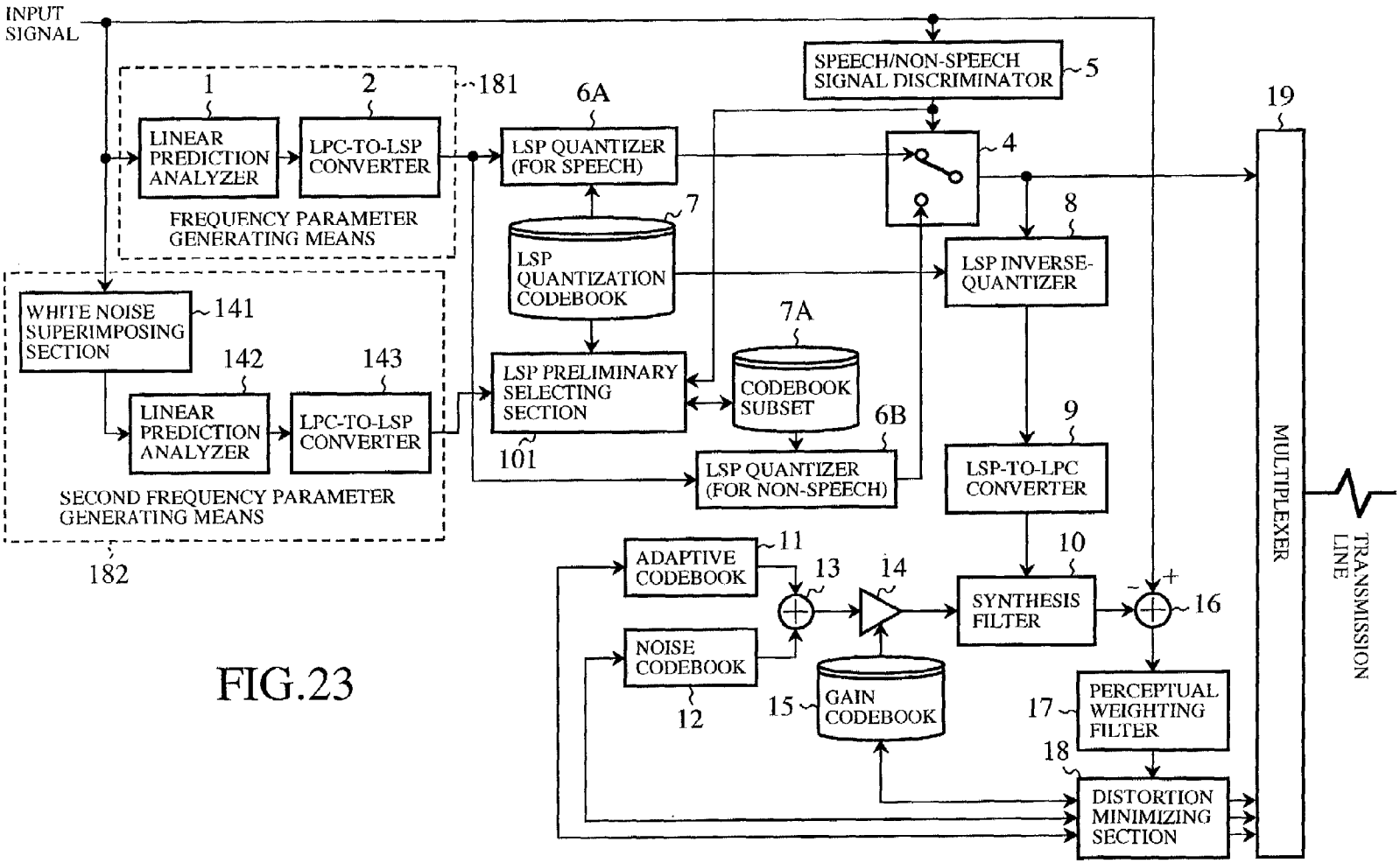
FIG. 23 is a block diagram showing a configuration of an embodiment 14 of the speech coding apparatus in accordance with the present invention.

FIG. 23 is a block diagram showing a configuration of an embodiment 14 of the speech coding apparatus in accordance with the present invention. In this figure, the reference numeral 141 designates a white noise superimposing section installed in front of the LSP preliminary selecting section 101; 142 designates a linear prediction analyzer installed in front of the LSP preliminary selecting section 101; and 143 designates an LPC-to-LSP converter installed in front of the LSP preliminary selecting section 101. Since the remaining components of FIG. 23 are the same as those of the foregoing embodiment 10, the description thereof is omitted here.

Next, the operation of the present embodiment 14 will be described.

In the speech coding apparatus of the present embodiment 14, the input signal is supplied to the linear prediction analyzer 1, speech/non-speech signal discriminator 5, subtracter 16 and white noise superimposing section 141. The white noise superimposing section 141 superimposes white noise on the input signal as the white noise superimposing section 81, and supplies the linear prediction analyzer 142 with the input signal on which the white noise is superimposed. The linear prediction analyzer 142 generates the LP coefficients from the signal in the same manner as the linear prediction analyzer 1, and supplies them to the LPC-to-LSP converter 143. The LPC-to-LSP converter 143 converts the LP coefficients to the LSP coefficients, and supplies the LSP coefficients to the LSP preliminary selecting section 101. The LSP preliminary selecting section 101 adaptively changes the LSP samples in the codebook subset 7A in accordance with the LSP coefficients.

Since the remaining operation is the same as that of the foregoing embodiment 10, the description thereof is omitted here.

As described above, the present embodiment 14 is configured such that it superimposes the white noise on the non-speech signal, computes the LP coefficients from the input signal on which the white noise is superimposed, converts the LP coefficients to the LSP coefficients, and in accordance with the LSP coefficients, it extracts from the LSP quantization codebook 7 the LSP samples suitable for the quantization of the LSP coefficients of the non-speech signal to be stored as the codebook subset 7A. As a result, the present embodiment 14 has an advantage of being able to select the LSP samples suitable for the non-speech signal from the LSP samples constituting the LSP quantization codebook 7 for the speech signal.

Embodiment 15

Figure 24:
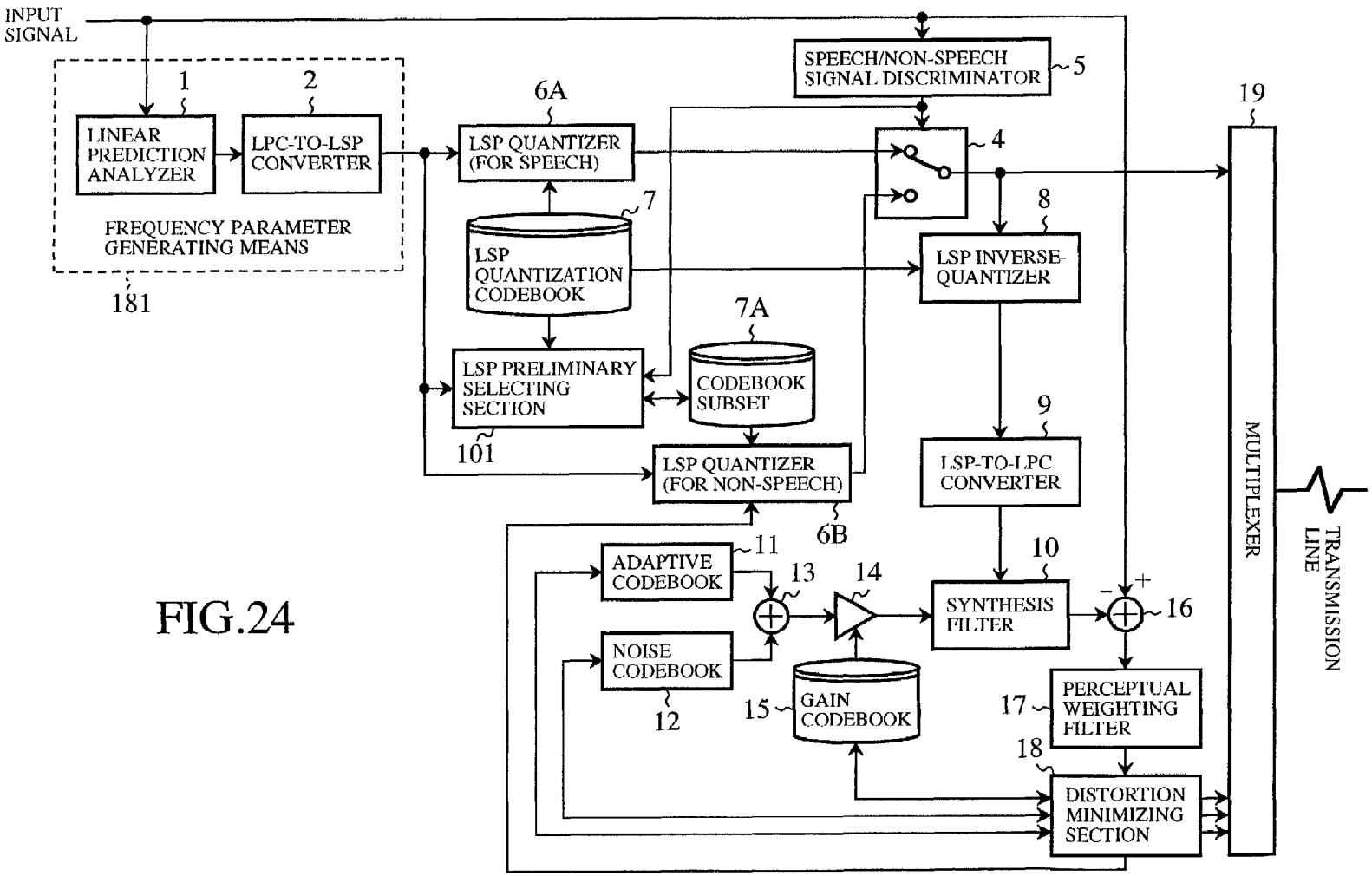
FIG. 24 is a block diagram showing a configuration of an embodiment 15 of the speech coding apparatus in accordance with the present invention.

FIG. 24 is a block diagram showing a configuration of an embodiment 15 of the speech coding apparatus in accordance with the present invention. In this figure, the reference numeral 18A designates a distortion minimizing section for searching the codebook subset 7A for the LSP samples that will minimize the quantization distortion when the input signal is the non-speech signal, and for outputting, in addition to the LSP codebook indices corresponding to the LSP samples, the adaptive codebook indices, noise codebook indices and gain codebook indices when the quantization distortion is minimum in the same manner as the distortion minimizing section 18. Since the remaining components of FIG. 24 are the same as those of the foregoing embodiment 10, the description thereof is omitted here. However, the LSP codebook indices from the selector switch 4 are supplied to the distortion minimizing section 18A rather than to the multiplexer 19.

Next, the operation of the present embodiment 15 will be described.

The distortion minimizing section 18A operates as follows: It successively changes the adaptive codebook indices, noise codebook indices and gain codebook indices, thereby sequentially varying exciting signals for driving the synthesis filter 10. In addition, it causes the LSP quantizer 6B to successively output the LSP codebook indices of the LSP samples included in the codebook subset 7A, and to supply the synthesis filter 10 with the plurality of LP coefficients corresponding to the LSP codebook indices, thereby causing the synthesis filter 10 to synthesize speech signals associated with the exciting signals in accordance with the filtering characteristics based on the LP coefficients.

The subtracter 16 subtracts the synthesized speech signals from the input signal, and supplies the errors between them to the perceptual weighting filter 17. The perceptual weighting filter 17 regulates the filter coefficients adaptively according to the frequency distribution of the input signal, carries out the filtering of the speech signal errors, and supplies the errors after the filtering to the distortion minimizing section 18A as the distortion.

The distortion minimizing section 18A iteratively selects the LSP samples used for the quantization, pitch parameters output from the adaptive codebook 11, noise parameters output from the noise codebook 12 and gain parameters output from the gain codebook 15 such that the square of the distortion becomes minimum, and supplies the multiplexer 19 with the LSP codebook indices, adaptive codebook indices, noise codebook indices and gain codebook indices at the time when the distortion becomes minimum. Thus, the distortion minimizing section 18A selects optimum codewords by the closed loop search method using the four variables consisting of the LSP codebook indices, adaptive codebook indices, noise codebook indices and gain codebook indices.

Since the remaining operation is the same as that of the foregoing embodiment 10, the description thereof is omitted here. Incidentally, when the input signal is the speech signal, the closed loop search including the LSP samples is not carried out. In this case, the LSP codebook indices, which are supplied from the LSP quantizer 6A to the distortion minimizing section 18A via the selector switch 4, are supplied to the multiplexer 19 directly.

As described above, the present embodiment 15 is configured such that it selects the optimum codewords that will achieve the least distortion in the synthesized speech signal according to the closed loop search method using the four variables, the LSP codebook indices, adaptive codebook indices, noise codebook indices and gain codebook indices. As a result, it offers an advantage of being able to further reduce the distortion involved in the coding.

Embodiment 16

Figure 25:
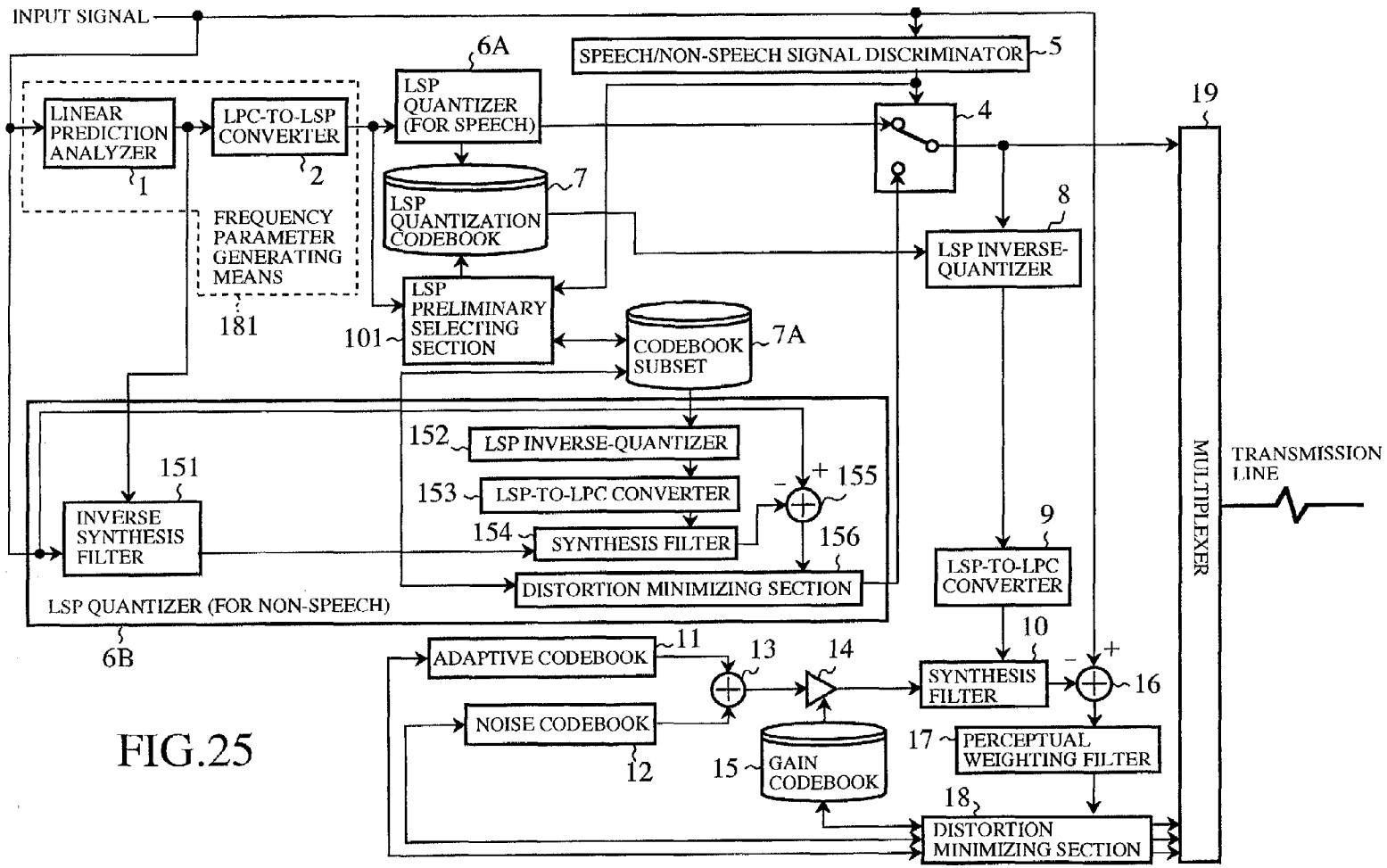
FIG. 25 is a block diagram showing a configuration of an embodiment 16 of the speech coding apparatus in accordance with the present invention.

FIG. 25 is a block diagram showing a configuration of an embodiment 16 of the speech coding apparatus in accordance with the present invention. In this figure, the reference numeral 151 designates an inverse synthesis filter installed in the LSP quantizer 6B for carrying out the inverse operation to that of the synthesis filter 154 on the input signal (though the LP coefficients are different); 152 designates an LSP inverse-quantizer installed in the LSP quantizer 6B for computing the LSP coefficients from the LSP codebook indices read from the codebook subset 7A; 153 designates an LSP-to-LPC converter installed in the LSP quantizer 6B; 154 designates a synthesis filter that is installed in the LSP quantizer 6B and is similar to the synthesis filter 10; 155 designates a subtracter installed in the LSP quantizer 6B; and 156 designates a distortion minimizing section installed in the LSP quantizer 6B for searching for the LSP samples that will minimize the error between the input signal and the speech signal generated by the synthesis filter 154, and for outputting the LSP codebook indices corresponding to the LSP samples.

Since the remaining components of FIG. 25 are the same as those of the foregoing embodiment 10, the description thereof is omitted here.

Next, the operation of the present embodiment 16 will be described.

In the LSP quantizer 6B of the non-speech signal in the speech coding apparatus of the present embodiment 16, the inverse synthesis filter 151 generates, by equation (3), the linear prediction residual error signal from the input signal according to the filtering characteristics based on the LP coefficients generated by the linear prediction analyzer 1, and supplies it to the synthesis filter 154 instead of the exciting signal.

$$S^{-1}(z) = 1 + \sum_{i=1}^{10} a(i)z^{-i} \tag{3}$$

where a(i) is the ith order LP coefficient.

On the other hand, from the LSP codebook indices corresponding to the LSP samples included in the codebook subset 7A, the LSP inverse-quantizer 152 computes the LSP coefficients corresponding to the LSP codebook indices, and supplies them to the LSP-to-LPC converter 153. The LSP-to-LPC converter 153 converts the LSP coefficients to the LP coefficients, and supplies the LP coefficients to the synthesis filter 154.

The synthesis filter 154 generates the speech signal from the linear prediction residual error signal according to the filtering characteristics based on the LP coefficients (for example, the inverse function of equation (3)), and supplies it to the subtracter 155. The subtracter 155 computes the error between the input signal and the speech signal generated by the synthesis filter 154 as the distortion, and supplies the error to the distortion minimizing section 156. The distortion minimizing section 156 searches the codebook subset 7A for the LSP samples such that the square of the distortion becomes minimum, and supplies the selector switch 4 with the LSP codebook indices corresponding to the LSP samples that will minimize the square of the distortion.

In the course of searching for the LSP samples, the distortion minimizing section 156 causes the codebook subset 7A to supply the LSP inverse-quantizer 152 iteratively with the LSP codebook indices of the different LSP samples, so that the LSP inverse-quantizer 152 and LSP-to-LPC converter 153 generate the LP coefficients corresponding to the LSP codebook indices every time they are supplied, and the synthesis filter 154 generates the speech signal according to the different filtering characteristics.

Since the remaining operation is the same as that of the foregoing embodiment 10, the description thereof is omitted here.

As described above, the present embodiment 16 is configured such that it carries out the inverse synthesis filtering of the input non-speech signal according to the filtering characteristics based on the LPC coefficients of the non-speech signal, generates the speech signal by carrying out the synthesis filtering of the generated signal according to the filtering characteristics based on the LP coefficients corresponding to the LSP samples of the codebook subset 7A, and selects the LSP samples that will minimize the error between the input non-speech signal and the speech signal. As a result, the present embodiment 16 offers an advantage of being able to carry out the quantization of the LSP coefficients of the non-speech signal appropriately.

Embodiment 17

Figure 26:
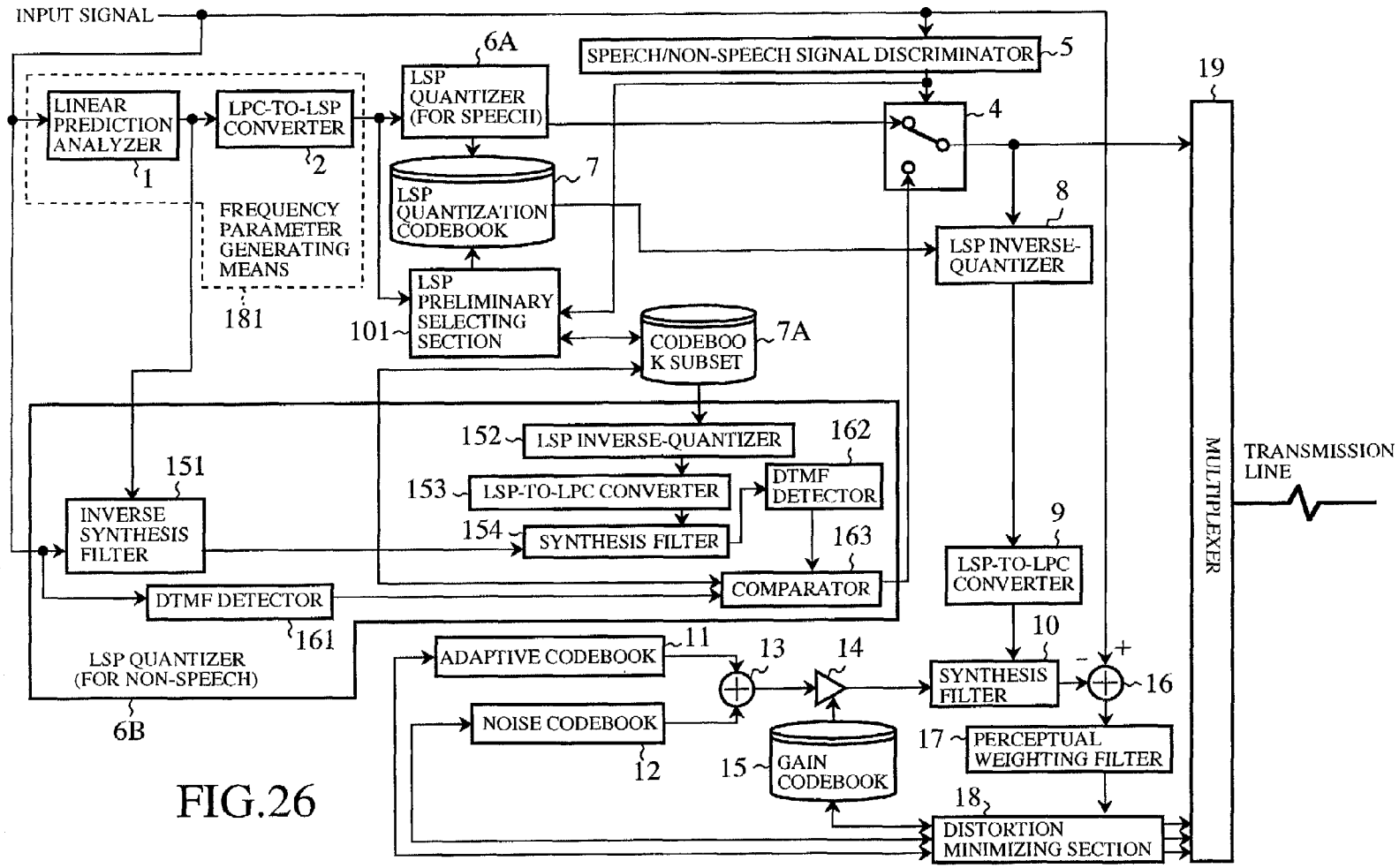
FIG. 26 is a block diagram showing a configuration of an embodiment 17 of the speech coding apparatus in accordance with the present invention.
Figure 27:
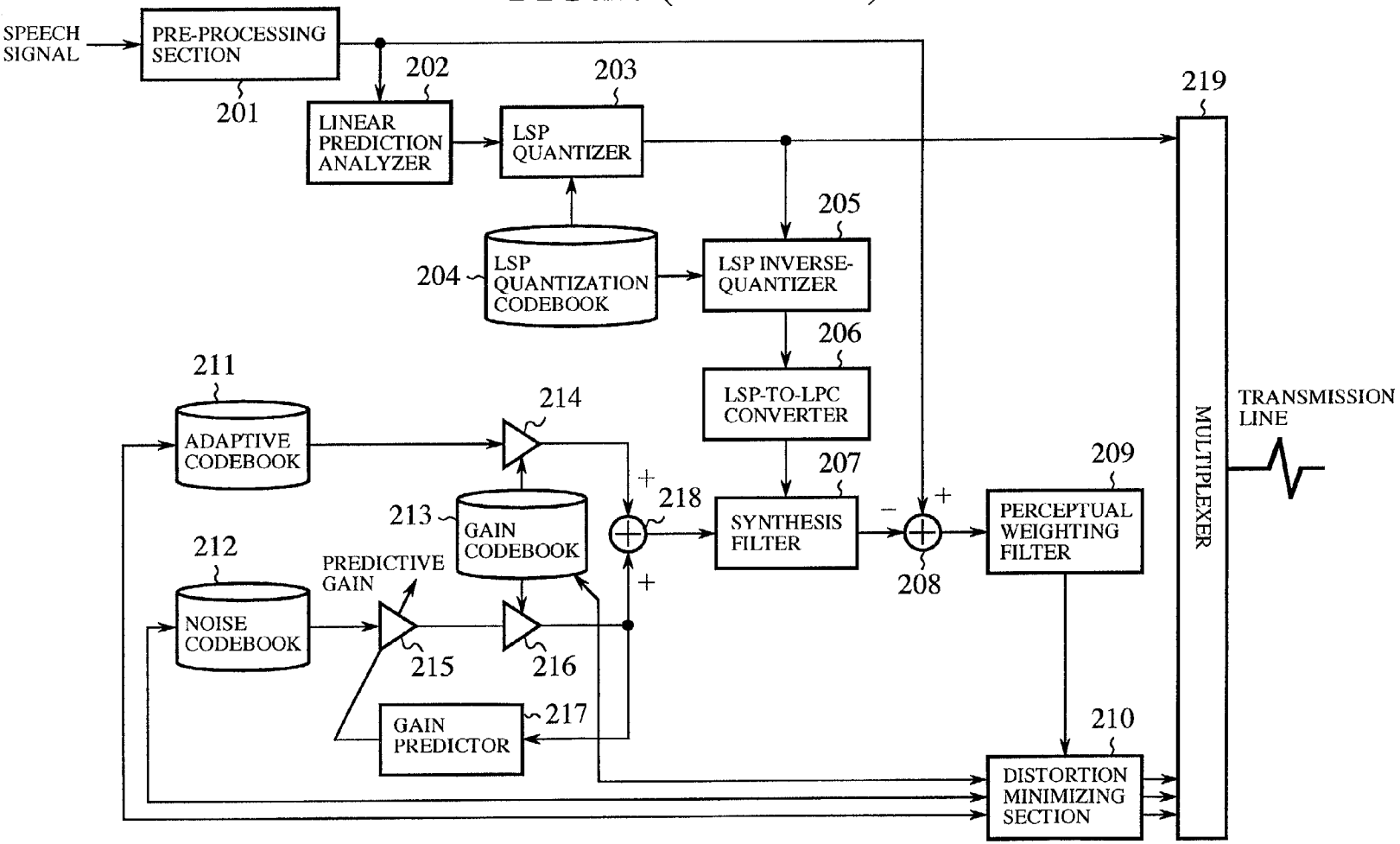
FIG.27 (PRIOR ART)
FIG. 27 is a block diagram showing a configuration of a first conventional speech coding apparatus using 8-kbit/s CS-ACELP.
Figure 28:
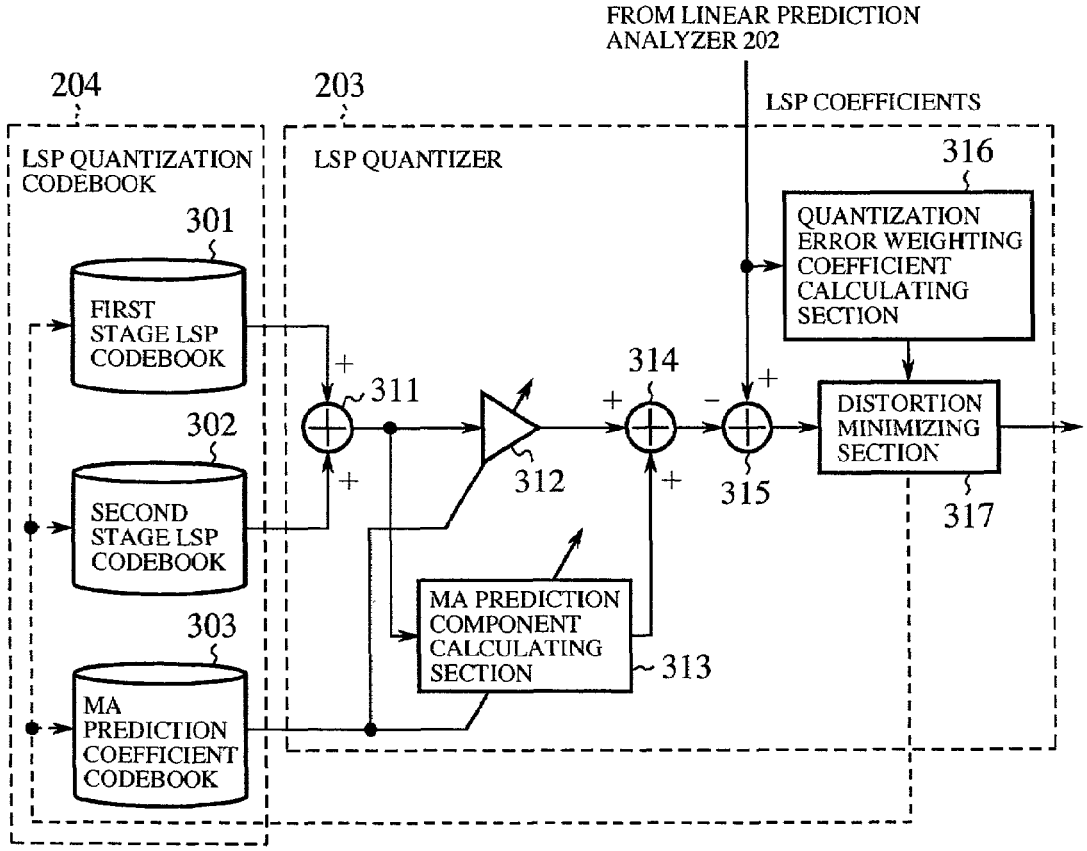
FIG.28 (PRIOR ART)
FIG. 28 is a block diagram showing a configuration of the LSP quantizer and LSP quantization codebook in FIG. 27.
Figure 29:
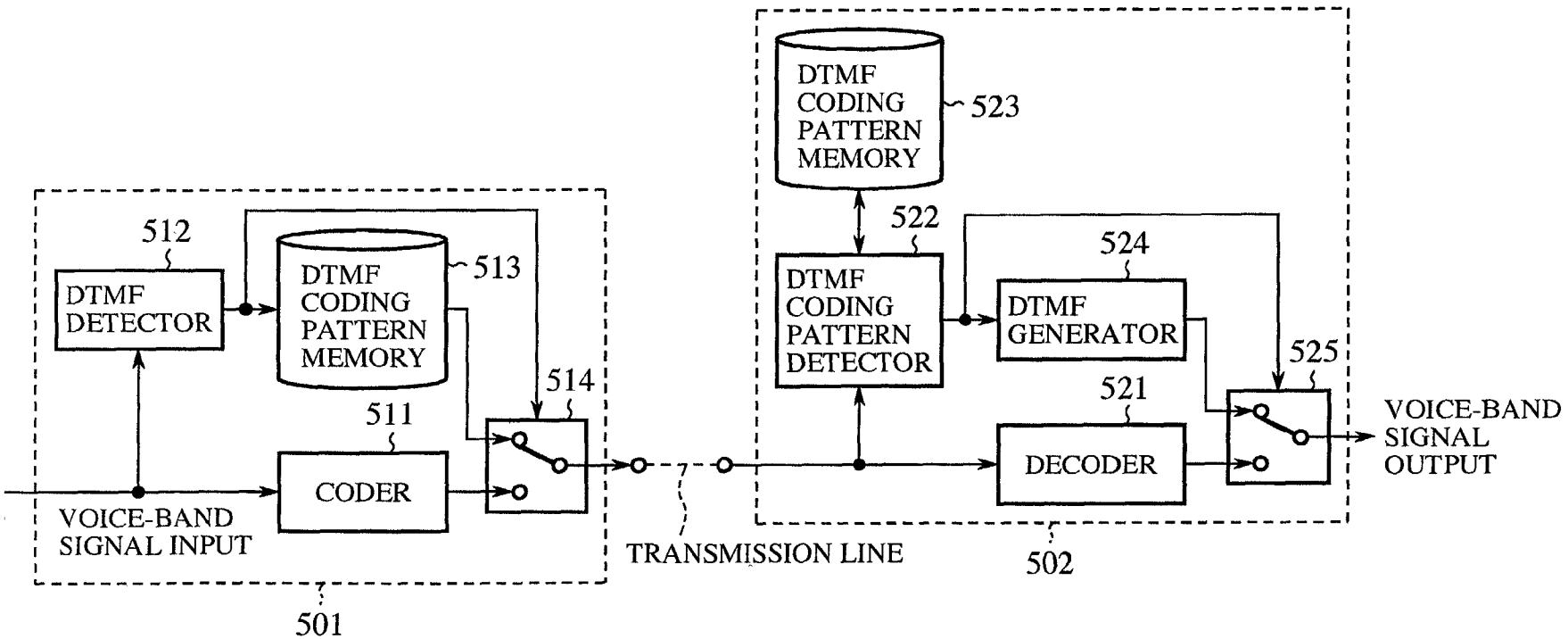
FIG.29 (PRIOR ART)
FIG. 29 is a block diagram showing a configuration of a second conventional speech coding apparatus.
Figure 30:
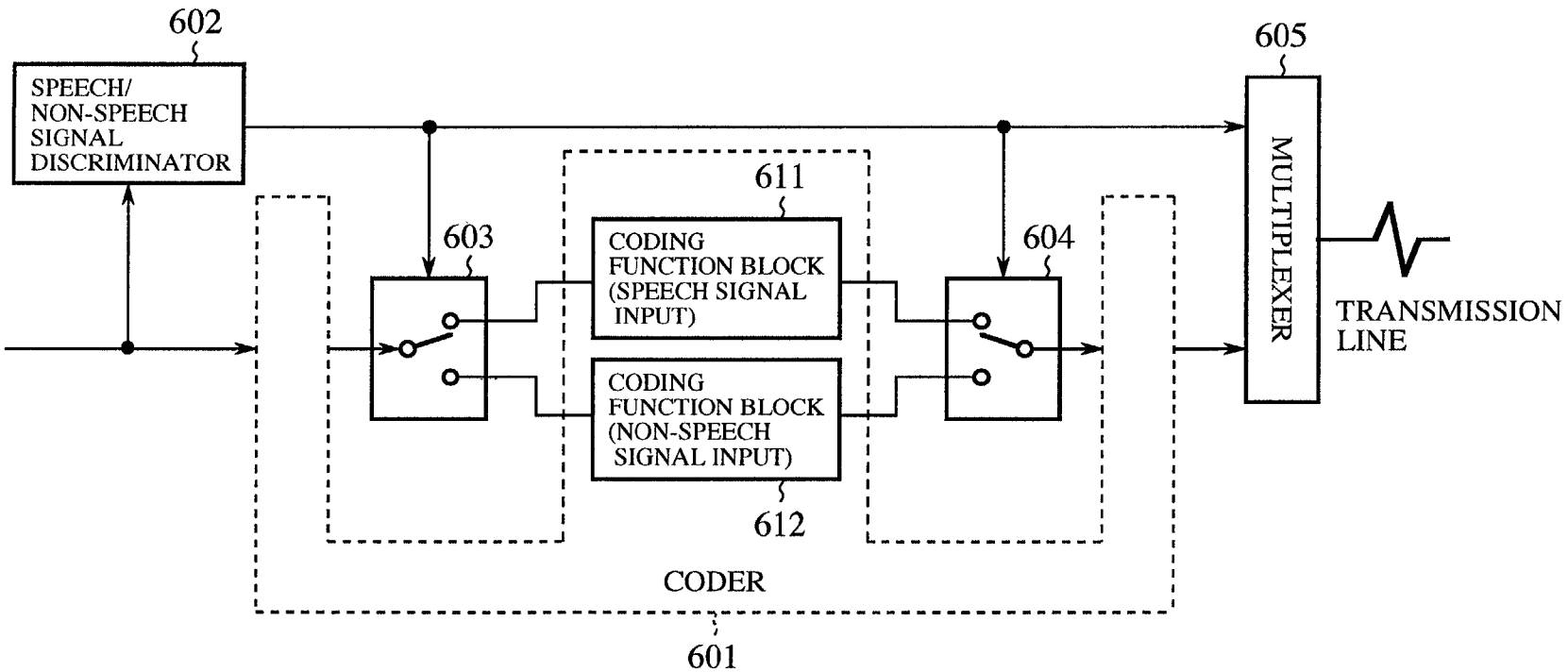
FIG.30 (PRIOR ART)
FIG. 30 is a block diagram showing a configuration of a speech coding apparatus proposed previously by the present assignee.
Figure 31:
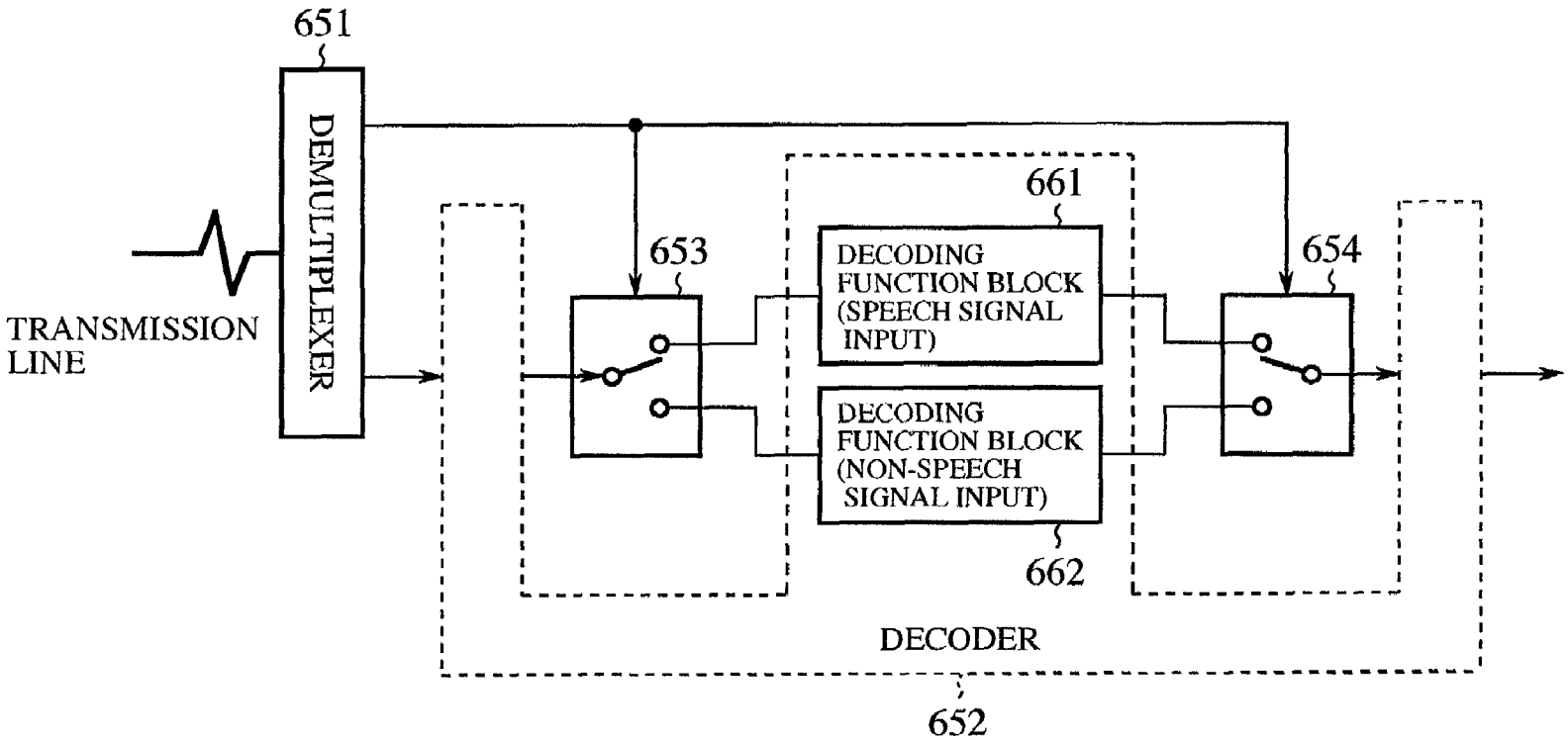
FIG.31 (PRIOR ART)
FIG. 31 is a block diagram showing a speech decoding apparatus for decoding the code generated by the speech coding apparatus as shown in FIG. 30.

FIG. 26 is a block diagram showing a configuration of an embodiment 17 of the speech coding apparatus in accordance with the present invention. In this figure, the reference numeral 161 designates a DTMF detector (first non-speech signal detector) for detecting the DTMF signals from the input signal; 162 designates a DTMF detector (second non-speech signal detector) for detecting the DTMF signals from the speech signal synthesized by the synthesis filter 154; and 163 designates a comparator for comparing the detection result by the DTMF detector 161 with the detection result by the DTMF detector 162, and selects the LSP samples that will equalize them from the codebook subset 7A. Since the remaining components of FIG. 26 are the same as those of the foregoing embodiment 16, the description thereof is omitted here.

Next, the operation of the present embodiment 17 will be described.

In the LSP quantizer 6B of the non-speech signal in the speech coding apparatus of the present embodiment 17, the DTMF detector 161 detects a DTMF signal from the input signal, and notifies the comparator 163 of the digit corresponding to the DTMF signal. On the other hand, the DTMF detector 162 detects a DTMF signal from the speech signal the synthesis filter 154, which is synthesized according to the filtering characteristics based on the LP coefficients corresponding to the LSP codebook indices, and notifies the comparator 163 of the digit corresponding to the DTMF signal.

The comparator 163 causes the codebook subset 7A to supply the LSP inverse-quantizer 152 with different LSP samples successively until the digit sent from the DTMF detector 161 becomes equal to the digit sent from the DTMF detector 162, and when the two digits become equal, the comparator 163 supplies the LSP codebook indices of the LSP samples to the selector switch 4.

Since the remaining operation is the same as that of the foregoing embodiment 16, the description thereof is omitted here. However, a plurality of candidates can be selected depending on the LSP samples in the codebook subset 7A, in which case, the one that will minimize the distortion can be selected as in the embodiment 16.

Although the DTMF signals are detected as the non-speech signal here, other non-speech signals can be handled in the same manner.

As described above, the present embodiment 17 is configured such that it detects the type of each input non-speech signal, and selects from the codebook subset 7A the LSP samples that will cause the same type of the non-speech signal to be detected from the synthesized speech signal. As a result, the present embodiment 17 offers an advantage of being able to reduce the time required for the quantization of the LSP coefficients of the non-speech signal with reducing the quantization distortion.

Incidentally, the foregoing embodiments 9–17 can comprise the LSP coefficient correcting section 3, bandwidth expanding section 61, white noise superimposing section 81 in front of the LSP quantizer 6B of the non-speech signal as in the embodiments 1–8.

Although the foregoing embodiments employ the CS-ACELP as the speech coding method, other speech coding methods are also applicable.

What is claimed is:

1. A speech coding apparatus for coding an input signal consisting of one of a speech signal and a voice-band non-speech signal, said speech coding apparatus comprising:

a discriminator for deciding as to whether the input signal is a speech signal or a non-speech signal;

a frequency parameter generator for outputting, when the input signal is the speech signal, frequency parameters that indicate characteristics of a frequency spectrum of the speech signal, and for outputting, when the input signal is the non-speech signal, frequency parameters obtained by correcting frequency parameters that indicate characteristics of a frequency spectrum of the non-speech signal;

a quantization codebook for storing codewords of a predetermined number of frequency parameters; and a quantizer for selecting codewords corresponding to the frequency parameters output from said frequency parameter generating means by referring to said quantization codebook, wherein said frequency parameter generator comprises a correcting section for interpolating frequency parameters between the frequency parameters of the input signal and frequency parameters of white noise when the input signal is the non-speech signal, and for replacing the frequency parameters of the input signal by the frequency parameters interpolated.

2. The speech coding apparatus according to claim 1, wherein the frequency parameters are line spectral pairs.

3. The speech coding apparatus according to claim 1, wherein said frequency parameter generator comprises a linear prediction analyzer for computing linear prediction coefficients from the input signal, at least one bandwidth expanding section for carrying out bandwidth expansion of the linear prediction coefficients when the input signal is the non-speech signal; and at least one converter for generating line spectral pairs from the linear prediction coefficients passing through the bandwidth expansion as the frequency parameters.

4. The speech coding apparatus according to claim 1, wherein said frequency parameter generator comprises at least one white noise superimposing section for superimposing white noise on the input signal when the input signal is the non-speech signal, and at least one linear prediction analyzer for computing linear prediction coefficients from the input signal on which the white noise is superimposed.

5. The speech coding apparatus according to claim 1, wherein said quantizer comprises a first quantization section for selecting, when the input signal is the speech signal, codewords of the input signal according to the frequency parameters of the speech signal by referring to quantization codebook, and a second quantization section for selecting, when the input signal is the non-speech signal, codewords of the input signal according to the frequency parameters of the non-speech signal by referring to quantization codebook.

6. The speech coding apparatus according to claim 1, further comprising a non-speech signal detector for detecting a type of the non-speech signal from the input signal, wherein said frequency parameter generator comprises a correcting section for correcting, when the input signal is the non-speech signal, the frequency parameters of the input signal according to the type of the non-speech signal detected by the non-speech signal detector.

7. A speech coding apparatus comprising:

a discriminator for deciding as to whether the input signal is a speech signal or a non-speech signal;

a frequency parameter generator for outputting, when the input signal is the speech signal, frequency parameters that indicate characteristics of a frequency spectrum of the speech signal, and for outputting, when the input signal is the non-speech signal, frequency parameters obtained by correcting frequency parameters that indicate characteristics of a frequency spectrum of the non-speech signal;

a quantization codebook for storing codewords of a predetermined number of frequency parameters; and a quantizer for selecting codewords corresponding to the frequency parameters output from said frequency parameter generating means by referring to said quantization codebook; and a selector for selecting a codeword that will minimize quantization distortion from a plurality of codewords, wherein said frequency parameter generator comprises a corrector for correcting the frequency parameters of the non-speech signal when the input signal is the non-speech signal, said corrector including one of three sets consisting of a plurality of correcting sections, a plurality of bandwidth expansion sections and a plurality of white noise superimposing sections, said correcting sections correcting the frequency parameters of the non-speech signal with different interpolation characteristics between the frequency parameters of the input signal and frequency parameters of white noise, said bandwidth expansion sections carrying out bandwidth expansion of the non-speech signal by different characteristics, and said white noise superimposing sections superimposing different level white noises on the input signal, and said frequency parameter generator generates the frequency parameters of a plurality of non-speech signal streams from the outputs of the corrector;

said quantizer includes a plurality of quantization sections for selecting codewords corresponding to the frequency parameters of the non-speech signal streams, and for outputting the codewords with quantization distortions at that time; and said selector selects codeword that will minimize quantization distortion from the plurality of codewords selected by said quantization sections.

8. A speech coding apparatus for coding an input signal consisting of one of a speech signal and a voice-band non-speech signal, said speech coding apparatus comprising:

a discriminator for deciding as to whether the input signal is a speech signal or a non-speech signal;

a frequency parameter generator for generating frequency parameters that indicate characteristics of a frequency spectrum of the input signal;

a quantization codebook for storing codewords of a predetermined number of frequency parameters;

at least one codebook subset including a subset of the codewords stored in the quantization codebook;

a quantizer for selecting, when said input signal is the speech signal, codewords corresponding to the frequency parameters of the input signal by referring to said quantization codebook, and for selecting, when said input signal is the non-speech signal, codewords corresponding to the frequency parameters of the input signal by referring to said codebook subset;

a codeword selector for adaptively selecting, from among the codewords in said quantization codebook, codewords with small quantization distortion involved in quantizing the frequency parameters of the non-speech signal, wherein said codebook subset includes the codewords output from said codeword selector; and a second frequency parameter generator for generating frequency parameters by interpolating between the frequency parameters of the input signal and frequency parameters of white noise, wherein said codeword selector quantizes the frequency parameters generated by said second frequency parameter generator, and selects the codewords of said codebook subset considering quantization distortion involved in the quantization.

9. The speech coding apparatus according to claim 8, wherein the frequency parameters are line spectral pairs.

10. The speech coding apparatus according to claim 8, further comprising a second frequency parameter generator including a linear prediction analyzer for computing linear prediction coefficients from the input signal, a bandwidth expansion section for carrying out bandwidth expansion of the linear prediction coefficients, and a converter for generating, as the frequency parameters, line spectral pairs from the linear prediction coefficients passing through the bandwidth expansion, wherein said codeword selector quantizes the frequency parameters generated by said second frequency parameter generator, and selects the codewords of said codebook subset considering quantization distortion involved in the quantization.

11. The speech coding apparatus according to claim 8, further comprising a second frequency parameter generator including a white noise superimposing section for superimposing white noise on the input signal, and a converter for generating the frequency parameters from the input signal on which the white noise is superimposed, wherein said codeword selector quantizes the frequency parameters generated by said second frequency parameter generator, and selects the codewords of said codebook subset considering quantization distortion involved in the quantization.

12. The speech coding apparatus according to claim 8, wherein said frequency parameter generator comprises:

a linear prediction analyzer for computing linear prediction coefficients from the input signal; and an LPC-to-LSP converter for converting the linear prediction coefficients into line spectral pairs used as the frequency parameters; and wherein said quantizer comprises:

an inverse synthesis filter for carrying out inverse synthesis filtering of the input signal according to filtering characteristics based on the linear prediction coefficients when the input signal is the non-speech signal;

an LSP inverse-quantization section for generating line spectral pairs by dequantizing codewords in said codebook subset when the input signal is the non-speech signal;

an LSP-to-LPC converter for converting the line spectral pairs generated by said LSP inverse-quantization section into linear prediction coefficients;

a synthesis filter for carrying out synthesis filtering of the signal generated by said inverse synthesis filter according to filtering characteristics based on the linear prediction coefficients output from said LSP-to-LPC converter; and a distortion minimizing section for selecting codewords that will minimize quantization distortion when the input signal is the non-speech signal according to errors between the input signal and the speech signal synthesized by said synthesis filter.

13. The speech coding apparatus according to claim 8, wherein said frequency parameter generator comprises:

a linear prediction analyzer for computing linear prediction coefficients from the input signal; and an LPC-to-LSP converter for converting the linear prediction coefficients into line spectral pairs used as the frequency parameter; and wherein said quantization means comprises:

an inverse synthesis filter for carrying out inverse synthesis filtering of the input signal according to filtering characteristics based on the linear prediction coefficients when the input signal is the non-speech signal;

an LSP inverse-quantization section for generating line spectral pairs by dequantizing codewords in said codebook subset when the input signal is the non-speech signal;

an LSP-to-LPC converter for converting the line spectral pairs generated by said LSP inverse-quantization section into linear prediction coefficients;

a synthesis filter for carrying out synthesis filtering of the signal generated by said inverse synthesis filter according to filtering characteristics based on the linear prediction coefficients output from said LSP-to-LPC converter;

a first non-speech signal detector for detecting a non-speech signal from the input signal;

a second non-speech signal detector for detecting a non-speech signal from the speech signal output from said synthesis filter; and a comparator for selecting codewords that will make a type of the non-speech signal that is detected by said first non-speech signal detector identical to a type of the non-speech signal that is detected by said second non-speech signal detector.

14. The speech coding apparatus according to claim 8, further comprising an optimizer for causing said quantization means to select optimum codewords according to a closed loop search method by comparing the input signal with a signal that is decoded from the codewords selected by said quantizer.

15. A speech coding method for coding input signals including at least one speech signal and at least one voice-band non-speech signal, said method comprising:

classifying each of the input signals as speech or non-speech;

obtaining frequency parameters characterizing a frequency spectrum for each of the classified input signals; and referring to a common quantization codebook to select codewords corresponding to the frequency parameters obtained for both the input signals classified as speech and non-speech, wherein the obtaining frequency parameters further comprises:

for each of the input signals classified as non-speech, performing the following:

interpolating frequency parameters between the frequency parameters of the input signal and frequency parameters of white noise; and replacing the frequency parameters of the input signal with the interpolated frequency parameters.

16. The method according to claim 15, wherein the obtaining frequency parameters is performed by:

computing linear prediction coefficients from the input signals;

carrying out bandwidth expansion of the linear prediction coefficients of each of the input signals classified as non-speech; and generating line spectral pairs for both the linear prediction coefficients of the input signals classified as speech and the bandwidth-expanded linear prediction coefficients of the input signals classified as non-speech.

17. The method according to claim 15, further comprising:

superimposing white noise on each of the input signals classified as non-speech, wherein the obtaining frequency parameters is performed by:

computing linear prediction coefficients of both the input signals classified as speech and the input signals classified as non-speech, on which white noise is superimposed; and generating line spectral pairs from the computed linear prediction coefficients.

18. The method according to claim 15, wherein the referring to a common quantization codebook is performed for each of the input signals classified as non-speech by:

removing codewords from the quantization codebook that are capable of causing large frequency distortion for non-speech signals; and using, to select the codewords for the input signal from the common quantization codebook, indices that are also used to select the codewords for the input signals classified as speech.

19. The method according to claim 15, wherein the referring to a common quantization codebook is performed for each of the input signals classified as non-speech by:

extracting a subset of codewords from the quantization codebook that are not capable of causing large frequency distortion for non-speech signals; and selecting the codewords for the input signal from the extracted subset using indices, which are also used to select the codewords from the common quantization codebook for the input signals classified as speech.

* * * * *